US006883277B2

(12) United States Patent
Wiechecki et al.

(10) Patent No.: US 6,883,277 B2
(45) Date of Patent: Apr. 26, 2005

(54) FLOOR-TO-CEILING WALL PANEL SYSTEM

(75) Inventors: Robert W. Wiechecki, Boothwyn, PA (US); Michael F. Cifelli, Thorndale, PA (US)

(73) Assignee: Kimball International, Inc., Jasper, IN (US)

( * ) Notice: Subject to any disclaimer, the term of this patent is extended or adjusted under 35 U.S.C. 154(b) by 0 days.

(21) Appl. No.: 10/162,293

(22) Filed: Jun. 4, 2002

(65) Prior Publication Data

US 2003/0089057 A1 May 15, 2003

Related U.S. Application Data

(60) Provisional application No. 60/298,756, filed on Jun. 15, 2001.

(51) Int. Cl.[7] ..... E04B 2/76

(52) U.S. Cl. ..... 52/36.6; 52/36.4; 52/36.5; 52/238.1; 52/272; 52/481.2; 52/656.9

(58) Field of Search ..... 52/36.1, 36.4–36.6, 52/238.1, 481, 656.9, 657, 655.1, 272; 446/122, 123; 403/260, 262, 205

(56) References Cited

U.S. PATENT DOCUMENTS

| | | | | | |
|---|---|---|---|---|---|
| 1,850,118 | A | * | 3/1932 | Meyers | 52/223.6 |
| 2,737,268 | A | * | 3/1956 | Smith | 403/21 |
| 3,045,784 | A | | 7/1962 | Hasekamp | 189/34 |
| 3,282,006 | A | | 11/1966 | Halsey et al. | 52/475 |
| 3,462,892 | A | | 8/1969 | Meyer | 52/28 |
| 4,100,709 | A | | 7/1978 | Good | 52/239 |
| 4,180,298 | A | * | 12/1979 | Borgerson, Jr. | 312/242 |
| 4,245,448 | A | | 1/1981 | Agar | 52/489 |
| 4,250,676 | A | | 2/1981 | Presby | 52/222 |
| 4,329,003 | A | * | 5/1982 | Manchester | 312/245 |
| 4,347,015 | A | * | 8/1982 | Olashaw | 403/219 |
| 4,401,222 | A | * | 8/1983 | Kulikowski et al. | 211/94.01 |

(Continued)

FOREIGN PATENT DOCUMENTS

| | | |
|---|---|---|
| GB | 1098851 | 1/1968 |
| WO | WO 00/24980 | 5/2000 |

*Primary Examiner*—Robert Canfield
(74) *Attorney, Agent, or Firm*—Baker & Daniels

(57) ABSTRACT

A floor-to-ceiling wall panel system, in which each panel includes a universal frame adjustably attached to a floor track member which rests on a floor surface, the frame additionally including a jack post assembly for releasable connection to a ceiling track fastened to a ceiling. The panel system includes a number of multi-functional components, thereby reducing the number of components in the panel system and facilitating easier installation of the panel system as well its easier modification of the panel system once installed. For example, a single track member may serve as both the floor track and the ceiling track. Also, a single type of spring clip may be used to attach several components to the frame, such as opaque panel skins and window panels, is well as to attach trim pieces to the floor and ceiling tracks, which mask the adjustable connections of the panel frame thereto.

12 Claims, 63 Drawing Sheets

U.S. PATENT DOCUMENTS 4,457,436 A * 7/1984 Kelley ..... 211/88.01
4,485,602 A 12/1984 Flamboe, Jr. et al. ..... 52/239
4,607,762 A 8/1986 Zulauf et al. ..... 222/48
4,610,561 A 9/1986 Cecchellero et al. ..... 403/171
4,660,339 A 4/1987 Paz ..... 52/238.1
4,685,255 A 8/1987 Kelley ..... 52/36
4,688,358 A * 8/1987 Madray ..... 52/93.2
4,703,593 A 11/1987 Smolik ..... 52/34
4,833,848 A 5/1989 Guerin ..... 52/242
4,876,835 A 10/1989 Kelley et al. ..... 52/239
4,905,428 A 3/1990 Sykes ..... 52/126.4
5,054,255 A 10/1991 Maninfior ..... 52/239
5,056,577 A 10/1991 DeLong et al. ..... 160/135
5,058,347 A 10/1991 Schuelke et al. ..... 52/339
5,062,246 A 11/1991 Sykes ..... 52/126.4
5,094,053 A 3/1992 Militzer ..... 52/238.1
5,175,969 A 1/1993 Knauf et al. ..... 52/239
5,219,406 A 6/1993 Raz ..... 160/135
5,241,796 A 9/1993 Hellwig et al. ..... 52/36.4
5,277,005 A 1/1994 Hellwig et al. ..... 52/220.1
5,297,888 A 3/1994 Nehls ..... 403/306
5,309,686 A 5/1994 Underwood et al. ..... 52/29
5,347,778 A 9/1994 Bray ..... 52/239
5,392,934 A * 2/1995 Fox ..... 211/94.01
5,394,668 A 3/1995 Lim ..... 52/483.1
5,428,928 A * 7/1995 Hellwig et al. ..... 52/239
5,634,300 A 6/1997 Huebner et al. ..... 52/36.1
5,642,593 A * 7/1997 Shieh ..... 52/239
5,768,845 A 6/1998 Beaulieu et al. ..... 52/585.1
5,784,843 A 7/1998 Greer et al. ..... 52/220.7
5,802,789 A 9/1998 Goodman et al. ..... 52/239
5,899,035 A 5/1999 Waalkes et al. ..... 52/239
5,930,963 A 8/1999 Nichols ..... 52/239
5,950,386 A 9/1999 Shipman et al. ..... 52/481.2
5,966,879 A * 10/1999 Verbeek et al. ..... 52/205
6,052,958 A 4/2000 Miedema et al. ..... 52/284
6,076,317 A * 6/2000 Hellwig et al. ..... 52/239
6,115,977 A 9/2000 Hornberger et al. ..... 52/238.1
6,128,876 A 10/2000 Nitschke et al. ..... 52/239
6,131,347 A * 10/2000 Hornberger et al. ..... 52/238.1
6,155,014 A 12/2000 Wagner ..... 52/281
6,202,381 B1 3/2001 Dame et al. ..... 52/745.1
6,230,459 B1 * 5/2001 Jeffers et al. ..... 52/239
6,240,687 B1 * 6/2001 Chong ..... 52/238.1
6,374,547 B1 * 4/2002 Baloga et al. ..... 52/36.1
6,449,909 B1 * 9/2002 Baloga et al. ..... 52/36.1
6,463,701 B1 * 10/2002 Baloga et al. ..... 52/29
2001/0029707 A1 * 10/2001 Hsueh ..... 52/36.4
2002/0139079 A1 * 10/2002 Brady ..... 52/653.1
2004/0093805 A1 * 5/2004 Underwood et al. ..... 52/36.1

* cited by examiner

FLOOR-TO-CEILING WALL PANEL SYSTEM

CROSS REFERENCE TO RELATED APPLICATIONS

This application claims the benefit under Title 35, U.S.C. § 119(e) of U.S. Provisional Patent Application Ser. No. 60/298,756, entitled FLOOR-TO-CEILING WALL PANEL SYSTEM, filed on Jun. 15, 2001.

BACKGROUND OF THE INVENTION

1. Field of the Invention

The present invention relates to office partition systems, and more particularly, to a movable office panel system including panels which extend between the floor and the ceiling of an office space.

2. Description of the Related Art

Floor-to-ceiling office panel systems typically include individual panel units associated with the existing permanent walls of an office space, the panel units extending between the floor and the ceiling of the office space and dividing same into multiple rooms, such as individual offices, conference rooms, and the like. Typically, such panel systems are custom designed and manufactured for a particular office space according to a predetermined office floor plan, and are installed in a relatively permanent manner within the office space. Therefore, such panel systems tend to be rather costly and difficult to install, and often cannot be relocated if modifications to the office floor plan are desired.

For example, existing panel systems typically include heavy, rigid frames made from frame members which are cut to a pre-measured length and permanently welded to one another. Additionally, the panel frames typically include a large number of additional components for attaching the panel frames to one another, and also for attaching the panel frames to the floor and to the ceiling of the office space. Typically, such components are specifically designed for a particular use, or for a specific type of panel-to-panel connection, such as a T-, L-, or X-type connection, and may only be used for such specific connection or other specialized use. The large amount of such parts increases both the cost and the difficulty of manufacturing and installing existing floor-to-ceiling panel systems.

As a result of the complexity of the design of existing floor-to-ceiling wall panel systems, the installation, modification, and removal of same typically require trained and experienced work crews, such that modifications to the configuration of the panel system, to the extent that any such modifications are allowed by the design of the system, cannot easily be made.

What is needed is a floor-to-ceiling wall panel system which is an improvement over the foregoing; specifically, a floor-to-ceiling wall panel system which includes a minimal number of components, is easy to install and easy to modify after installation, and which can accommodate existing modular office components.

SUMMARY OF THE INVENTION

The present invention provides a floor-to-ceiling wall panel system in which each panel includes a universal frame adjustably attached to a floor track member which rests on a floor surface, the frame additionally including a jack post assembly for releasable connection to a ceiling track fastened to a ceiling. The panel system includes a number of multi-functional components, thereby reducing the total number of components in the panel system and facilitating easier installation of the panel system, as well as easier modification of the panel system once installed.

For example, a single track member may serve as both the floor track and the ceiling track. Also, a single type of spring clip may be used to attach several components to the panel frames, such as opaque panel skins and window panels, for example. Also, the spring clips are used to attach trim pieces to the floor and ceiling tracks which mask the adjustable connections of the panel frames to the floor and ceiling. Further use of the spring clips are described in detail below.

The frame includes vertical frame members each formed by a pair of C-shaped vertical sub-frame members which are attached to one another in a back-to-back manner to form a vertical frame member having an I-shaped cross section for structural rigidity. Corner blocks are captured in the upper and lower ends of the vertical frame members, and serve as attachment points for horizontal frame members to the vertical frame members. The corner blocks may be selectively configured in a support block mode for attachment to a lower horizontal frame member to provide a vertically adjustable connection between the frame and the floor track, or the corner blocks may be configured in a jack post block mode for attachment to an upper horizontal frame member to provide an adjustable, releasable connection between the frame and the ceiling track.

A single panel connecting bracket may be attached to the corner blocks of adjacent panels to connect same in and end-to-end relationship, as well as to connect additional panels thereto to form building module L-type connections, T-type connections, or X-type connections between multiple panels. Further, a corner post is provided, which may also be used as desired to provide the foregoing types of connections in a furniture module mode. In an alternative embodiment, cam locks are provided to attach panels together to form the above connections.

An intermediate horizontal frame member may be attached to the vertical frame members at horizontal levels with respect thereto which may vary in increments up to one-eighth of an inch. Electrical and or data wiring harness assemblies may be attached to the floor track to provide electrical and data service throughout the lower region of panel system, or alternatively, may be attached to an intermediate frame member to provide electrical and data service throughout the panel system at any mid-height level. Existing mounting tracks may be secured to the horizontal frame members, or alternatively, to an intermediate frame member, to provide an attachment interface for existing modular furniture components, such as work surfaces, cabinets, shelves, and the like.

In this manner, the mounting tracks, when attached to the intermediate frame members, may be disposed at virtually any vertical level with respect to the surrounding panel frame. The foregoing construction allows the mounting tracks of the panels in the panel system to be aligned with identical mounting tracks which are mounted to permanent walls of an interior office space to provide aesthetic, visual continuity between the panel system and the permanent walls of the office space.

Advantageously, the present floor-to-ceiling wall panel system includes a universal frame which is easily assembled to any desired dimension, and which is configured to accept opaque panels skins, window panels, or any desired combination thereof.

In one form thereof, the present invention provides a partition system for partitioning a work space, including a frame, the frame including at least one vertical frame member having a series of substantially vertically aligned first holes therein, and at least one horizontal frame member, at least one bracket having a first portion attached to the horizontal frame member and a second portion having at least one second hole therein adapted to align with at least one of the first holes in the vertical frame member; at least one fastening element inserted through the first and second holes to secure the horizontal frame member to the vertical frame member; and a track member supported horizontally on the horizontal frame member, the track member configured for attachment of modular furniture components thereto.

In another form thereof, the present invention provides the combination of a permanent wall having a first track member horizontally supported thereon, the first track member configured for attachment of a modular furniture component thereto; and a partition system frame having at least one horizontal frame member, and a second track member horizontally supported on the at least one horizontal frame member, the second track member configured for attachment of a modular furniture component thereto; wherein the partition system frame is disposed adjacent the permanent wall, and wherein the first track member of the permanent wall is horizontally aligned with the second track member of the partition system frame.

In a further form thereof, the present invention provides a partition system for partitioning a work space, including a frame including at least one vertical frame member and at least one horizontal frame member; a least one spring clip removably attached to one of the horizontal and the vertical frame members, the spring clip including a spring body portion with a pair of leg portions extending therefrom, one of the leg portions and the spring body portion engaging the one frame member; and a partition system component including a receiving element to which is attached the other of the leg portions and the spring body portion of the spring clip, the spring clip thereby attaching the partition system component to the frame member.

In a further form thereof, the present invention provides a partition system for partitioning a work space, including a floor track; a ceiling track; a frame disposed intermediate the floor track and the ceiling track, including upper and lower horizontal frame members, and at least one vertical frame member having an upper portion and a lower portion; first and second corner blocks, the first corner block attached to the upper portion of the vertical frame member and connecting the upper horizontal frame member thereto, the second corner block attached to the lower portion of the vertical frame member and connecting the lower horizontal frame member thereto; the first corner block further including a first engagement assembly connecting the frame, to the ceiling track; and the second corner block further including a second engagement assembly connecting the frame to the floor track.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunct on with the accompanying drawings, wherein:

FIG. 91 is an end view of a panel frame, showing the connection of an intermediate horizontal frame member thereto, with the intermediate horizontal frame member disposed 12 and three eighths inches above the floor surface;

Corresponding reference characters indicate corresponding parts throughout the several views. The exemplifications set out herein illustrate embodiments of the invention, in several forms, and such exemplifications are not to be construed as limiting the scope of the invention in any manner.

DETAILED DESCRIPTION

Figure 1:
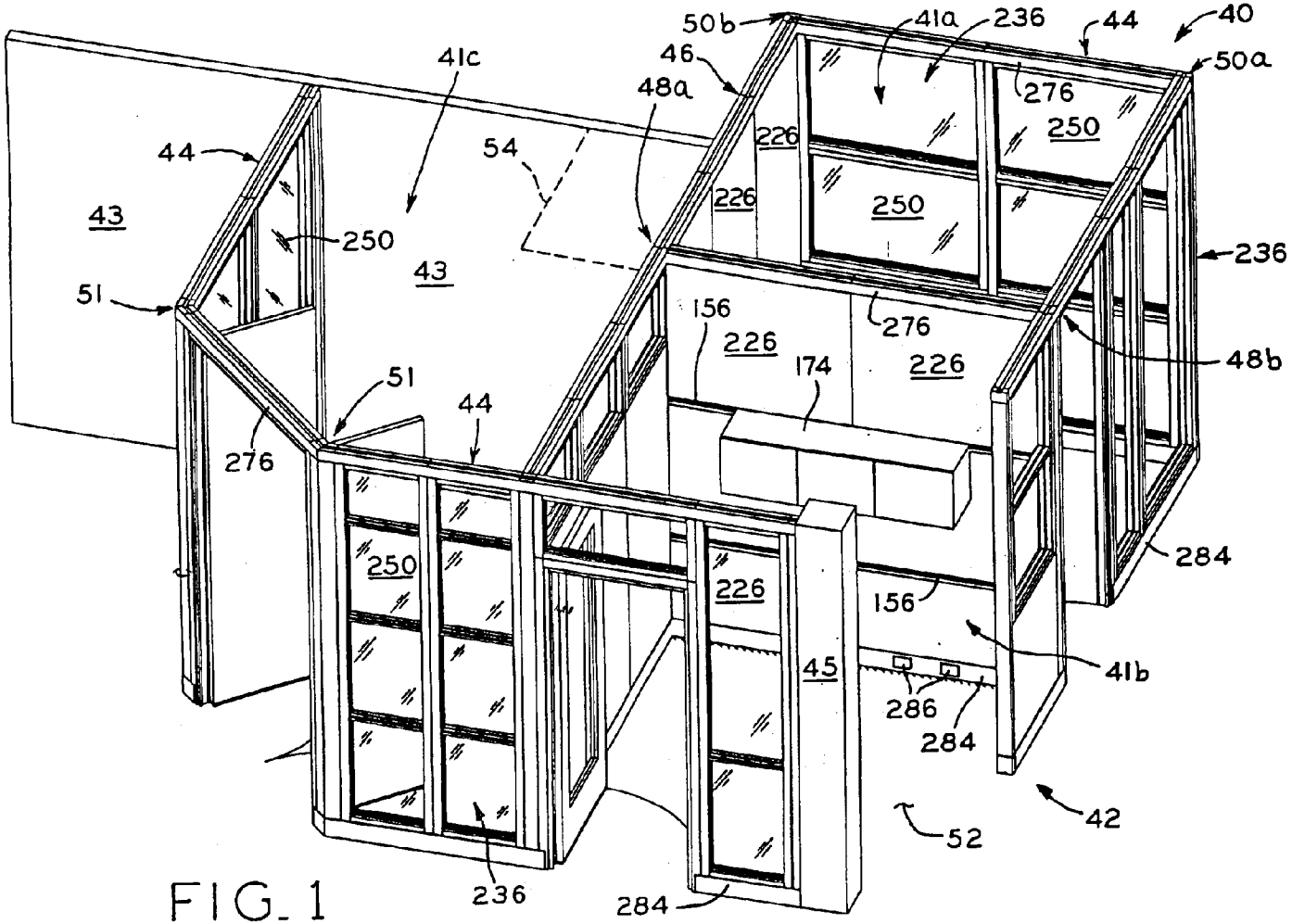
FIG. 1 is a perspective view of an exemplary office space including a floor-to-ceiling panel system in accordance with the present invention, the panel system including a variety of differently configured individual partition panels.

Referring to FIG. 1, office space 40 is shown, including floor-to-ceiling wall panel system 42. Floor-to-ceiling wall panel system 42 includes a plurality of individual partition panels 41 which may attached to one another, for example, by end-to-end connections 46, T-type connections 48*a*, 48*b*, L-type connections 50*a*, 50*b*, and X-type connections (not shown). Panels 44 may also be attached to permanent walls 43 or permanent columns 45 of the building within which office space 40 is disposed, wherein panels extend from floor 52 to ceiling 54 of office space 40 to define individual, partitioned office spaces 41*a*, 41*b*, 41*c*, which may be offices, work stations, conference rooms, reception rooms, and common areas, for example. Further, as shown in FIG. 1, panels 44 may include opaque panel skins 226, window panels 236, or any desired combination of the foregoing, as described further below.

More particularly, the individual partition panels 44 are attached to one another, for example, by end-to-end connections 46, building module T-type connections 48*a*, furniture module T-type connections 48*b*, building module L-type connections 50*a*, furniture module L-type connections 50*b*, and furniture and module or building module X-type connections (not shown), each of which is described further below. Generally, building module connections between panels 44 allow panels 44 to follow the existing ceiling grid structure within a building, and do not employ corner posts at the L-, T-, or X-type connections between panels 44, while furniture module connections may or may not follow the existing ceiling grid structure within a building and employ corner posts at the L-, T-, or X-type connections between panels 44. Office space 41*c* additionally includes a pair of 135 degree panel-to-panel connections 51, as also described further below.

Figure 2A:
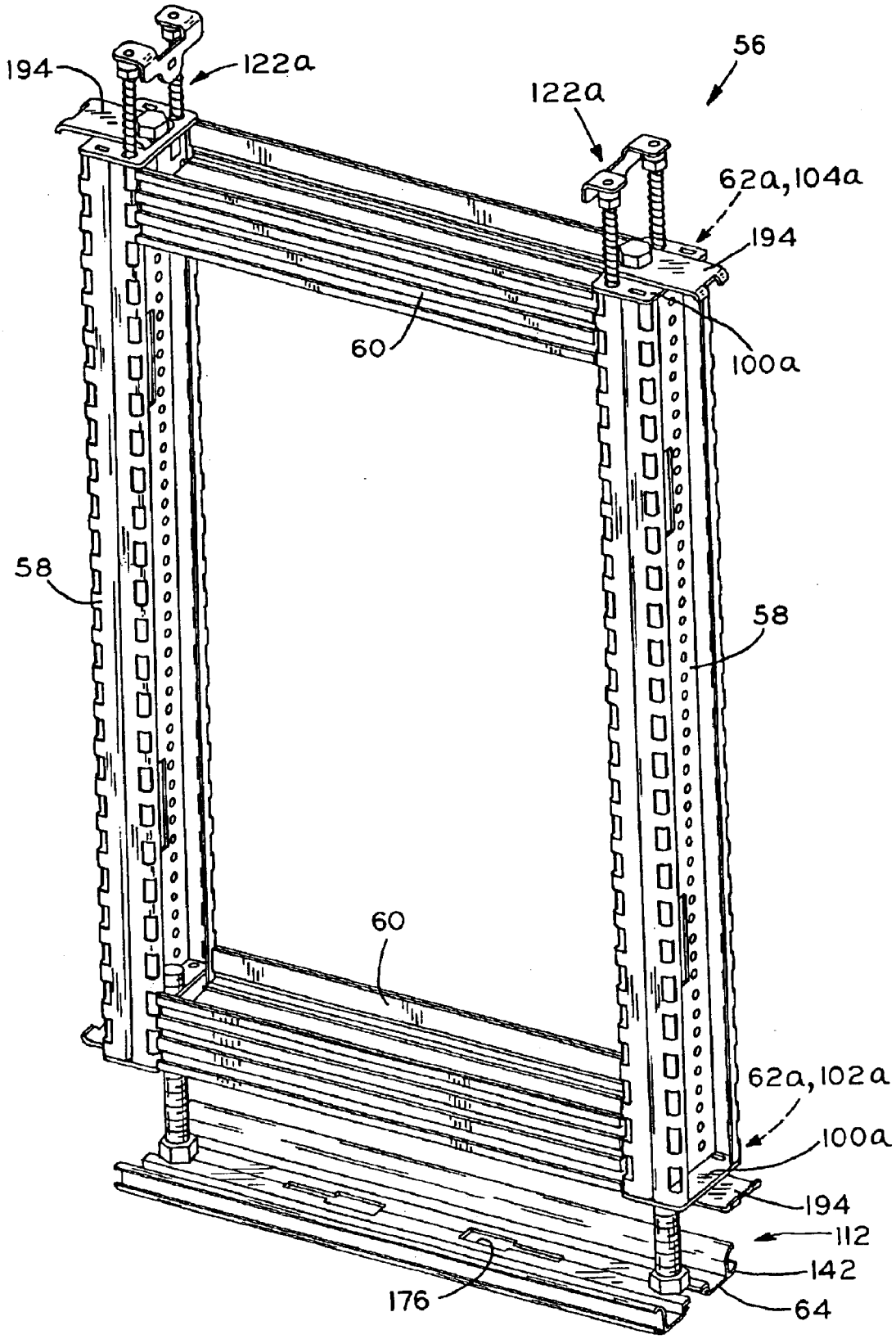
FIG. 2A is a perspective view of a universal frame including corner blocks according to a first embodiment.
Figure 2B:
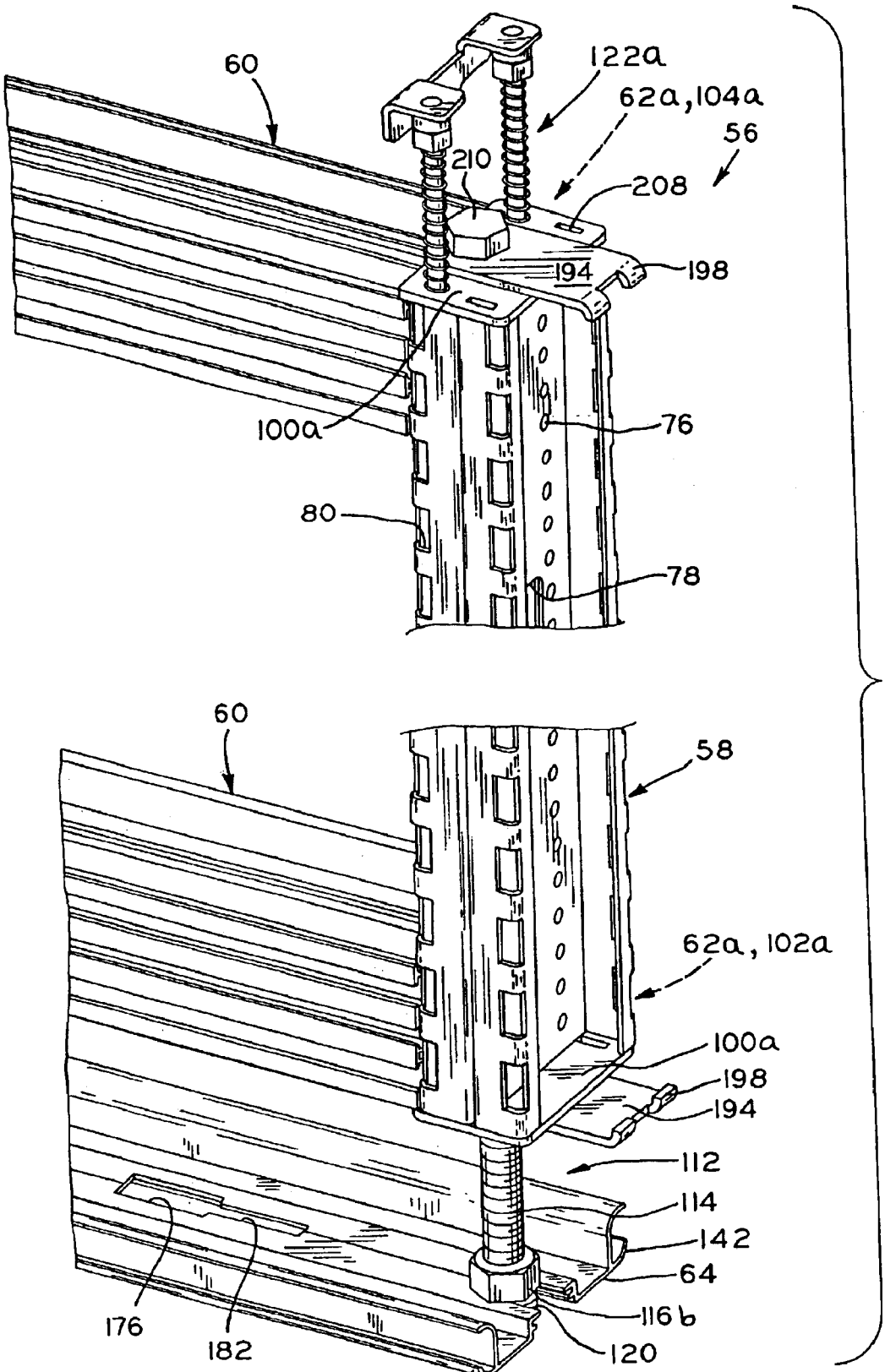
FIG. 2B is a perspective view of upper and lower corner portions of the universal frame of FIG. 2A.
Figure 3A:
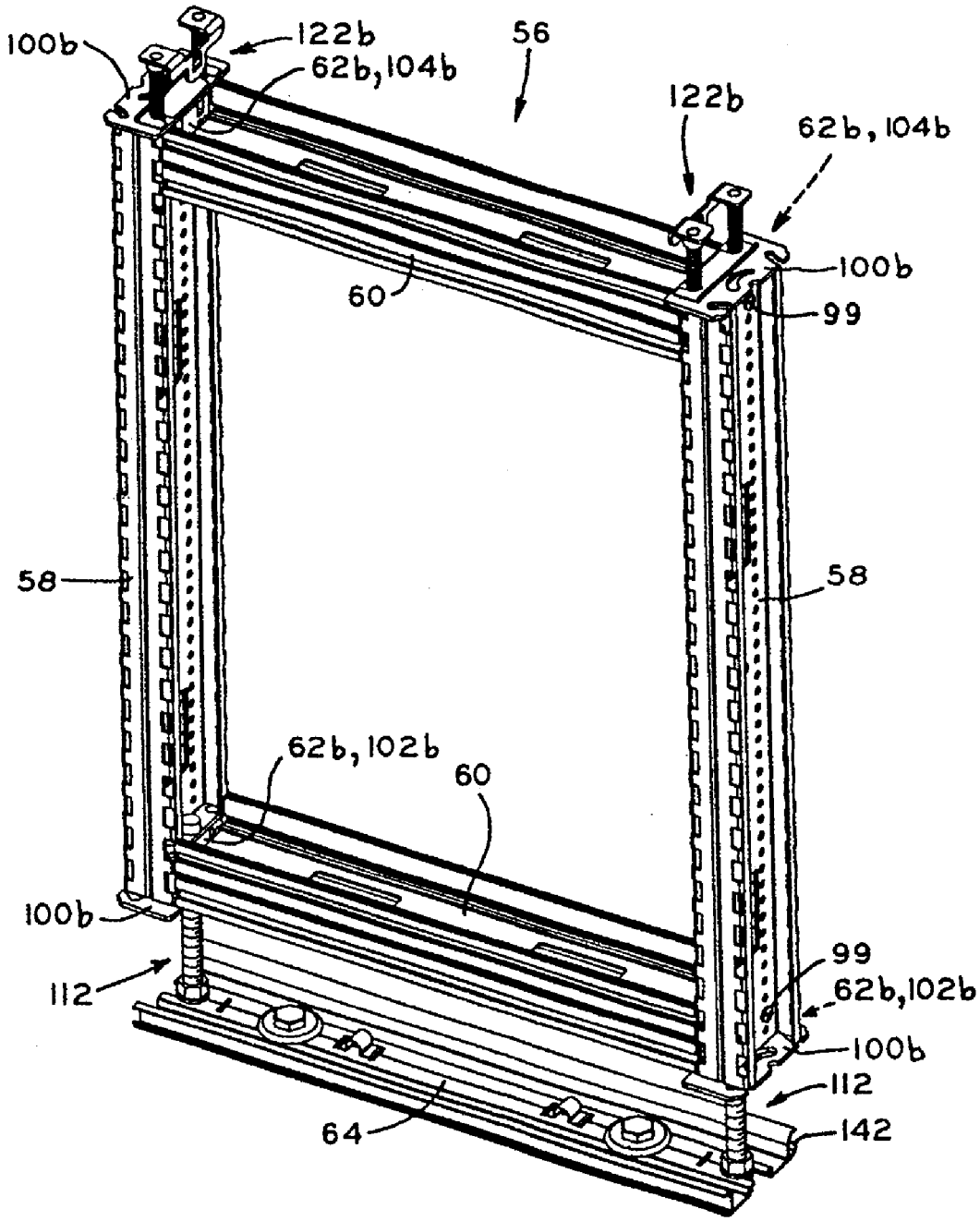
FIG. 3A is a perspective view of a universal frame including corner blocks according to a second embodiment.
Figure 3B:
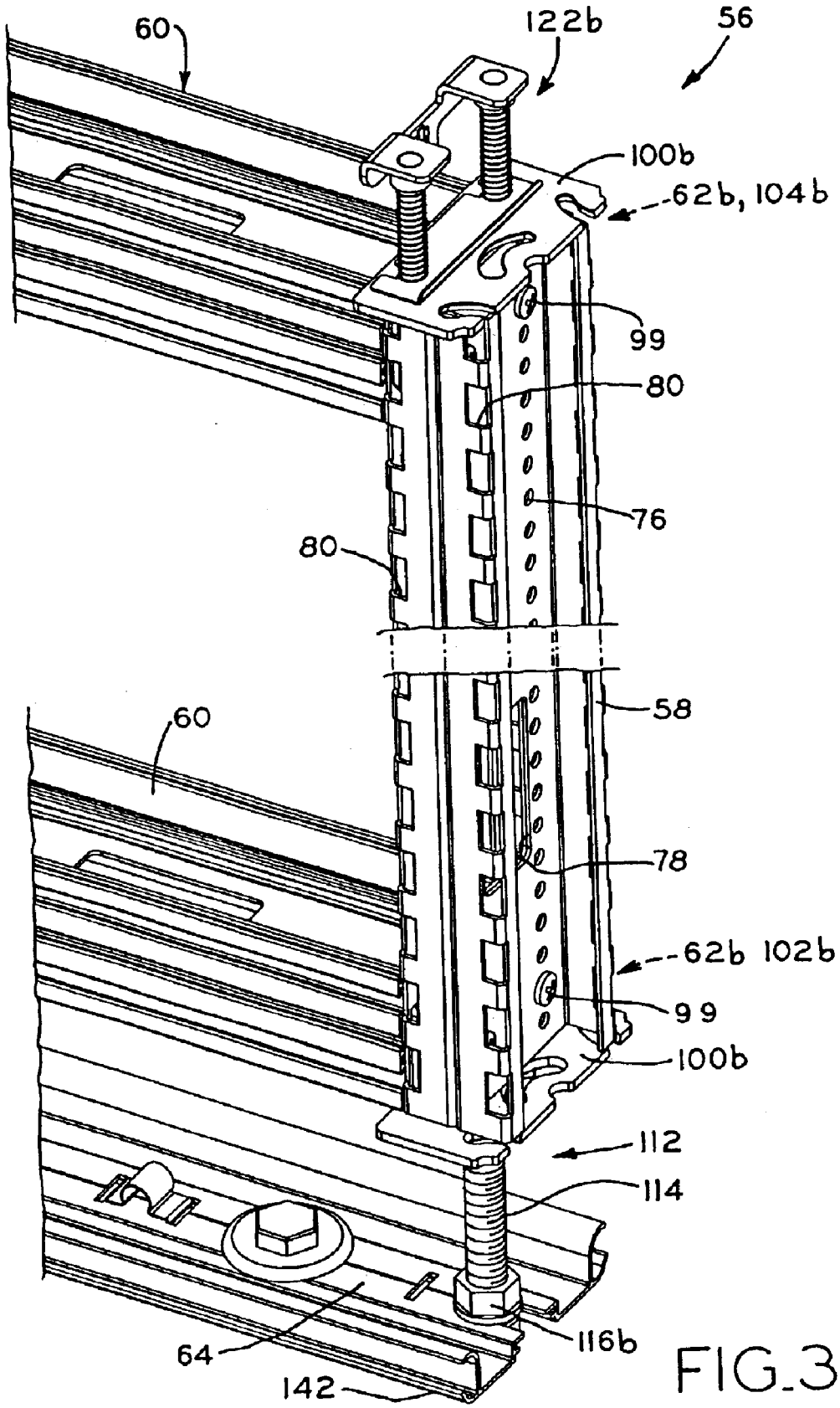
FIG. 3B is a perspective view of upper and lower corner portions of the universal frame of FIG. 3A.
Figure 3C:
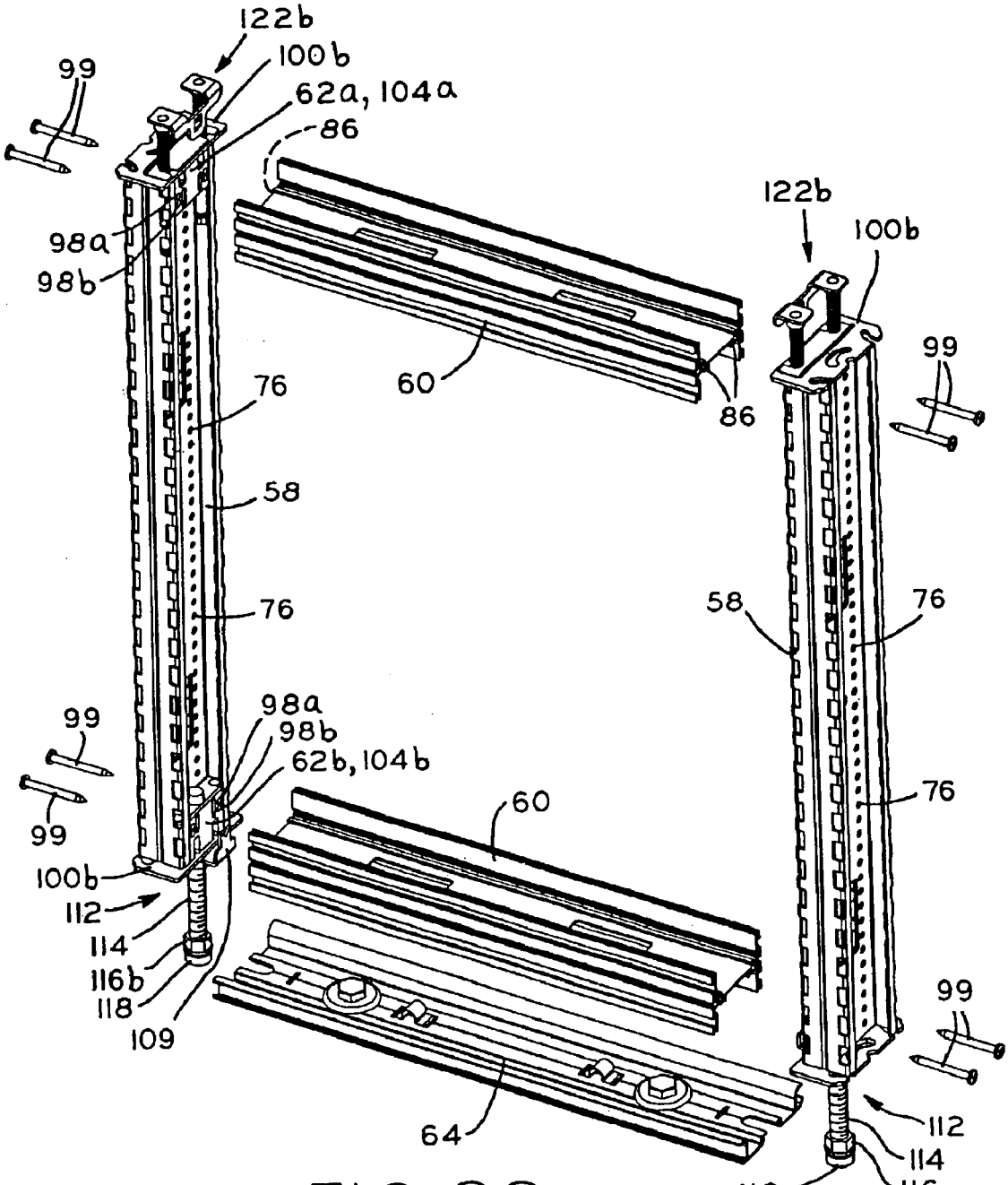
FIG. 3C is an exploded view of the universal frame of FIG. 3A.
Figure 8:
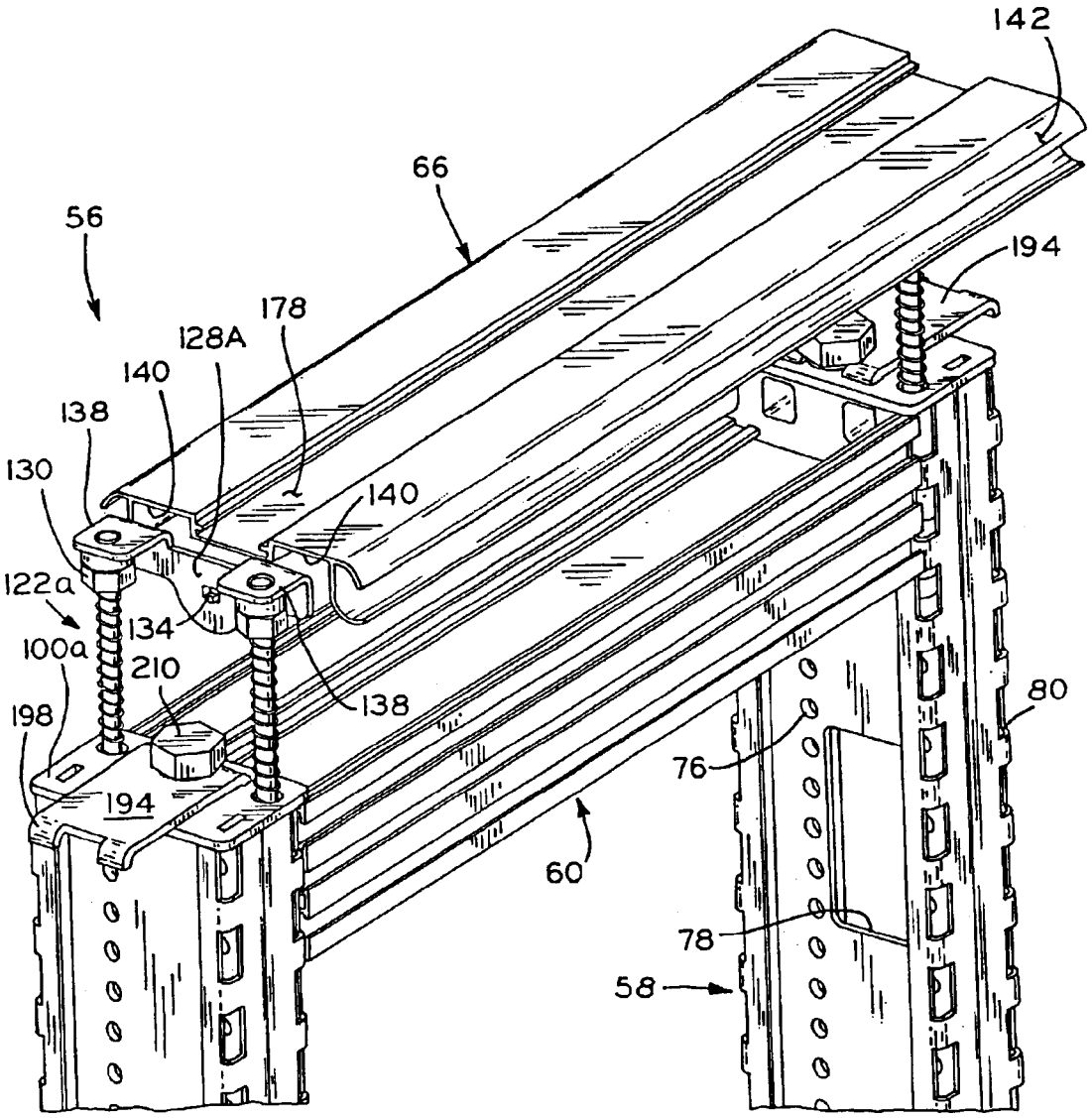
FIG. 8 is a perspective view of an upper portion of a panel, showing the jack post assemblies thereof engaging a ceiling track.
Figures 9A, 9B:
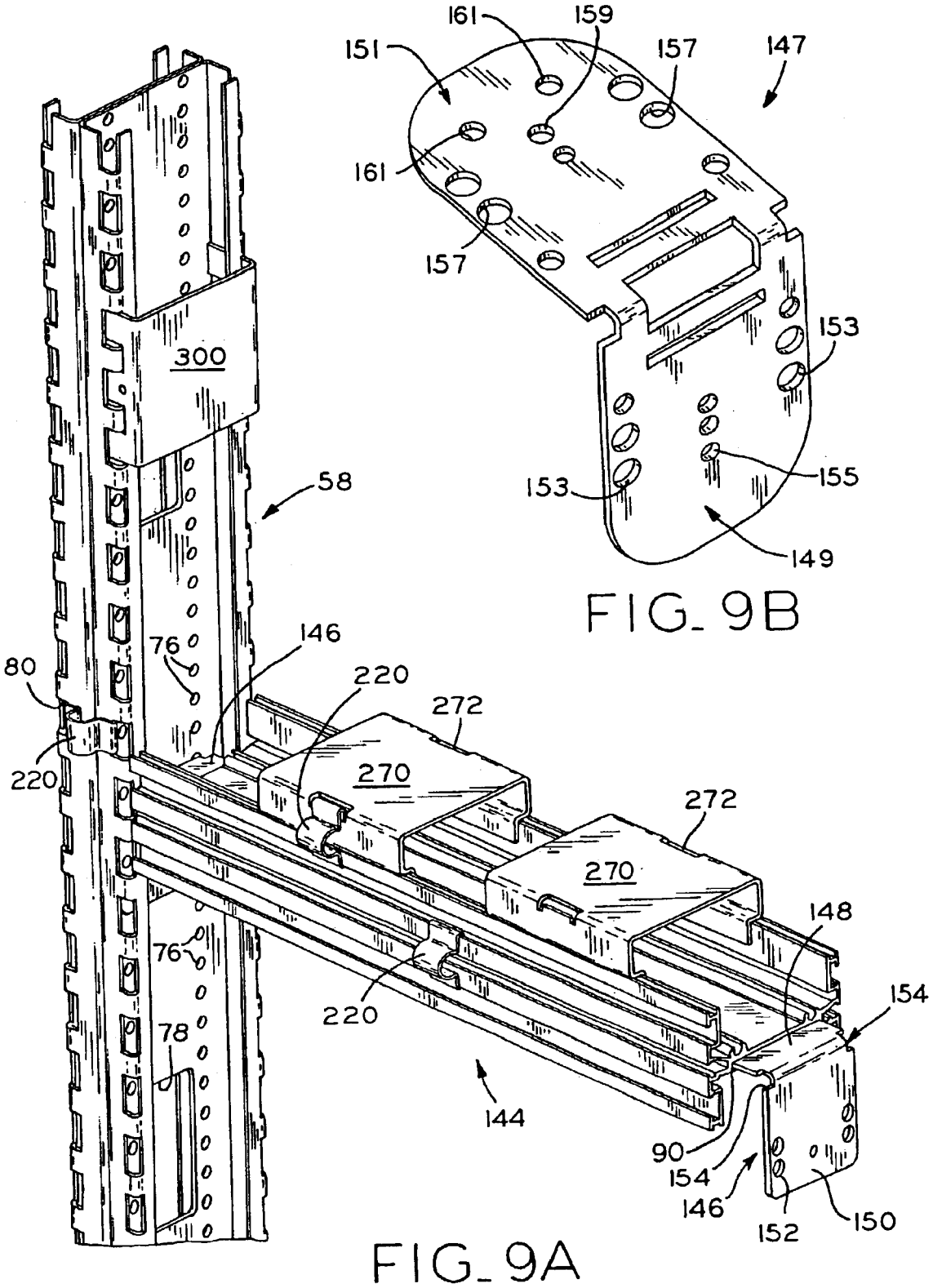
FIG. 9A is a perspective view of a portion of a panel frame, showing an intermediate horizontal frame member attached to the frame via L-shaped intermediate brackets according to a first embodiment.
FIG. 9B is a perspective view of an L-shaped bracket according to a second embodiment.
Figure 9C:
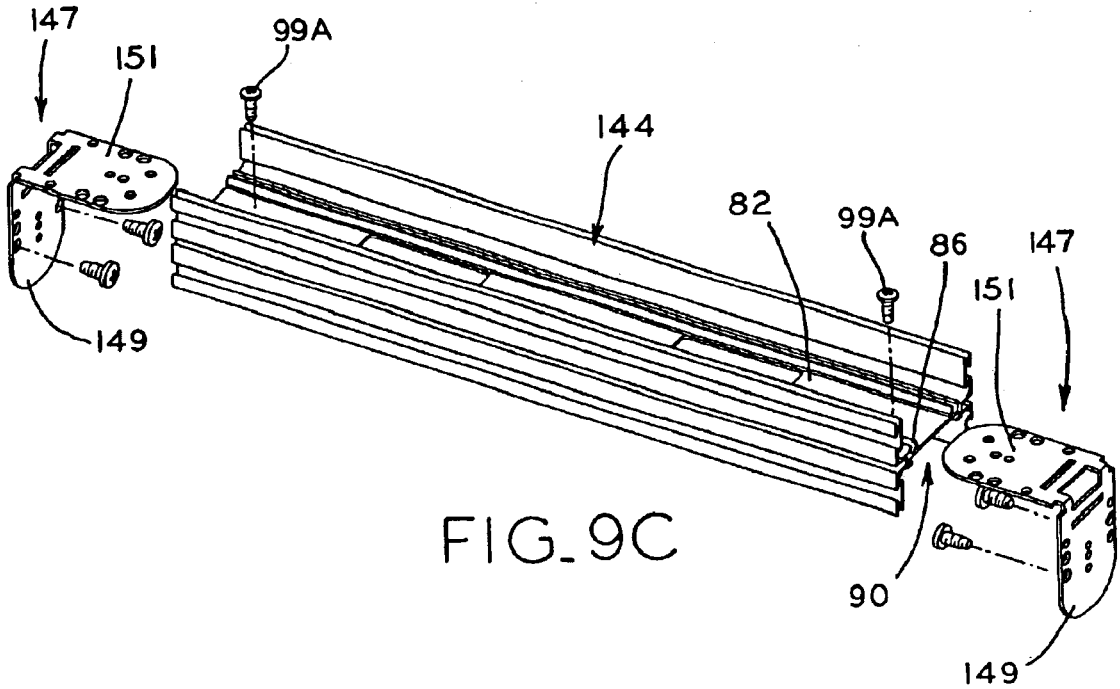
FIG. 9C is a perspective, exploded view showing an intermediate horizontal frame member and a pair of the L-shaped brackets of FIG. 9B.
Figure 9D:
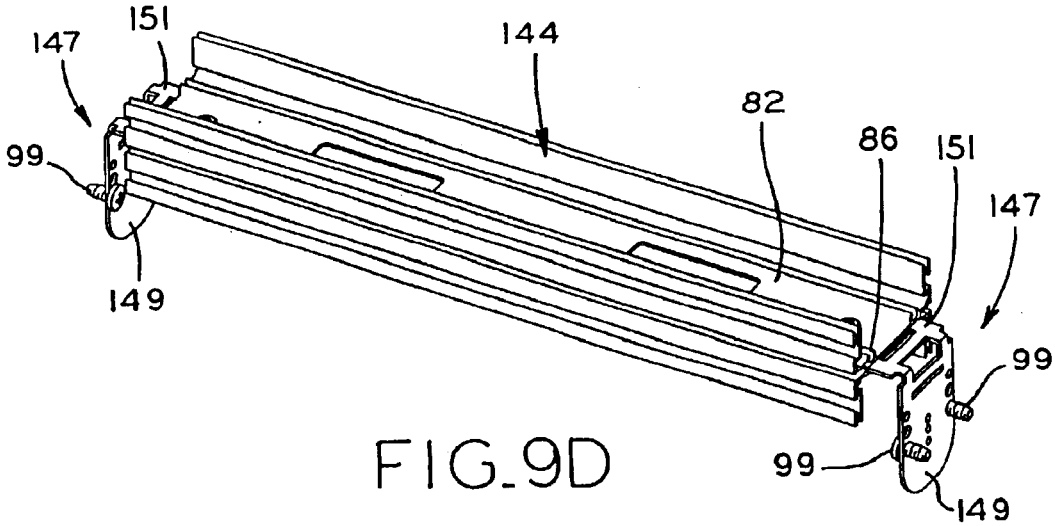
FIG. 9D is a perspective view of the assembly of FIG. 9C.
Figure 9E:
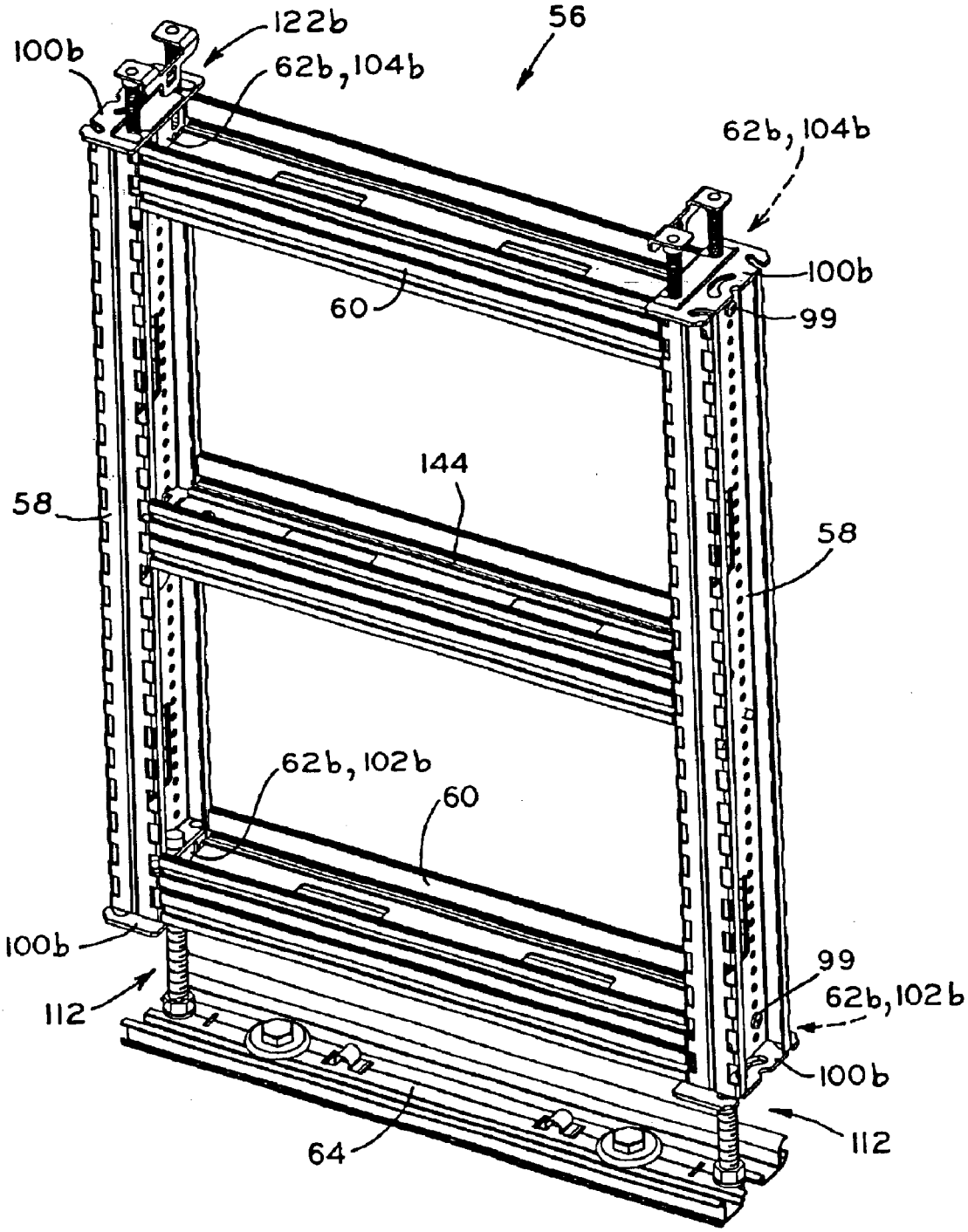
FIG. 9E is a perspective view of a panel frame having an intermediate horizontal frame member attached thereto at a mid-height location.

Each panel 44 includes universal frame 56, shown in FIGS. 2A through 3C, which generally includes vertical frame members 58 attached to horizontal frame members 60, as well as one or more intermediate horizontal frame members 44 if desired, as shown in FIGS. 9A and 9E, and described below. Vertical and horizontal frame members 58, 60 may be cut to any desired length, such as at one fourth inch increments, for example, in order to vary the overall dimensions of frame 56, and are attached to one another at corner blocks 62*a* or 62*b*, as described below. As shown in FIGS. 2A and 2B, frame 56 includes corner blocks 62*a* according to a first embodiment and, as shown in FIGS. 3A–3C, frame 56 includes corner blocks 62*b* according to a second embodiment. Additionally, floor track 64, which is disposed along floor 52, is attached to frame 56. As shown in FIG. 8, frame 56 is also detachably connected to ceiling track 66 fastened to ceiling 54, as described below.

Referring to FIGS. 4A–4E, vertical frame members 58 have a substantially I-shaped cross section, defined by a pair of substantially C-shaped sub-frame members 68 (one of which is shown individually in FIG. 4B) which may be formed from bent, roll-formed steel, for example. Sub-frame members 68 each include base wall 70 with a pair of parallel side walls 72 extending therefrom, and which are bent inwardly at 74 adjacent the ends thereof. A vertical series of slots 80 are formed in side walls 72 of sub-frame members 68 along bend 74, into which may be inserted suitable hanging hardware for hanging modular furniture components, such as a work surface, cabinet, or shelf, for example, from frame 56 of panel 44. Base walls 70 of sub-frame members 68 additionally include two vertical series of holes 76 and windows 78 therein. Sub-frame members 68 are attached to one another in a suitable manner, such as by welding or by fasteners for example, or by die-punching a tox 71 (FIGS. 4A and 4D) in at least two locations along abutting base walls 70 of sub-frame members 68 to bind same together. Regardless of how sub-frame members 68 are attached to one another, respective base walls 70 of sub-frame members 68 abut one another with respective side walls 72 thereof extending away from one another to define vertical frame member 58, wherein corresponding holes 76 and windows 78 of sub-frame members 68 are aligned. The I-shaped cross section of vertical frame members 58, defined by sub-frame members 68, provides structural rigidity to vertical frame members 58.

Figure 7A:
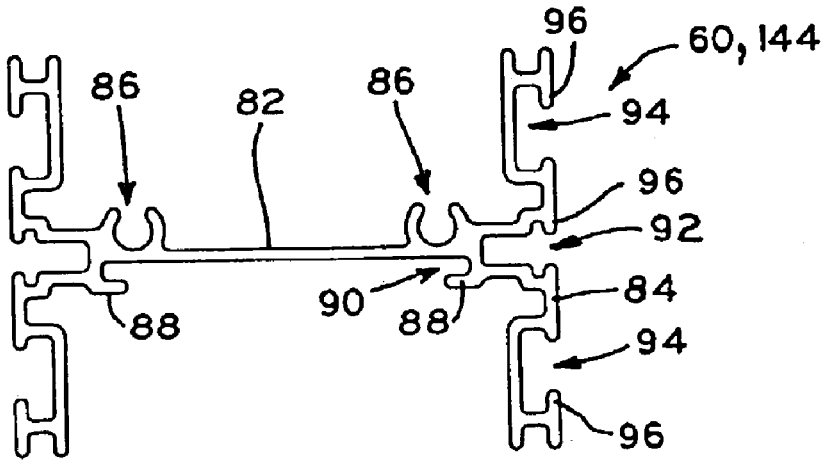
FIG. 7A is an end view of a horizontal frame member/intermediate horizontal frame member.

Horizontal frame member 60, shown in FIGS. 2A through 3C and 7A, may be formed of an elongated piece of extruded aluminum, for example, and, referring particularly to FIG. 7A, generally includes central web portion 82 and a pair of parallel side portions 84 defining a substantially H-shaped cross section. Central web portion 82 includes a pair of fastening embossments 86 formed on one side thereof and a pair of tongues 88 extending from an opposite side thereof which depend toward each other to define channel 90. Other than fastening embossments 86 and tongues 88, central web portion 82 defines a horizontal axis of symmetry through horizontal frame member 60, allowing horizontal frame member 60 to be selectively rotationally oriented such that fastening embossments 86 are disposed on either an upper or lower side of central web portion 82, as described further below. Side portions 84 are shaped to define first channel 92 and second channels 94 disposed above and below first channel 92, respectively, wherein each of the foregoing first and second channels 92, 94 open generally outwardly of horizontal rail member 60 and frame 56. A series of protrusions 96 are defined at the openings of first and second channels 92, 94. First channel 92, as described further below, is adapted to receive a threaded fastener therein for attaching a mounting track to frame 56.

Figure 4B:
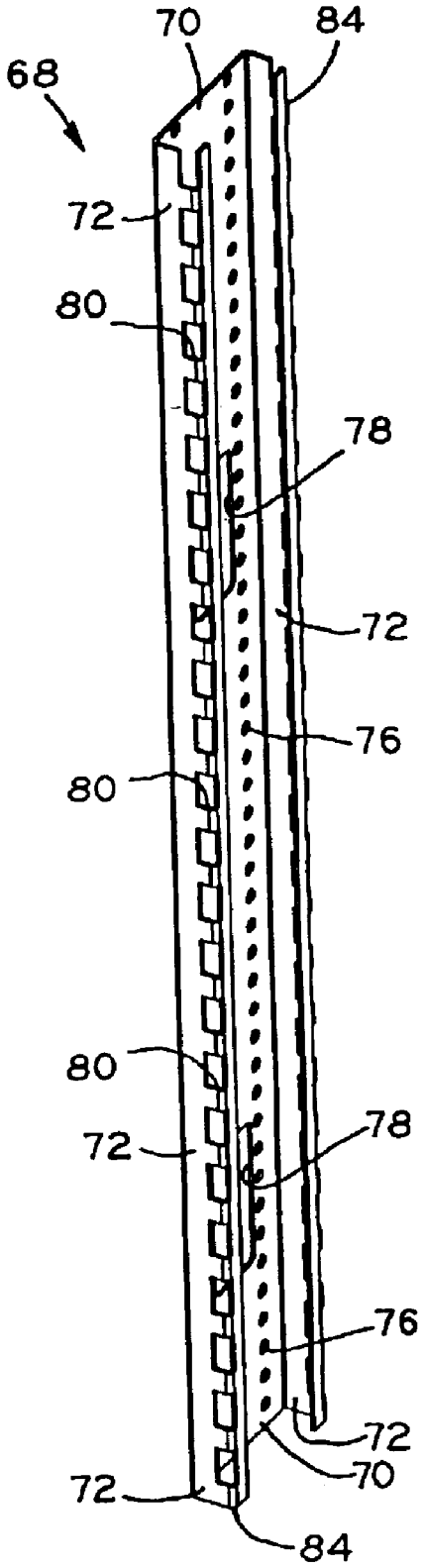
FIG. 4B is a perspective view of a sub-frame member of the vertical frame member of FIG. 4A.
Figure 4A:
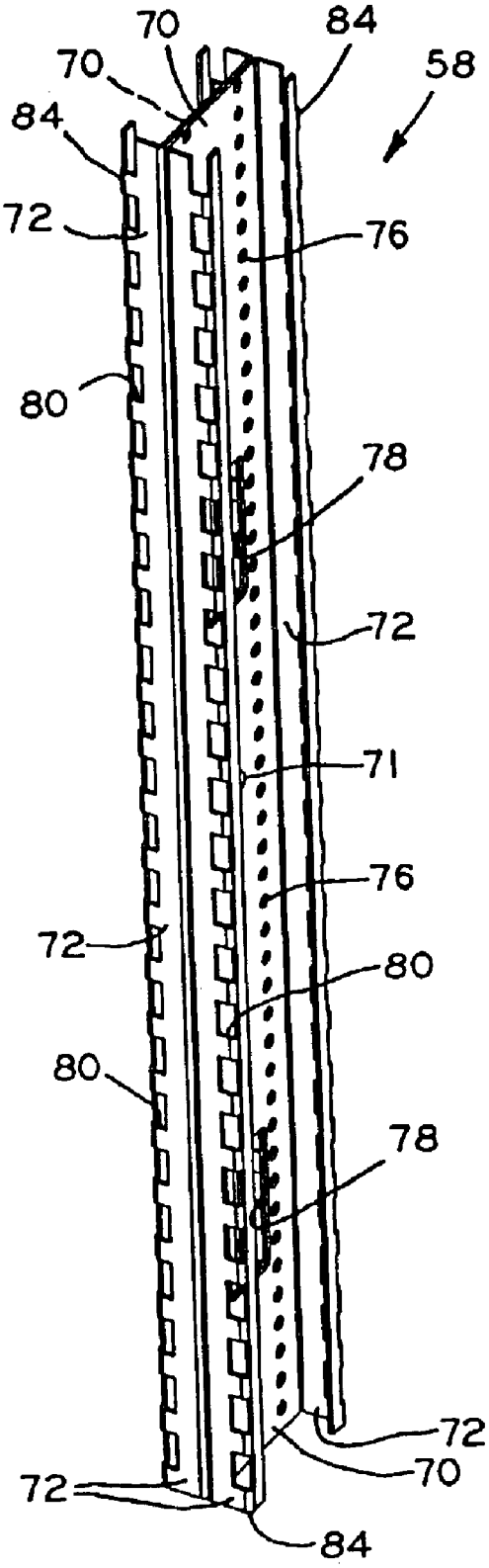
FIG. 4A is a perspective view of a vertical frame member.
Figure 4C:
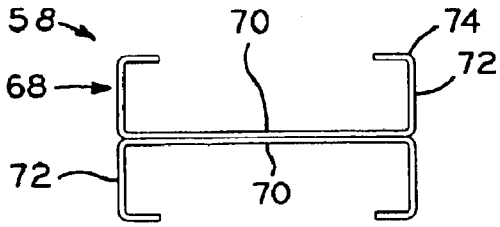
FIG. 4C is a top view of the vertical frame member of FIG. 4A.
Figure 4D:
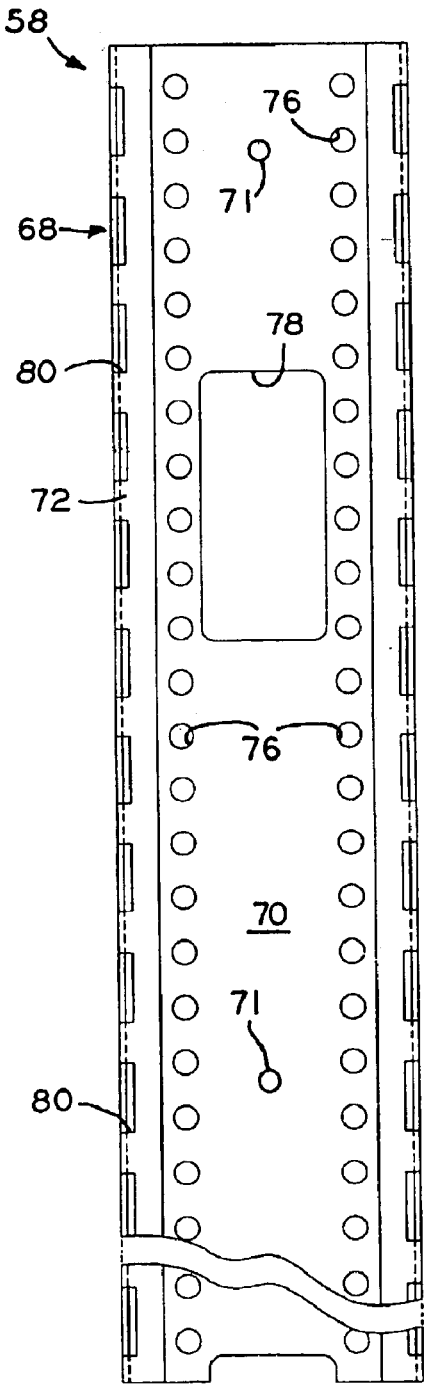
FIG. 4D is a front view of the vertical frame member of FIG. 4A.
Figure 4E:
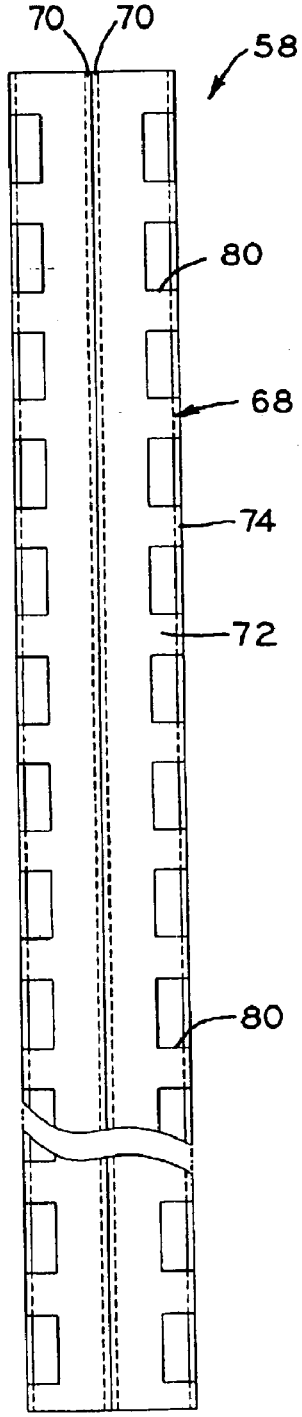
FIG. 4E is a side view of the vertical frame member of FIG. 4A.
Figure 4F:
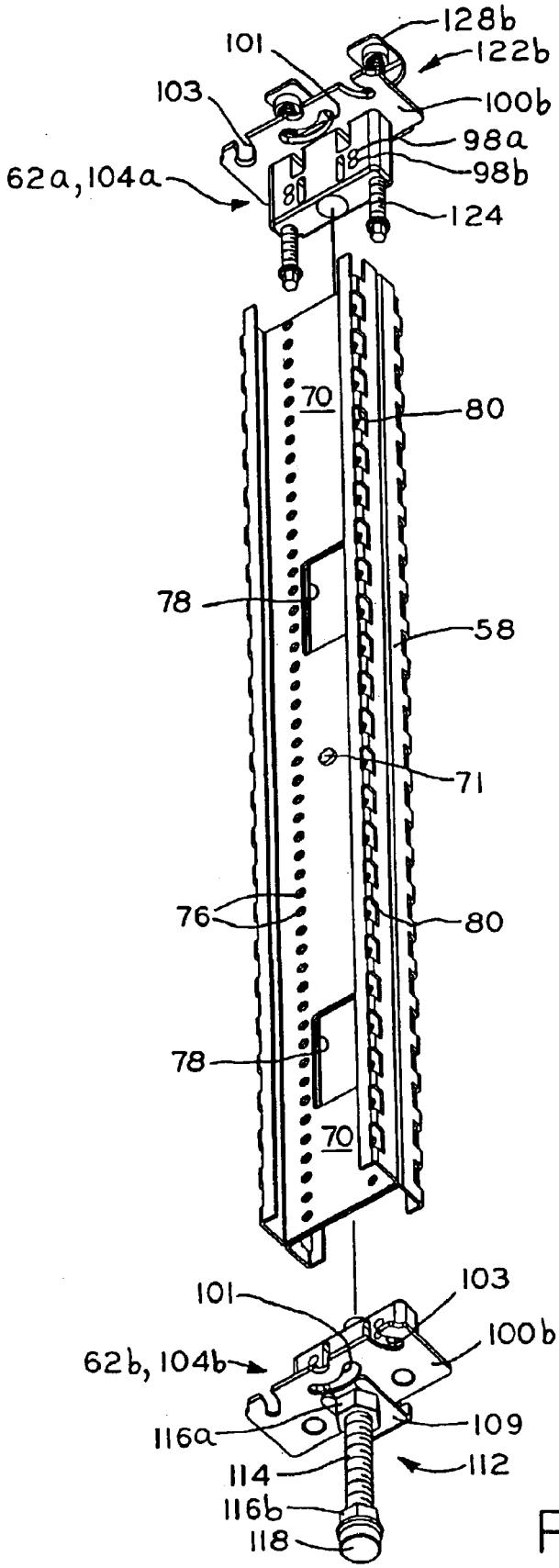
FIG. 4F is an exploded perspective view of a vertical frame member, a jack post block, and a panel support block.

As shown in FIG. 4F, corner blocks 62*b* (or 62*a*) are received in each of the upper and lower portions of vertical frame members 58, and specifically, are captured within the space defined within one of the C-shaped vertical sub-frame members 68 thereof. Referring additionally to FIG. 3C, corner blocks 62*a*, 62*b* include two horizontal pairs of holes 98*a*, 98*b* therein. Threaded fasteners 99 extend through holes 76 in vertical frame members 58, holes 98*a*, 98*b* in corner blocks 62*a*, 62*b* and into fastening embossments 86 of horizontal frame members 60 to secure horizontal frame members 60 to vertical frame members 58 to define frame 56. An upper horizontal frame member 60 may be aligned with fastening embossments 86 disposed above central web portion 82 thereof, with the fasteners extending through upper horizontal pair of holes 98*a* in corner blocks 62*a*, 62*b*, and a lower horizontal frame member 60 may be aligned with fastening embossments 86 disposed below central web portion 82 thereof, with fasteners extending through lower horizontal pair of holes 98*b* in corner blocks 62*a*, 62*b*. Alternatively, the foregoing orientation of horizontal frame member 60 may be reversed. Additionally, the ends of side portions 84 of horizontal frame members 60 abut plates 100*a*, 100*b* of corner blocks 62*a*, 62*b* to align horizontal frame members 60 in a square orientation with respect to vertical frame members 58, thereby providing an installation guide for connecting horizontal and vertical frame members 60, 58 in a square orientation with respect to one another.

Referring to FIGS. 5A–6E, corner blocks 62*a* and 62*b* of first and second embodiments, respectively, are shown, which may be configured as lower, panel support blocks 102*a*, 102*b* or upper, jack post blocks 104*a*, 104*b* as described further below.

Referring to FIGS. 5A, 5B, 6A, and 6B, corner blocks 62*a* according to a first embodiment are shown. Corner blocks 62*a* generally include block portion 106 with plate 100*a* attached thereto. Block portion 106 and plate 100*a* may be an integral zinc, die-cast part. Corner blocks 62*a* include first bore 108 therein, which is threaded along at least a portion thereof, and a pair of second bores 110 disposed on each side of first bore 108, wherein each of the foregoing are aligned with corresponding apertures in plate 100*a*. Alternatively, block portion 106 and plate 101*a* of corner blocks 62*a* may be unitarily formed, of a high strength, injection-molded plastic, in which first and second bores 108, 110 may include threaded or smooth steel insert sleeves (not shown) therein.

Referring to FIGS. 5C through 5E and 6C through 6E, corner blocks 62*b* according to a second embodiment are shown, which are similar to corner blocks 62*a*, wherein the same reference numerals will be used to refer to common parts between corner blocks 62*a* and 62*b*. Corner locks 62*b* are formed of a single, integral piece of a hard plastic material, and include block portion 106 and plate portion 100*b*. Each plate portion 100*b* includes cam slot 101 and a pair of half cam slots 103, with cam slot 101 including wide portion 105 tapering to narrow portion 107. One of the half cam slots 103 in plate portion 100*b* includes a wide portion 105 and the other of the half cam slots 103 in plate portion 100*b* includes a narrow portion 107. The function of cam slots 101 and half cam slots 103 will be explained below.

Panel support blocks 102*a*, 102*b* according to first and second embodiments are shown in FIGS. 6A through 6E, and each include vertical adjustment assembly 112 for vertically adjustable connecting panel frame 56 to floor track 64. Panel support blocks 102*a*, 102*b* include threaded bolt 114 disposed through threaded first bore 108 thereof, and first and second nuts 116*a*, 116*b* threaded on bolt 114, wherein second nut 116*b* is fixed relative to bolt 114. Referring additionally to FIG. 2B, a portion of bolt 114 adjacent head 118 thereof is slidably received within slot 120 at each end of floor track 64. Floor track 64 is thus captured at each end thereof between second nut 116*b* and head 118 of bolt 114 to connect floor track 64 to frame 56. The vertical height of frame 56 from floor track 64 may be adjusted by rotating second nut 116*b*, which in turn rotates bolt 114 within panel support blocks 102*a*, 102*b* to thereby adjust the vertical position of frame 56 of panel 44 relative to floor 52. Panel support block 102*b* further includes carpet gripper 109 which, during shipment of panel system 42, is captured between first nut 116*a* and plate portion 100*b* of panel support block 102*b* for storage. Upon assembly of vertical adjustment assembly 112 when panel system 42 is installed, first nut 116*a* is loosened to release carpet gripper 109, and carpet gripper 109 is inverted and reinstalled between second nut 116*b* and first nut 116*a* by threading first nut 116*a* downwardly on bolt 114. Carpet gripper 109 includes teeth 111 for gripping carpet disposed on a floor surface on which panel system 42 is supported.

Figure 5A:
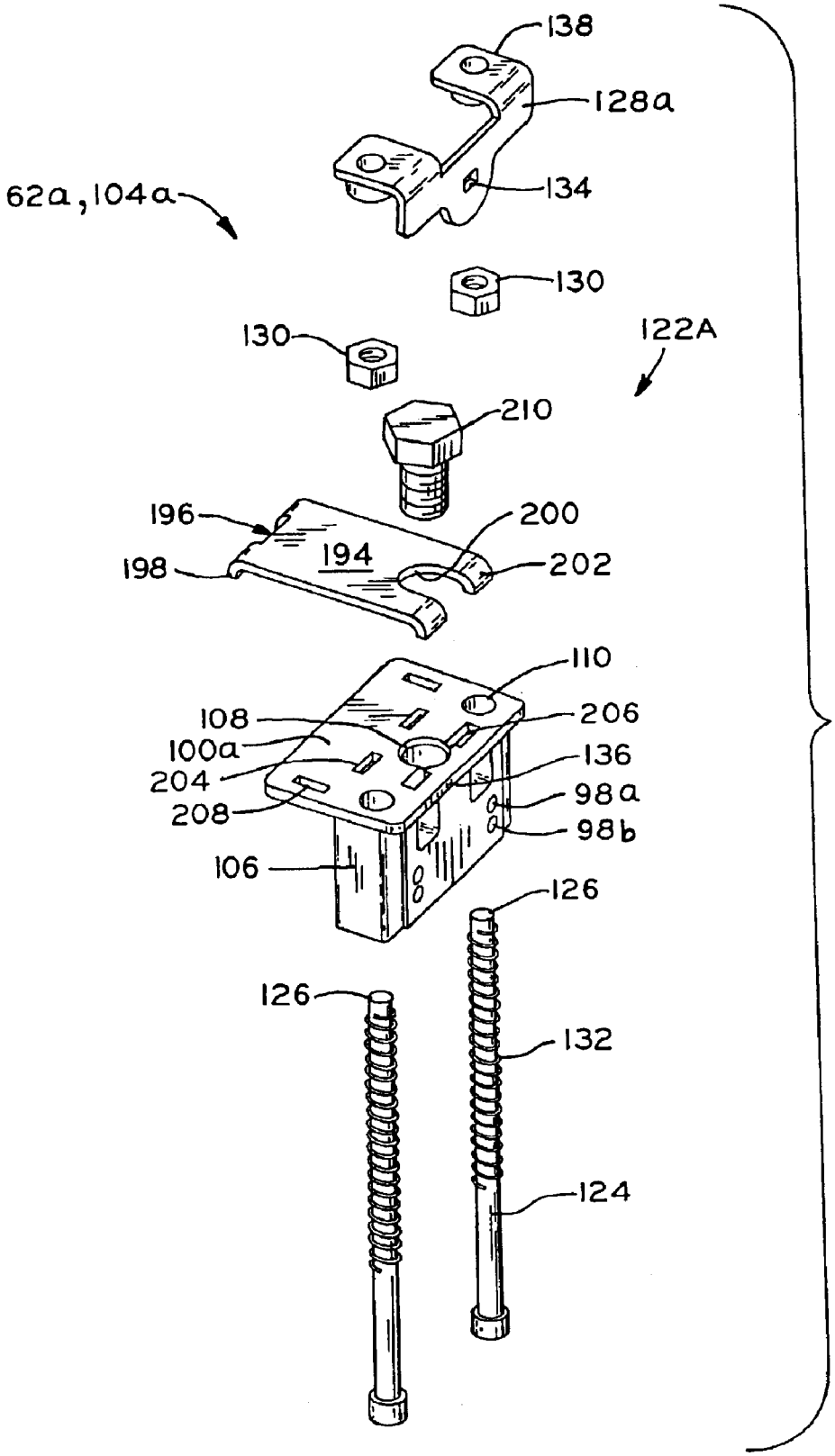
FIG. 5A is an exploded view of a jack post block according to a first embodiment, including, a jack post assembly for releaseably connecting the panel frame to a ceiling track.
Figure 5B:
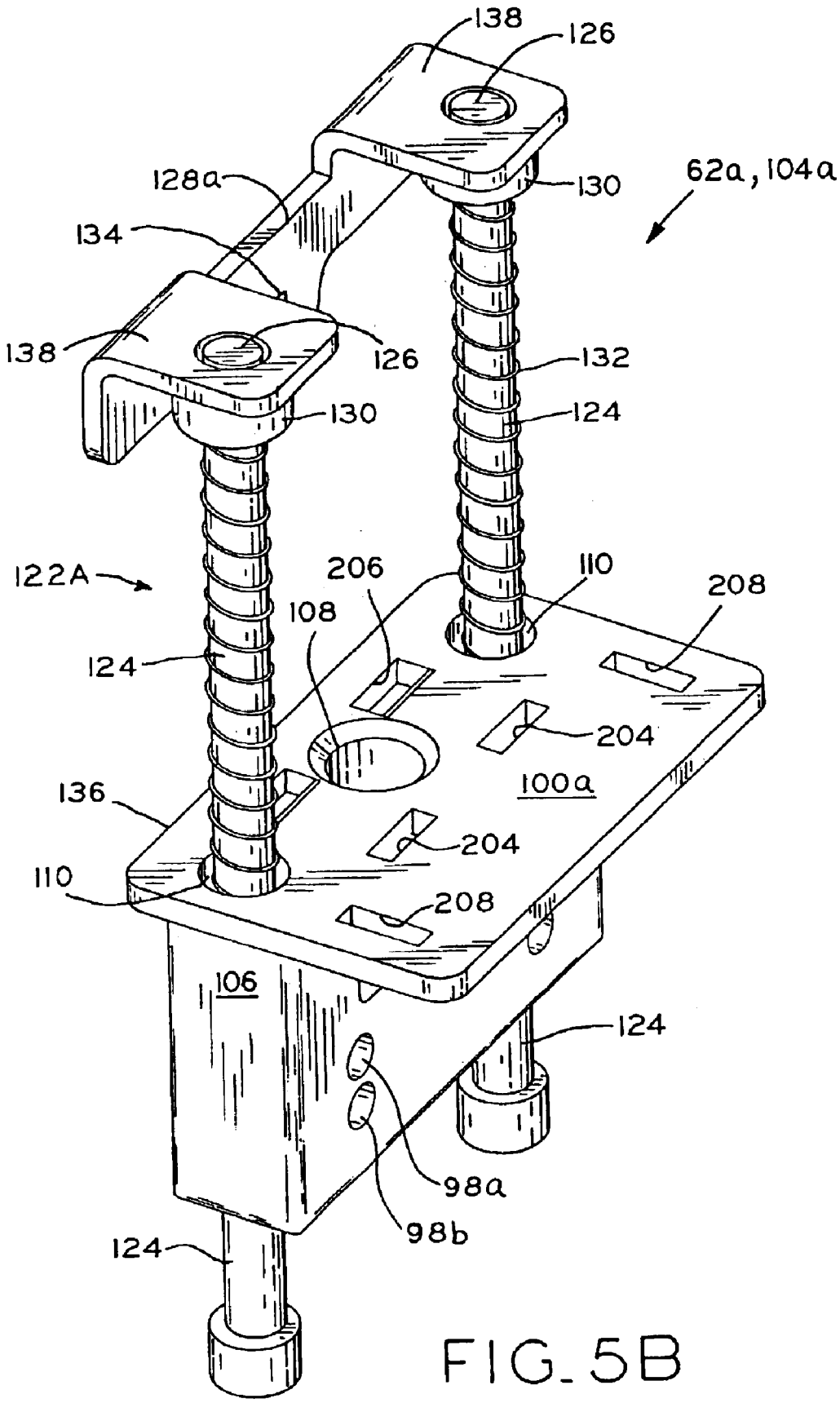
FIG. 5B is a perspective view of the jack post block and jack post assembly of FIG. 5A.

Jack post block 104*a* according to a first embodiment is shown in FIGS. 5A and 5B, and includes jack post assembly 122*a* for detachably connecting frame 56 to ceiling track 66. A pair of bolts 24 are respectively slidably disposed through second bores 110 of jack post block 104*a*. Ends 126 of bolts 124 each threadably engage jack plate 128*a*, and nuts 130 are threaded onto bolts 124. Springs 132 are respectively disposed around bolts 124, and the ends of same are trapped between block portion 106 of jack post block 104*a* and nuts 130 on bolts 124 to thereby bias bolts 124 outwardly of jack post block 104*a*. Jack plate 128*a* includes tongue 134 depending therefrom which engages lip 136 of plate 100*a* to lock jack post assembly 122*a* in a retracted position, with jack plate 128*a* disposed adjacent jack post block 106. Referring also to FIG. 8, union release of tongue 134 of jack plate 128*a* from lip 136 of plate 100*a*, springs 132 bias bolts 12 and jack plate 128*a* of jack post assembly 122*a* upwardly to engage jack plate 128*a* with ceiling track 66 to secure frame 56 of panel 44 thereto. Specifically, protruding portions 138 of jack plate 128*a* seat within recesses 140 (FIGS. 7B, 8) of ceiling track 66 to prevent tilting movement of frame 56 out of a vertical plane. Thereafter, nuts 130 may be threaded downwardly around bolts 124 and into abutment with the upper surface of plate 100*a* to prevent retraction of jack post assembly 122*a* and to thereby releaseably lock jack post assembly 122*a* and frame 56 of panel 44 into engagement with ceiling track 66.

Figure 5E:
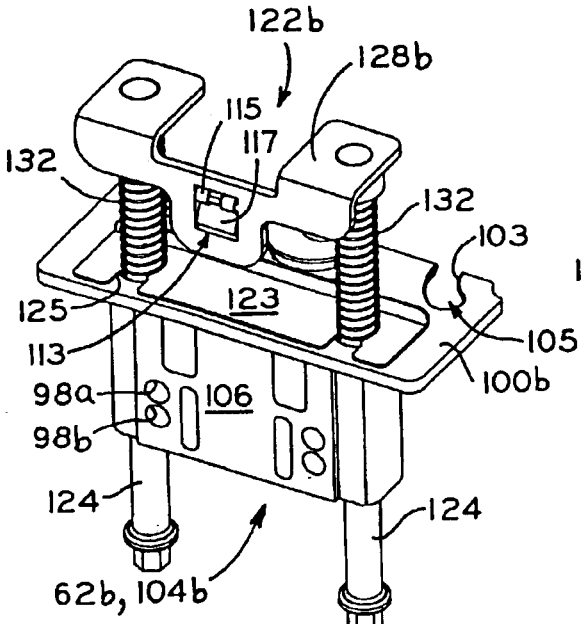
FIG. 5E is a perspective view of the jack post block and jack post assembly of FIG. 5C, showing the jack post assembly in an extended position.
Figure 5D:
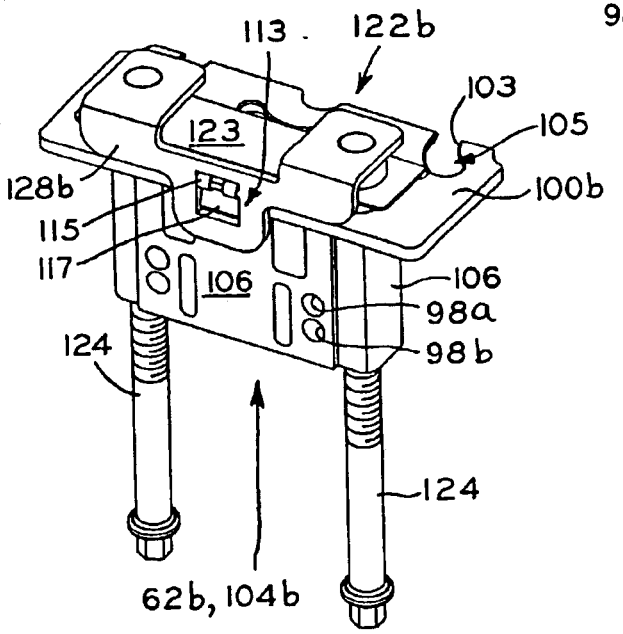
FIG. 5D is a perspective view of the jack post block and jack post assembly of FIG. 5C, showing the jack post assembly in a retracted position.
Figure 5C:
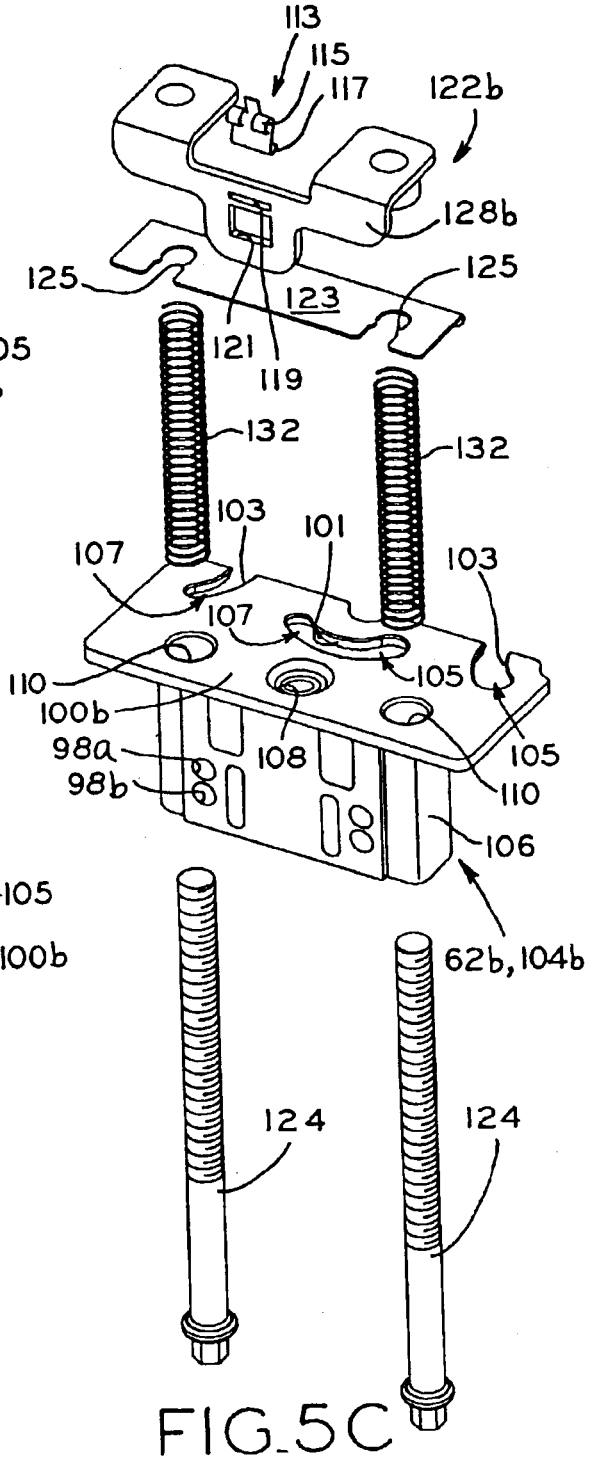
FIG. 5C is an exploded view of a jack post block according to a second embodiment, including a jack post assembly for releaseably connecting the panel frame to a ceiling track.
Figure 6A:
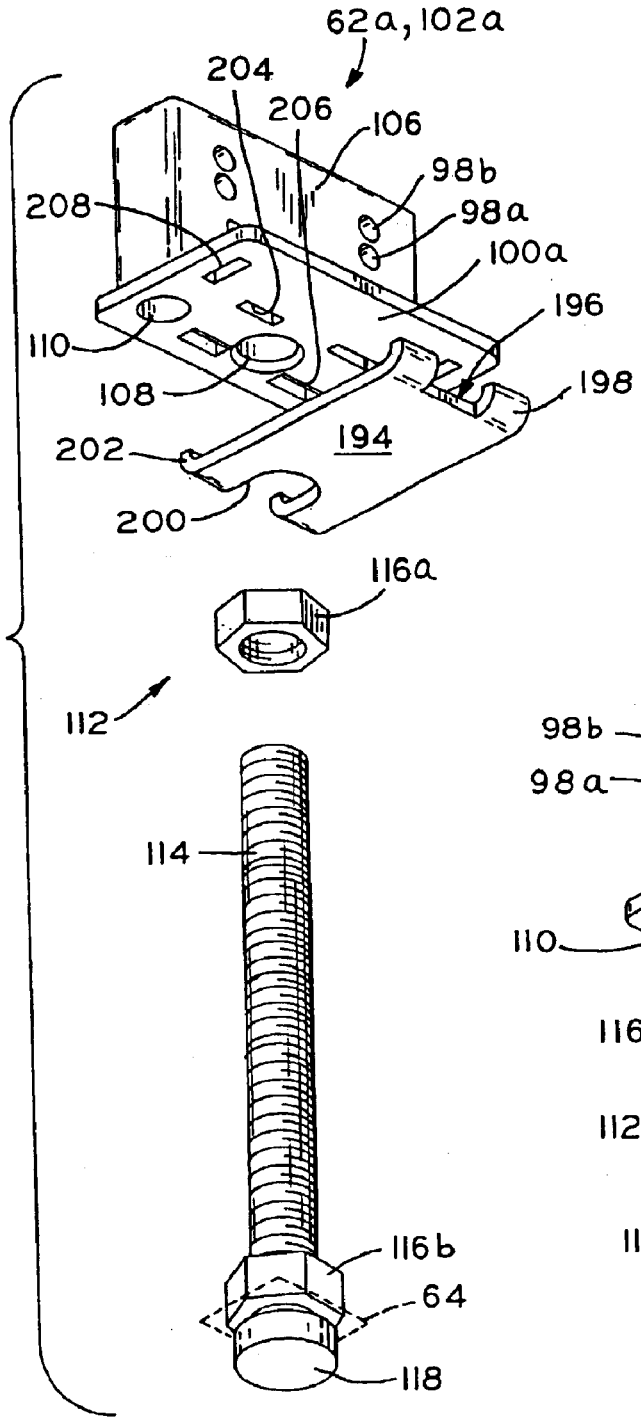
FIG. 6A is an exploded view of a panel support block according to a first embodiment, including a vertical adjustment assembly for vertically adjustably connecting the panel frame to a floor track.
Figure 6B:
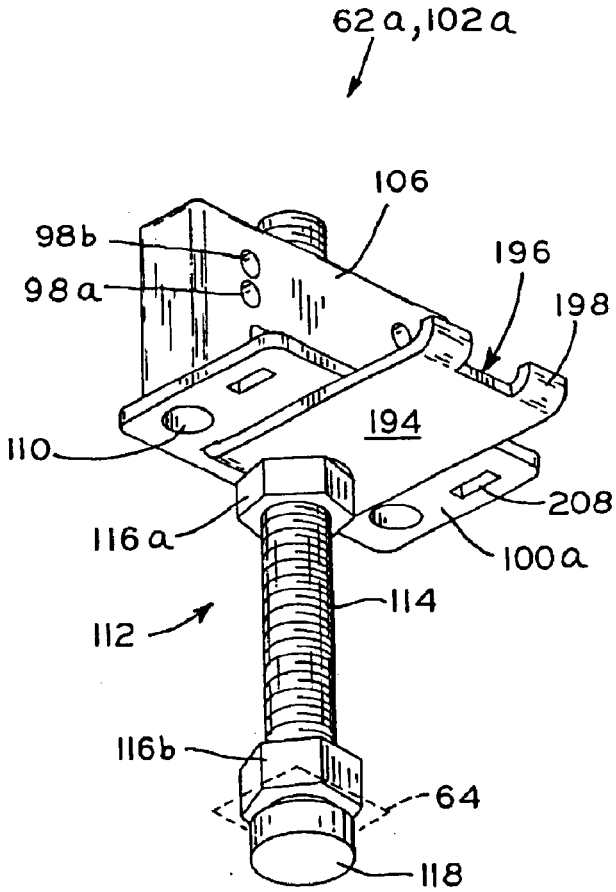
FIG. 6B is a perspective view of the panel support block and vertical adjustment assemble of FIG. 6A.
Figure 6E:
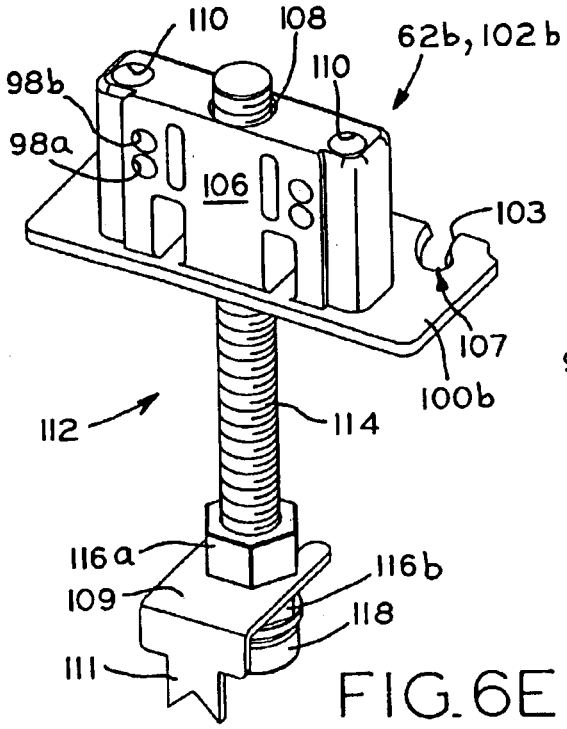
FIG. 6E is a perspective view of the panel support block and vertical adjustment assembly of FIG. 6C, shown in an installed position.
Figure 6D:
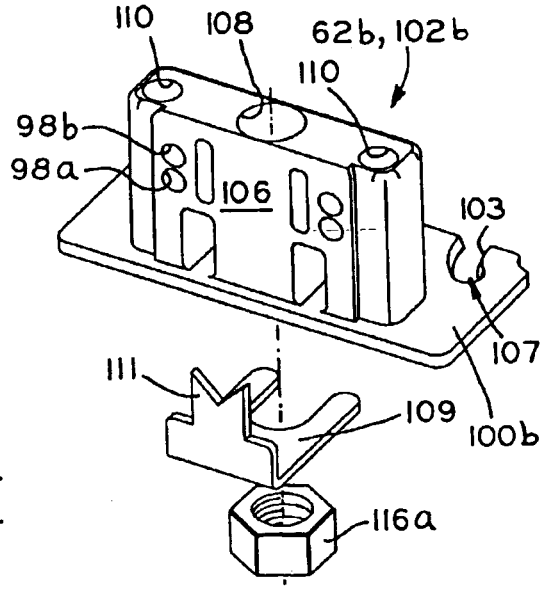
FIG. 6D is a perspective view of the panel support block and vertical adjustment assemble of FIG. 6C, shown in a shipment or pre-installation position.
Figure 6D:
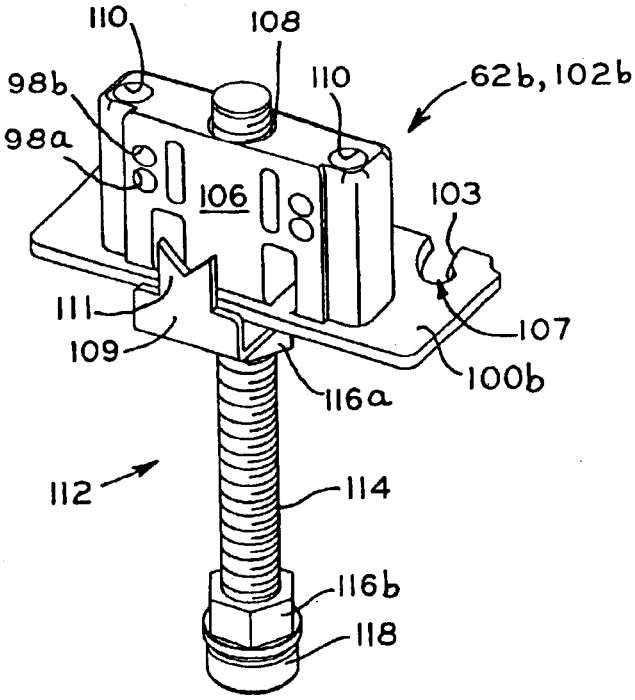
Figure 6C:
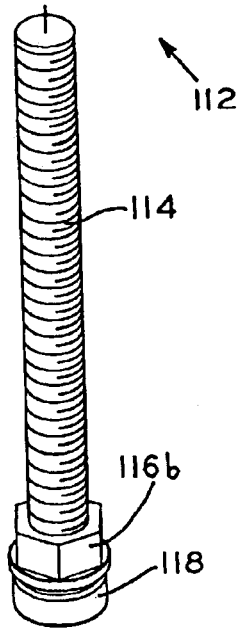
FIG. 6C is an exploded view of a panel support block according to a second embodiment, including a vertical adjustment assembly f(or vertically adjustably connecting the panel frame to a floor track.

A second embodiment of a jack post block is shown in FIGS. 5C–5E. Jack post block 104*a* includes jack post assembly 122*b*. Similar to jack post assembly 122*a*, jack post assembly 122*b* includes a pair of bolts 124 respectively slidably disposed through second bores 110 of jack post block 104*b*, wherein ends 126 of bolts 124 each threadably engage jack plate 128*b*. Springs 132 are respectively disposed around bolts 124, and the ends of same are trapped between block portion 100*b* of jack post block 104*b* jack plate 128*b* to thereby bias jack plate 128*b* and bolts 124 outwardly of jack post block 104*b*. Jack plate 128*b* includes apertures 119, 121 therein for receiving jack post retainer spring 113, wherein arms 115 of jack post retainer spring 113 are received within aperture 119, and spring leg 117 of jack post retainer spring 113 is disposed within aperture 121. Additionally, jack post assembly 122*b* includes jack post lock plate 123, having slots 125 therein.

Jack post assembly 122*b* is shown in a retracted position in FIG. 5D, such as when same is in a shipment or pre-installation position. In this position, engagement of spring leg 117 of jack post retainer spring 113 with the edge of plate 100*b* of jack post block 104*b* retains jack plate 123*b* in a retracted position, with springs 132 under compression between jack plate 128*b* and plate 100*b*. Additionally, jack post lock plate 123 is disposed between jack plate 128*b* and the upper ends of springs 132, wherein bolts 124 are received within slots 125 of jack post lock plate 123. A downward force upon jack plate 128*b* releases spring leg 117 of jack post retainer spring 113 from the edge of plate 100*b*, allowing springs 132 to bias bolts 124 and jack plate 128*b* upwardly to engage jack plate 128*b* with ceiling track 66 in the same manner as described above with respect to jack post block 104*a* and jack post assembly 122*a* (FIG. 8). The downward force upon jack plate 128*b* for releasing same may be exerted by an installer using a pole (not shown). For example, such that the installer may conveniently release jack plate 128*b* from a standing position therebelow to set the initial engagement between jack plate 128*b* and ceiling track 66. After jack plate 128*b* is engaged with ceiling track 66, jack post lock plate 123 is removed from bolts 124, and relocated to the position showing FIG. 5E, wherein the threads of bolt 124 and portions of springs 132 are captured by slots 125 of jack post lock plate 123 to secure jack plate 128*b* and bolts 124 in the extended position shown in FIG. 5E.

Figure 7B:
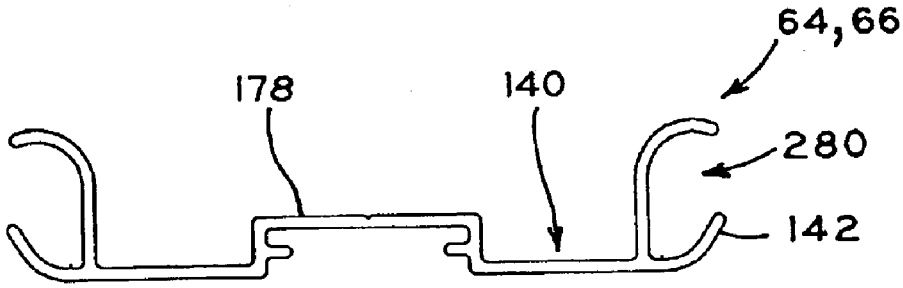
FIG. 7B is an end view of a floor track/ceiling track.

Floor and ceiling tracks 64, 66, shown in FIG. 7B, may be formed of identical pieces of extruded aluminum, for example, thereby reducing the number of components associated with floor-to-ceiling panel system 42. Additionally, referring to FIGS. 2A through 3C and 7B, floor track 64 includes curved edge 142, which allows panel frame 56 to slide or skid across a floor surface when pushed by an installer to any desired location before engaging jack post assemblies 122*a* or 122*b* are engaged with ceiling track 66 to secure panel frame 56 thereto, as described above. Additionally, screws (not shown) may be threaded through floor track 64 to grip carpet on floor 52, or alternatively, such screws may be directly threaded into a permanent floor surface to attach floor track 64 thereto for securing panel frame 56 to a floor surface.

Additionally, referring to FIG. 9A, panel frame 56 may include one or more intermediate horizontal frame members 144, which may be formed of pieces of extruded aluminum identical to horizontal frame members 60. L-shaped brackets 146, according to a first embodiment, connect intermediate horizontal frame members 144 to vertical frame members 58, and include first flange 148 slidably disposed within the channel 90 of intermediate horizontal frame member 144 which is defined by tongues 88, and shown in FIG. 7A. Second flange 150 of intermediate brackets 146 connect to vertical frame members 58 via fasteners (not shown) disposed through holes 152 in intermediate bracket 146 and through holes 76 in vertical frame members 58. Slots 154 in second flange 150 accommodate the ends of tongues 88 of intermediate horizontal frame member 144.

Holes 76 in vertical frame members 58 may be disposed therealong at one-half inch center-to-center intervals, thereby allowing intermediate horizontal frame members 144 to be located it any horizontal level corresponding to one-half inch vertical intervals with respect to frame 56. Additionally, intermediate horizontal frame member 144 may be selectively mounted to vertical frame members 58 in one of two rotational orientations, with fastening embossments 86 disposed on either the upper or lower side of central web portion 82, which orientations vary the vertical position of intermediate horizontal frame member 144 by one-fourth of an inch relative to vertical frame members 58. Therefore, the one-half inch spacing between holes 76 in vertical frame members 58, as well as the selective rotational orientation of intermediate horizontal frame member 144, allow intermediate horizontal frame member 144 to be located at any horizontal level corresponding to one-fourth inch vertical intervals with respect to frame 56. Additionally, intermediate bracket 146 may be provided with multiple sets of holes 152 for selective alignment with holes 76 of vertical frame members 58 and which, when combined with the foregoing further adjustment provided by the selective rotational orientation of intermediate horizontal frame member 144, allows intermediate horizontal frame member 144 to be located at any desired one-eighth inch vertical interval along vertical frame members 58 of frame 56.

A method of connecting intermediate horizontal frame members 144 to vertical frame member, 58 according to a second embodiment is shown in FIGS. 9B–9J. Referring first to FIG. 9B, L-shaped brackets 147, according to a second embodiment, include first flange 149 and second flange 151 extending at right angles from one another. First flange 149 includes a first set of four holes 153 and center holes 155. Second flange 151 includes a second set of four holes 157, center holes 159, and 135° connection holes 161. The function of 135° connection holes 161 will be explained below. Either first or second flanges 149, 151 of L-shaped brackets 147 may be inserted into the channel 90 of intermediate horizontal frame member 144 which is defined by tongues 88, and shown in FIG. 7A. However, in the embodiment shown in FIGS. 9B–9I, the orientation of intermediate horizontal frame member 144 need not change to effect connection of intermediate horizontal frame member 144 at one-eighth inch intervals along vertical frame members 58—intermediate horizontal frame member 144 may be oriented such that channel 90 thereof is disposed below fastening embossments 86 for all such connections.

As shown in FIGS. 9C and 9D, fasteners 99A are inserted through central web portion 82 of intermediate horizontal frame member 144 and into either center holes 155 or 159 of first flange 149 or second flange 151, respectively, of L-shaped brackets 147 to secure L-shaped brackets 147 to intermediate horizontal frame member 144. Thereafter, referring to FIG. 9D, further fasteners 99 are inserted through a pair of first or second sets 153, 157 of holes in first or second flanges 149, 151 of L-shaped brackets 147 to secure same to vertical frame members 58, as described below. For example, in FIG. 9E, an intermediate horizontal frame member 144 is shown attached to vertical frame members 58 of panel frame 56 at a mid-height location.

Figure 9F:
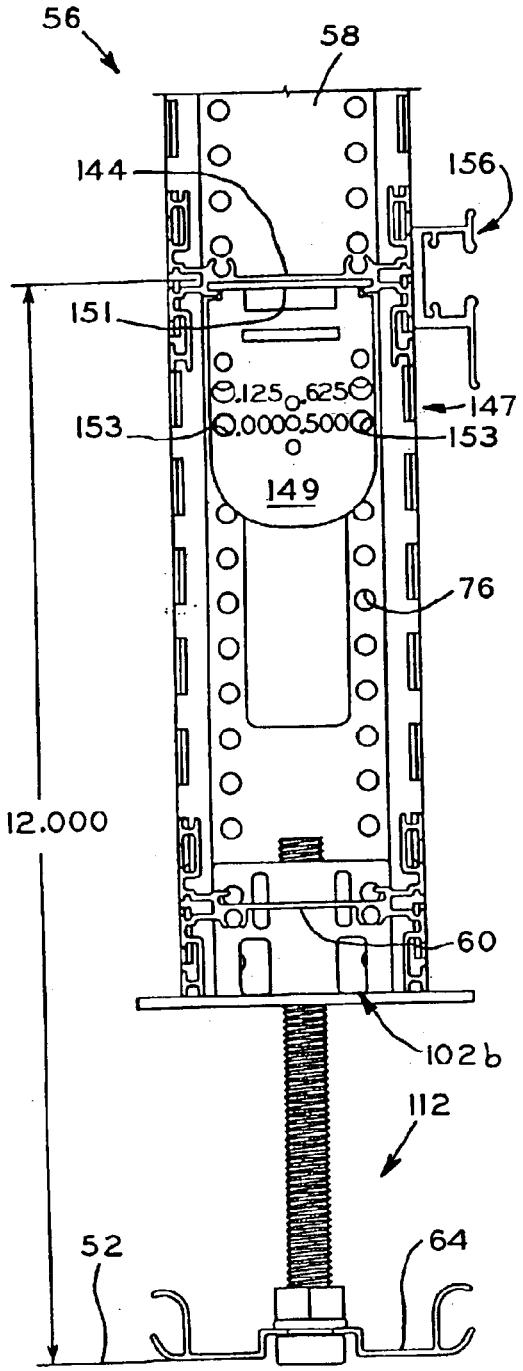
FIG. 9F is an end view of a panel frame, showing the connection of an intermediate horizontal frame member thereto, with the intermediate horizontal frame member located 12 inches above the floor surface.

Referring to FIGS. 9F–9I, the manner in which intermediate horizontal frame members 144 mar be attached to vertical frame members 58 of panel frame 56 is shown. In FIG. 9F, second flange 151 of L-shaped bracket 147 is attached to intermediate horizontal frame member 144 as described above, exposing first flange 149 thereof for mounting to vertical frame member 58. A pair of fasteners (not shown) are inserted through the hole marked "0.000" and the corresponding horizontal hole (marked "0.500") of the lower pair of holes in first set 153 of holes in first flange 149, and engage a corresponding pair of holes 76 in vertical frame member 58 to secure intermediate horizontal frame member 144 to panel frame 56, with intermediate horizontal frame member 144 located at a desired one inch interval with respect to the surface of floor 52, for example, 12 inches as shown in FIG. 9F.

Figure 9G:
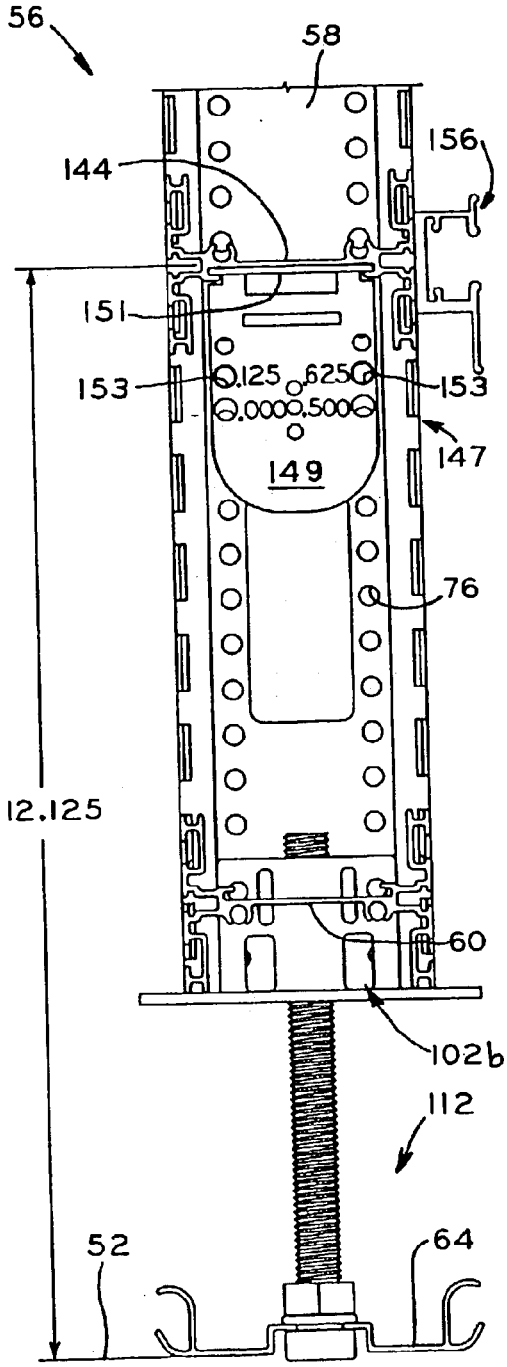
FIG. 9G is an end view of a panel frame, showing the connection of an intermediate horizontal frame member thereto, with the intermediate horizontal frame member located 12 and one eighth inches above the floor surface.

In FIG. 9G, intermediate horizontal frame member 144 and first flange 149 of L-shaped bracket 147 are moved upwardly one eighth of an inch from the position shown in FIG. 9F, and a pair of fasteners (not shown) are inserted through the hole marked "0.125" and the corresponding horizontal hole (marked "0.625") of the upper pair of holes in first set 153 of holes in first flange 149, engaging a corresponding pair of holes 76 in vertical frame member 58 to secure intermediate horizontal frame member 144 to panel frame 56, with intermediate horizontal frame member 144 located at a desired one eighth inch interval with respect to the surface of floor 52, for example, 12.125 inches as shown in FIG. 9G.

Figure 9H:
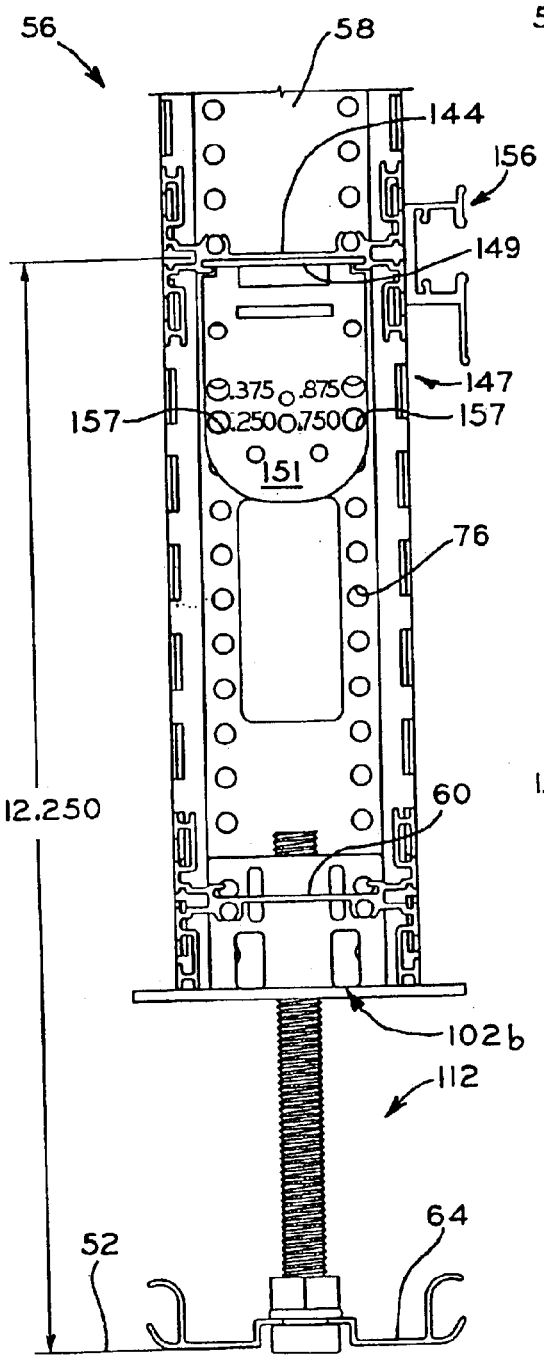
FIG. 9H is an end view of a panel frame, showing the connection of an intermediate horizontal frame member thereto, with the intermediate horizontal frame member located 12 and one fourth inches above the floor surface.

In FIG. 9H, first flange 149 of L-shaped bracket 147 is attached to intermediate horizontal frame member 144 as described above, exposing second flange 151 thereof for mounting to vertical frame member 58. A pair of fasteners (not shown) are inserted through the hole marked "0.250" and the corresponding horizontal hole (marked "0.750") of the lower pair of holes in second set 157 of holes in second flange 151, engaging a corresponding pair of holes 76 in vertical frame member 58 to secure intermediate horizontal frame member 144 to panel frame 56, with intermediate horizontal frame member 144 located at a desired one quarter inch interval with respect to the surface of floor 52, for example, 12.250 inches as shown in FIG. 9H.

Figure 9I:
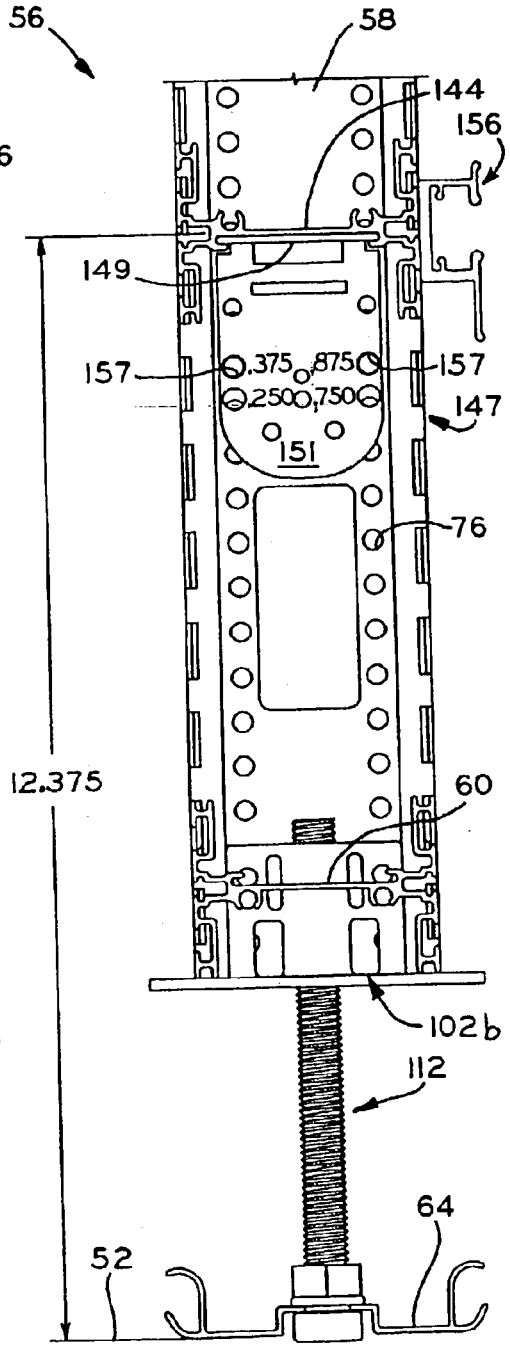

In FIG. 9I, intermediate horizontal frame member 144 and second flange 151 of L-shaped bracket 147 are moved upwardly another one eighth inch from the position shown in FIG. 9H, and a pair of fasteners (not shown) are inserted through the hole marked "0.375" and the corresponding horizontal hole (marked "0.875") of the upper pair of holes in second set 157 of holes in second flange 151, engaging a corresponding pair of holes 76 in vertical frame member 58 to secure intermediate horizontal frame member 144 to panel frame 56, with intermediate horizontal frame member 144 located at a desired three eighths inch interval with respect to the surface of floor 52, for example, 12.375 inches as shown in FIG. 91.

Continuing with the foregoing progression, and as may be seen in FIGS. 9F–9I, the other holes labeled "0.500" and "0.625" in first set of holes 153 in first flange 149 and the other holes labeled "0.750" and "0.875" in second set of holes 157 in second flange 151 may be used to attach intermediate horizontal frame member 144 to panel frame 56 with intermediate horizontal frame member 144 located at any one eighth inch interval with respect to the surface of floor 52. In this manner, the location of intermediate horizontal frame member 144 with respect to the surface of floor 52 may be varied up to one eighth of an inch, based upon the orientation of L-shaped brackets 147 and upon which holes in sets 153 and 157 of first and second flanges 149 and 151, respectively, of L-shaped brackets 147 are used. Further, as shown in FIGS. 9F–9I, mounting tracks 156 are attached to intermediate horizontal frame members 144 as described below, such that mounting tracks 156 may in turn be located at any desired one eighth inch interval with respect to the surface of floor 52.

Figure 21:
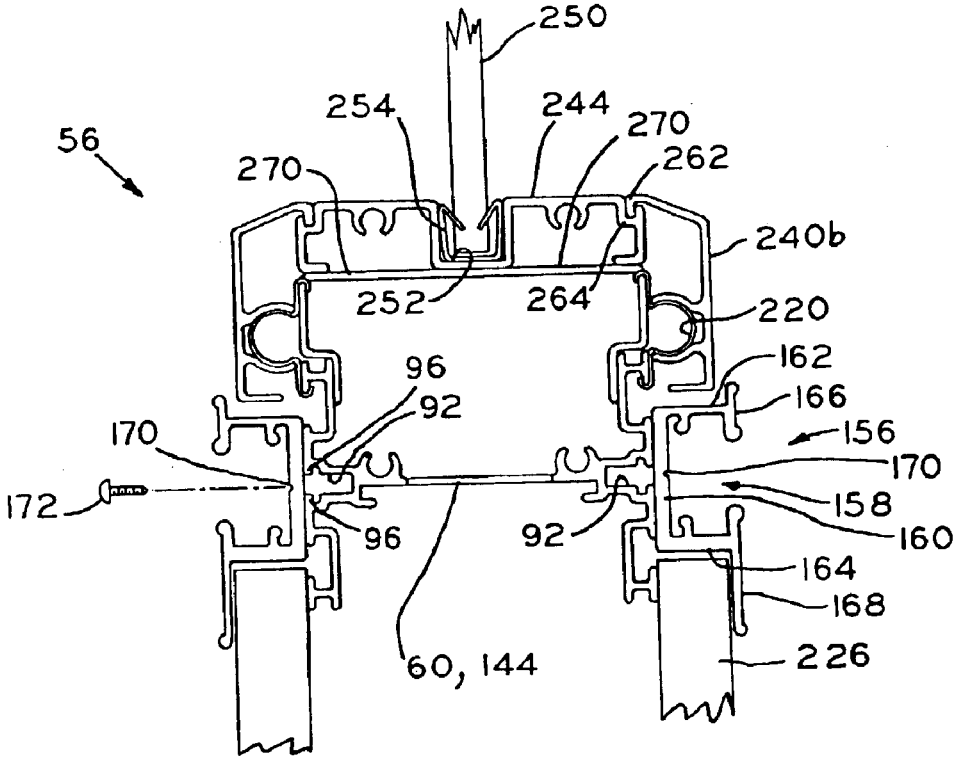
FIG. 21 is a sectional view taken along line 21—21 of FIG. 19.

Referring to FIGS. 7A and 21, mounting tracks 156 may be connected to horizontal frame members 60 adjacent the upper or lower ends of frame 56, as well as to intermediate horizontal frame members 144, which may be located at any desired vertical height with respect to frame 56, as described above. Mounting tracks 156 are described in detail in U.S. Pat. No. 5,309,686, assigned to the assignee of the present application, the disclosure of which is expressly incorporated herein by reference. Referring to FIG. 21, mounting tracks 156 generally include an extruded metal rectangular channel 158 defined by back wall 160 and upper and lower edges 162, 164, which terminate in upper and lover face surfaces 166 and 168, respectively. Back wall 160 includes V-shaped groove 170, permitting fastener 172 to be centered therein. Referring also to FIG. 7A, fastener 172 is threaded through back wall 160 and into first channel 92 of horizontal or intermediate frame members 60, 144, with the threads of fastener 172 engaging protrusions 96 at the opening of first channel 92 to secure mounting track 156 to horizontal or intermediate frame members 60, 144. Notably, because V-shaped groove 170 of mounting track 156 and first channel 92 of horizontal or intermediate frame members 60, 144 each extend continuously along the long dimensions of same, fasteners may be used to attach mounting track 156 to horizontal or intermediate frame members 60, 144 at any desired horizontal location thereon.

As described in the above-incorporated U.S. Pat. No. 5,309,686, modular office furniture components, such as work surfaces, cabinets, or shelves, for example, may be attached to mounting tracks 156 at any horizontal location therealong, and, due the variable vertical location of intermediate frame member 144 to which mounting track 156 may be attached, such modular components may therefore be located at virtually any vertical location with respect to frame 56 of panel 44. For example, as shown in FIG. 1, cabinet 174 is mounted to mounting track 156 of a panel 44 at an intermediate level between floor 52 and ceiling 54.

Figure 34:
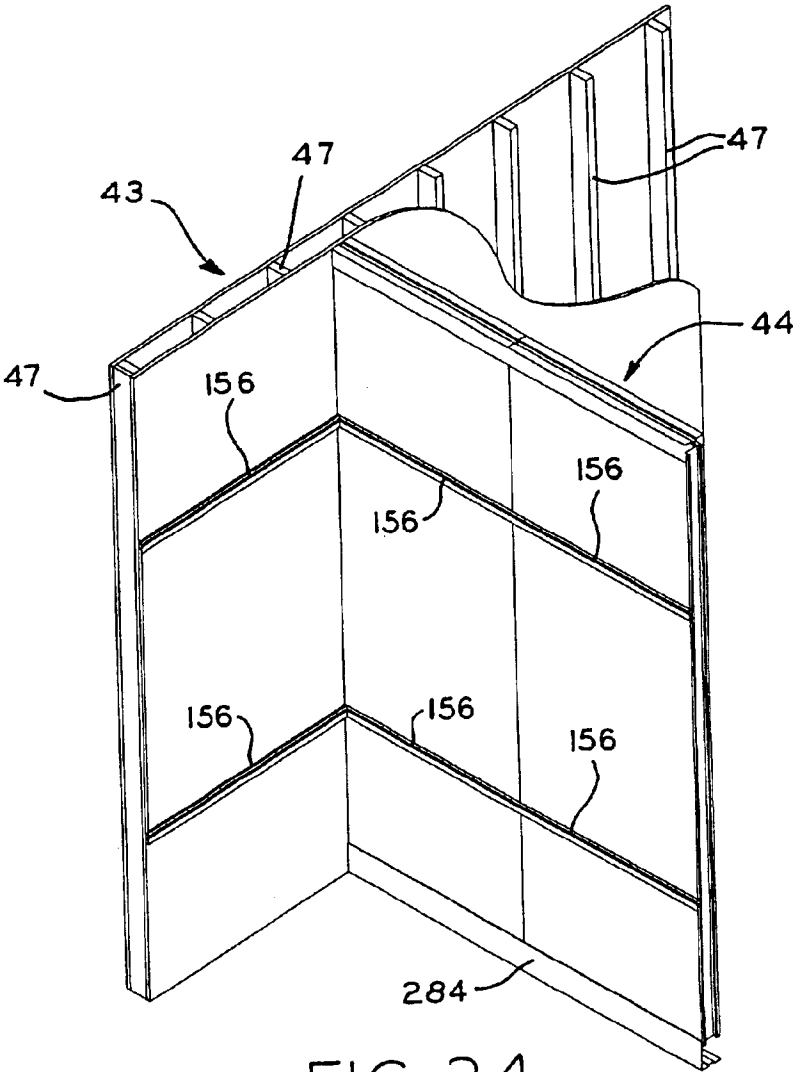
FIG. 34 is a perspective view of a panel of a panel system adjacent a permanent wall, the permanent wall partially removed to show the studs therein.

Additionally, as shown in FIG. 34, mounting tracks 156 of panels 44 of wall panel system 42 may be aligned with similar mounting tracks 156 which are mounted to an existing permanent wall 43 to provide aesthetic continuity between panels 44 of wall panel system 42 and existing permanent walls 43. Mounting tracks 156 may be mounted to permanent walls 43 in the manner described in the above-incorporated U.S. Pat. No. 5,309,686. Specifically, mounting tracks 156 may be mounted to studs 47 of permanent wall 43 using bolts (not shown), or may be mounted to the drywall or other wall material of permanent wall 43 intermediate studs 47 using a bolt and molly anchor assembly (not shown), for example. With further reference to FIGS. 9F–9I, intermediate frame member 144 of a panel frame, with mounting track 156 attached thereto, is mounted to the panel frame at a height such that mounting track 156 of the panel frame horizontally aligns with mounting track 156 on permanent wall 43 as shown in FIG. 34, such that mounting track 156 of panel 44 and mounting track 156 of permanent wall 43 are disposed at the same vertical level throughout the office space. The manner in which intermediate frame member 144 and mounting track 156 of a panel frame may be mounted thereto at any selected vertical height, up to an ⅛" interval, is described above. Advantageously, the alignment of mounting tracks 156 of panels 44 of wall panel system 42 with mounting tracks 156 on existing permanent wall 43 provides aesthetic and functional continuity throughout the office space, for example, by allowing modular office furniture components to be attached at the same vertical height to one or both of mounting tracks 156 of panels 44 of wall panel system 42 and mounting tracks 156 of permanent wall 43.

Figure 10:
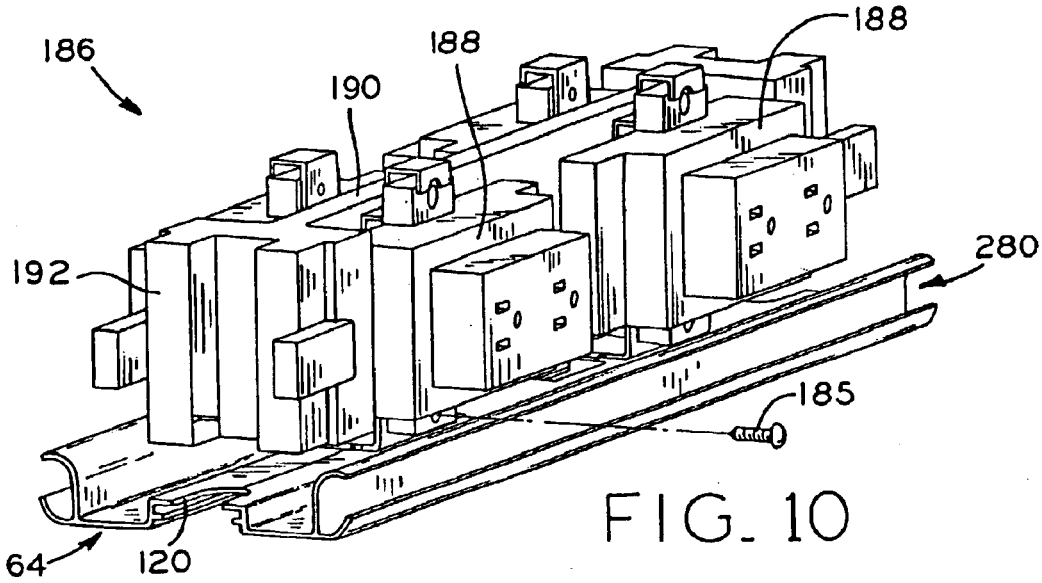
FIG. 10 is a perspective view of a portion of the, bottom of a panel frame, including a floor track to which is connected an electrical harness assembly according to a first embodiment.
Figure 11:
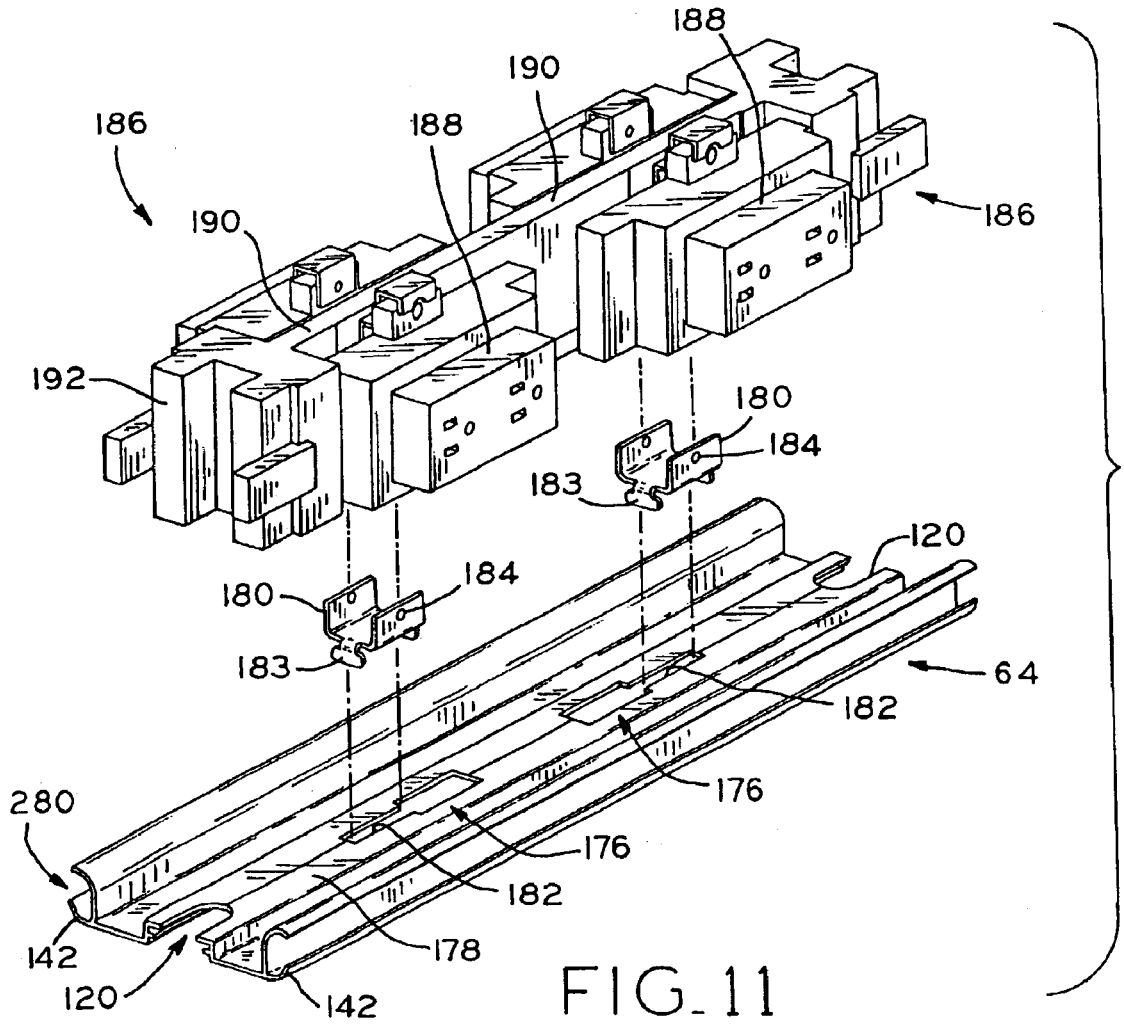
FIG. 11 is an exploded view of FIG. 10, showing the floor track, connecting brackets, and electrical harness assembly.

Referring to FIGS. 10 and 11, floor track 64 additionally includes slots 176 in central portion 178 thereof intermediate recesses 140 for receipt of U-shaped connecting brackets 180, which are used to connect electrical or data harness assemblies 186 to floor track 64 of frame 56. Tabs 183 of connecting brackets 180 are inserted within slots 176, and connecting brackets 180 are then moved along the longitudinal axis of floor track 64 to capture connecting brackets 180 within narrow portions 182 of slots 176 to secure connecting brackets 180 to floor track 64. Connecting brackets 180 include apertures 184 therein into which fasteners 185 (FIG. 10) may be received to mount harness assembly 186 to floor track 64. In the embodiment shown in FIGS. 10 and 11, fasteners 185 are disposed both through electrical outlet modules 188 and through connecting brackets 180 to connect outlet modules 188 to harness assembly 186 and also to connect harness assembly 186 to connecting brackets 180 of floor track 64.

Harness assemblies 186 may be, for example, 240 Series, 8 wire UL #183 assemblies, available from Group Dekko Engineering, Pent Div., of Kendalville, Ind., and generally include harness portions 190 which contain electrical wiring and to which electrical outlet modules 188 are attached, and electrical connection ports 192 for connecting wire jumpers (not shown) thereto. Such wire jumpers are used to connect electrical harness assemblies 186 of adjacent panels 44 together to thereby provide electrical service throughout panel system 42. Each panel frame 56 may include one or more harness assemblies 186 centrally mounted to floor track 64 of frame 56 about a vertical axis of symmetry of frame 56, with jumpers of various lengths used to connect the harness assemblies 186 of adjacent panels 44, wherein the length of the jumpers is selected to correspond to the width of the respective panels 44. In addition to electrical wiring and outlets, harness assemblies 186 may additionally include telephone and data wiring and outlets to provide telephone and data service throughout panel system 42.

Harness assemblies 186 may also be mounted to intermediate horizontal frame member, 144 if desired, to provide electrical or data service accessible at any mid-height, vertical location on panel 44 at which intermediate horizontal frame members 144 are disposed. In such an embodiment, intermediate horizontal frame members 144 may be mounted to vertical frame members 58 with harness assemblies 186 aligned with windows 78 in vertical frame members 58, such that jumpers may extend through windows 78 to connect with harness assemblies 186 of adjacent panels 44.

Figure 12B:
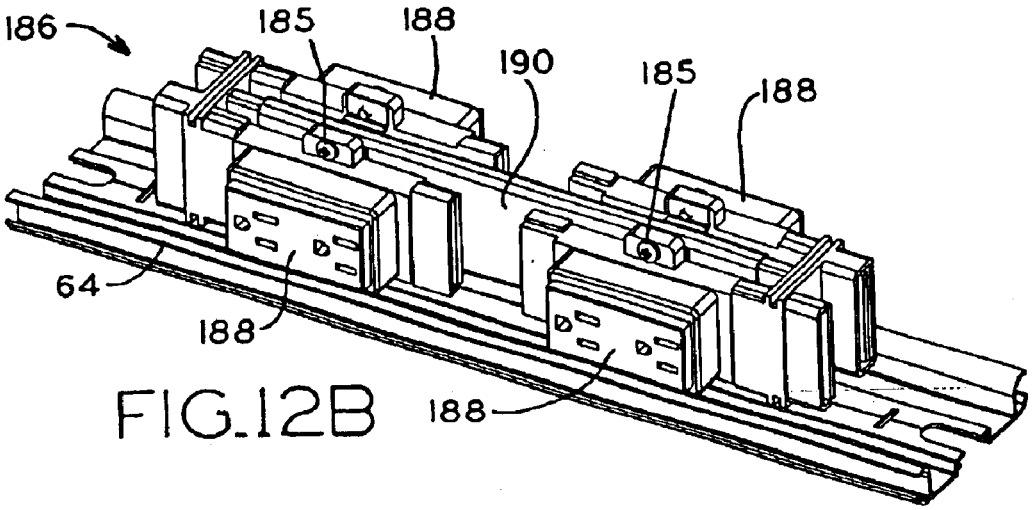
FIG. 12B is a perspective view of FIG. 12A, showing the floor track with the electrical harness assembly connected thereto.
Figure 12A:
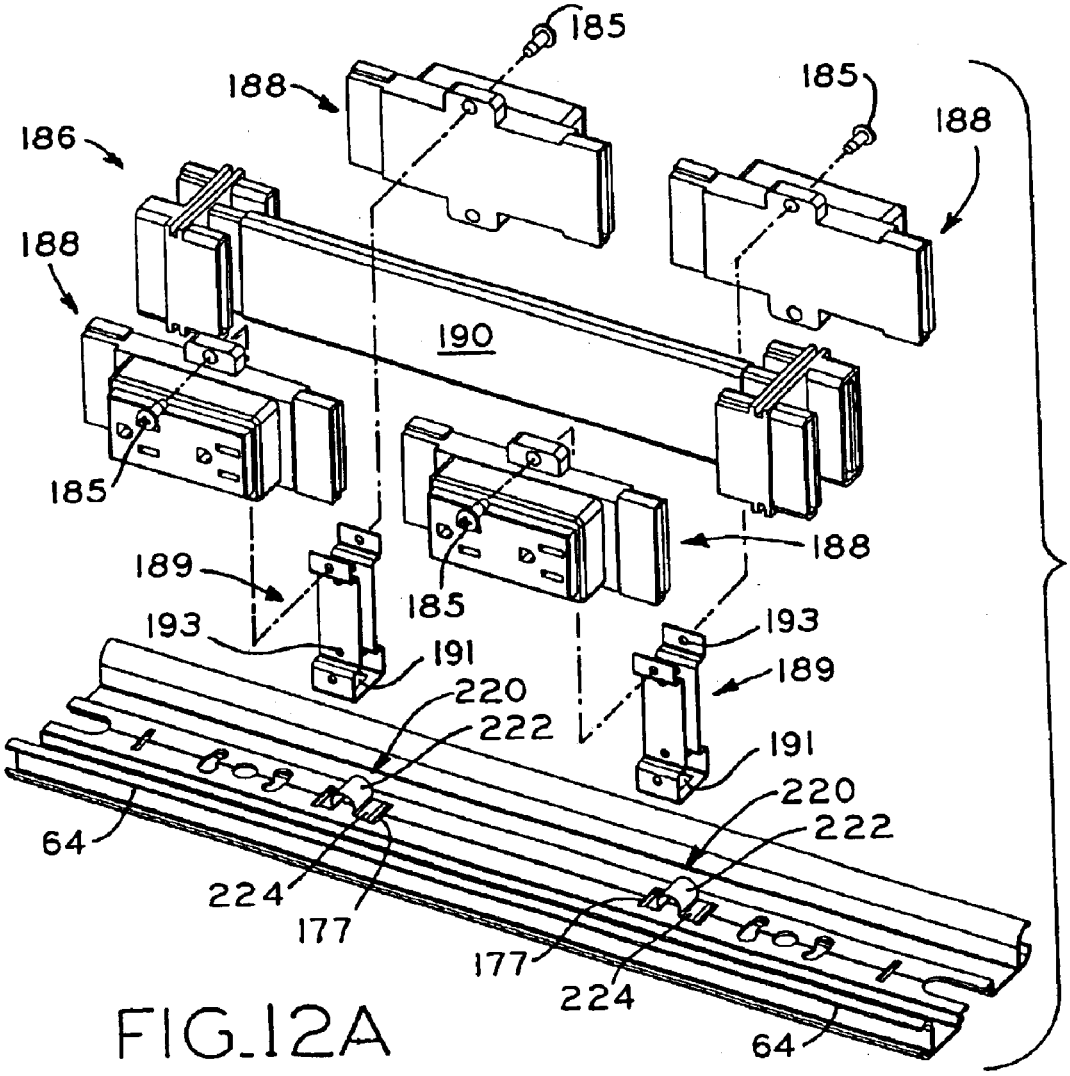
FIG. 12A is an exploded view of a portion of the bottom of a panel frame, including a floor track to which is connected an electrical harness assembly according to a second embodiment.

A second embodiment, illustrating an alternative manner of mounting electrical harness assemblies 186 to floor tracks 64, is shown in FIGS. 12A and 12B. Floor track 64 may be provided with slots 177 for receipt of spring legs 224 of spring clips 220 to thereby attach spring clips 220 to floor track 64. Connecting brackets 189 each include aperture 191 for receipt of spring body portions 222 of spring clips 220 therein to removably attach connecting brackets 189 to floor track 64. Connecting brackets 189 are may be formed from pieces of metal bent into a generally U-shape, and additionally include several holes 193 for receipt of fasteners 185 for securing electrical outlet modules 188 and harness portions 190 of harness assemblies 186 thereto in order to attach harness assemblies 186 to floor track 64, similar to the manner describes above with regard to FIGS. 10 and 11.

Figure 13:
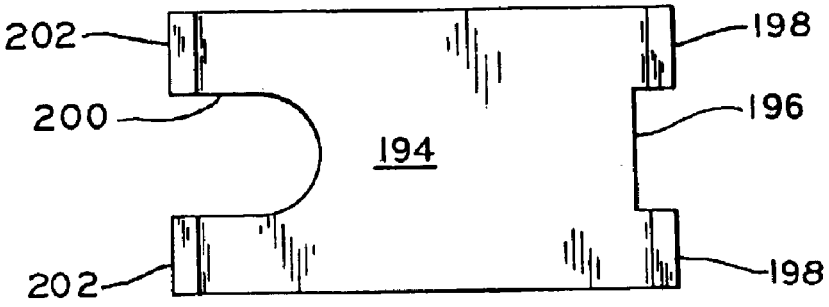
FIG. 13 is a top view of a connecting bracket for interconnecting panel frames according, to a first embodiment.
Figure 14:
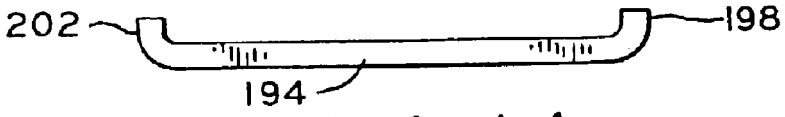
FIG. 14 is a side view of the connecting bracket of FIG. 13.
Figure 15A:
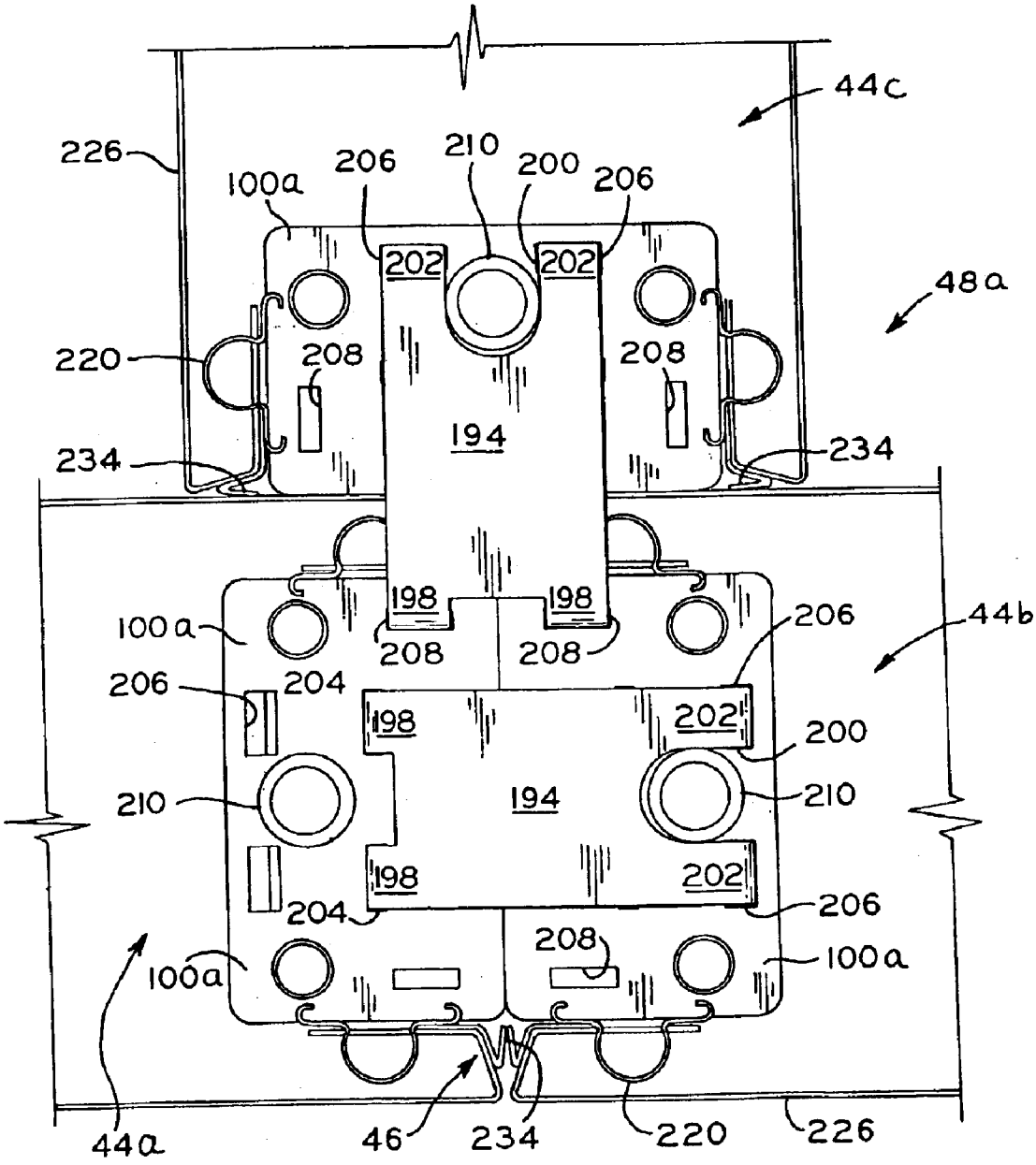
FIG. 15A is a top view showing the upper ends of three panels connected in a building module T-type connection according to a first embodiment.

Adjacent panels 44*a*, 44*b* (FIG. 15A) may be connected in an end-to-end manner according to a first embodiment, with panel connecting brackets 194, shown in FIGS. 13 and 14, which may comprise a piece of stamped and bent steel, for example. Panel connecting brackets 194 include slot 196 defining first connecting fingers 198 and, on an opposite end thereof, U-shaped slot 200 defining second connecting fingers 202. A building module end-to-end connection 46 between adjacent panels 44*a* and 44*b* is shown in FIG. 15A, in which a corner post is not used. As shown in FIG. 15A, connecting brackets 194 connect the upper ends of adjacent panels 44*a*, 44*b* in an end-to-end manner by inserting first connecting fingers 198 within first aperture; 204 in jack post plate 100*a* of a first panel 44*a*, and inserting second connecting fingers 202 within second apertures 206 of jack post plate 100*a* of an adjacent panel 44*b*, with bolt 210 disposed within U-shaped slot 200. Thereafter, bolt 210 is tightened within first bore 108 of block portion 106 to secure connecting bracket 194 in position by capturing same between the head of bolt 210 and jack post plate 100*a*, wherein the engagement of first and second connecting fingers 198, 202 of connecting bracket 194 within first and second apertures 204, 206 of plate 100*a*, respectively, prevent separation of the connected panels 44*a*, 44*b*.

Panel connecting brackets 194 also connect to plates 100*a* of panel support blocks 102A of adjacent panels 44 to secure the lower ends of panels 44 together in the same manner as that described above with respect to the upper ends of panels 44. However, rather than using bolt 210 to lock connecting brackets 194 in position, first nut 116*a* of bolt 114 is tightened to secure connecting brackets 194 in position adjacent the tower ends of panels 44.

Referring still to FIG. 15A, a further panel 44*c* may be connected to panels 44*a*, 44*b* to form a building module T-type connection 48*a* using another panel connecting bracket 194 in a similar manner as that described above, in which first connecting fingers 198 of panel connecting bracket 194 are inserted within adjacent third apertures 208 of jack post plates 100*a* of panels 44*a*, 44*b*. After second connecting fingers 202 of connecting bracket 194 are inserted within second apertures 206 of jack post plate 100*a* of panel 44*c*, bolt 210 is tightened to secure connecting bracket 194 in position as described above. A further connecting bracket 194 may be used to connect a fourth panel (not shown) to the above-described building module T-type connection 48*a* opposite panel 44*c* in the same manner as that described above to form a building module X-type connection between four adjacent panels. Connecting brackets 194 may also be attached in the same manner as that described above to connect the lower ends of panels 44*a–c* together.

Figure 15B:
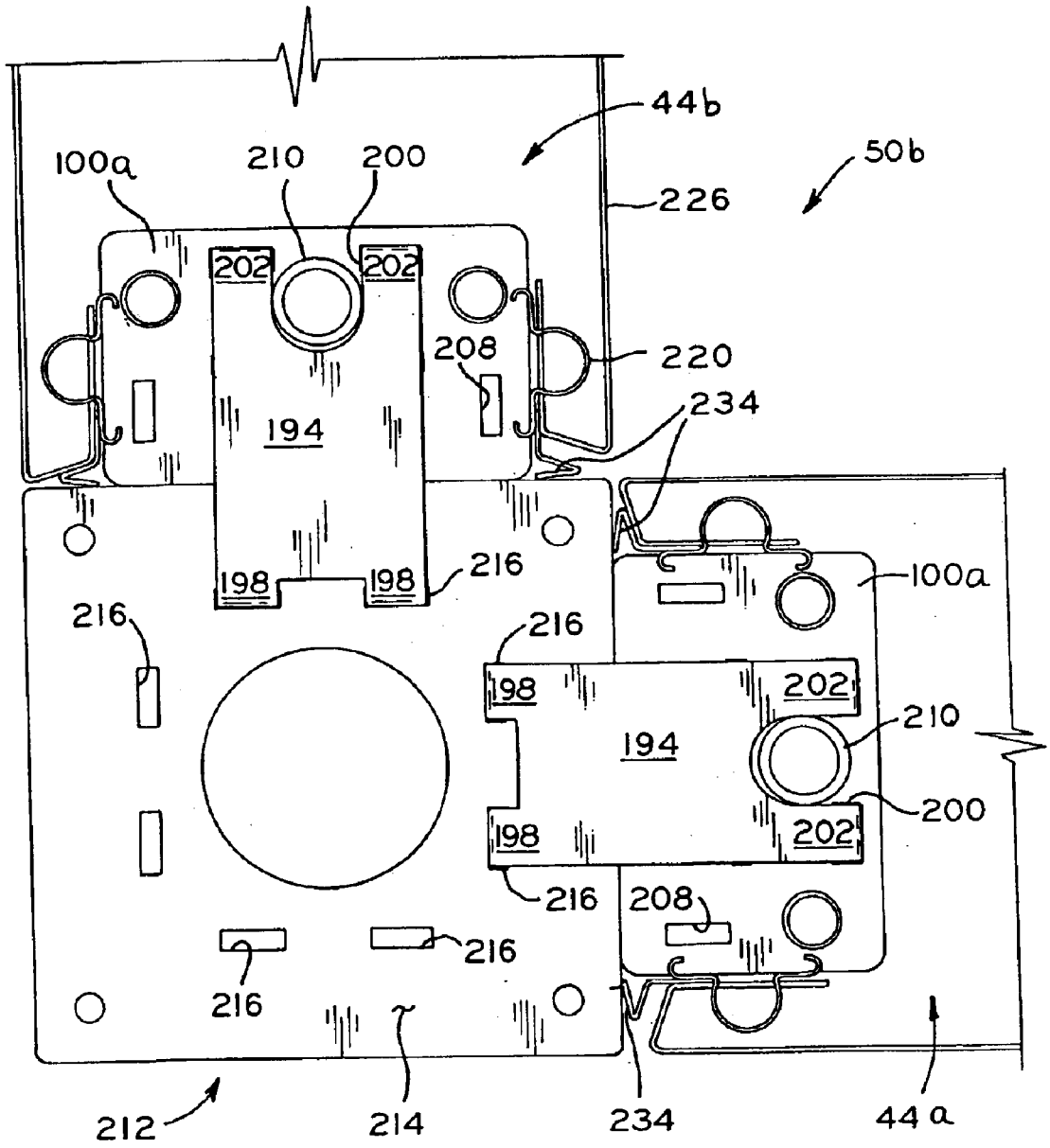
FIG. 15B is a top view showing the upper ends of two panels connected in a furniture module L-type connection with a corner post according to a first embodiment.

As shown in FIG. 15B, corner post 212 may be used to connect adjacent panels 44*a*, 44*b* together in a furniture module L-type connection 50*b* in a similar manner as described above, in which the connecting fingers of connecting brackets 194 engage apertures 216 in cover plate 214 of corner post 212. Similarly, additional panels may be connected to corner post 212 using additional connecting brackets 194 to form a furniture module T-type connection 48*b* or a furniture module X-type connection therebetween. Advantageously, adjacent panels 44 may be connected to one another in and end-to-end manner, or to form building and furniture module L-type connections 50*a*, 50*b*, building and furniture module T-type connections 48*a*, 48*b*, or furniture and building module X-type connections using the same panel connecting brackets 194, which greatly reduces the total number of components of floor-to-ceiling wall panel system 42.

Figure 15C:
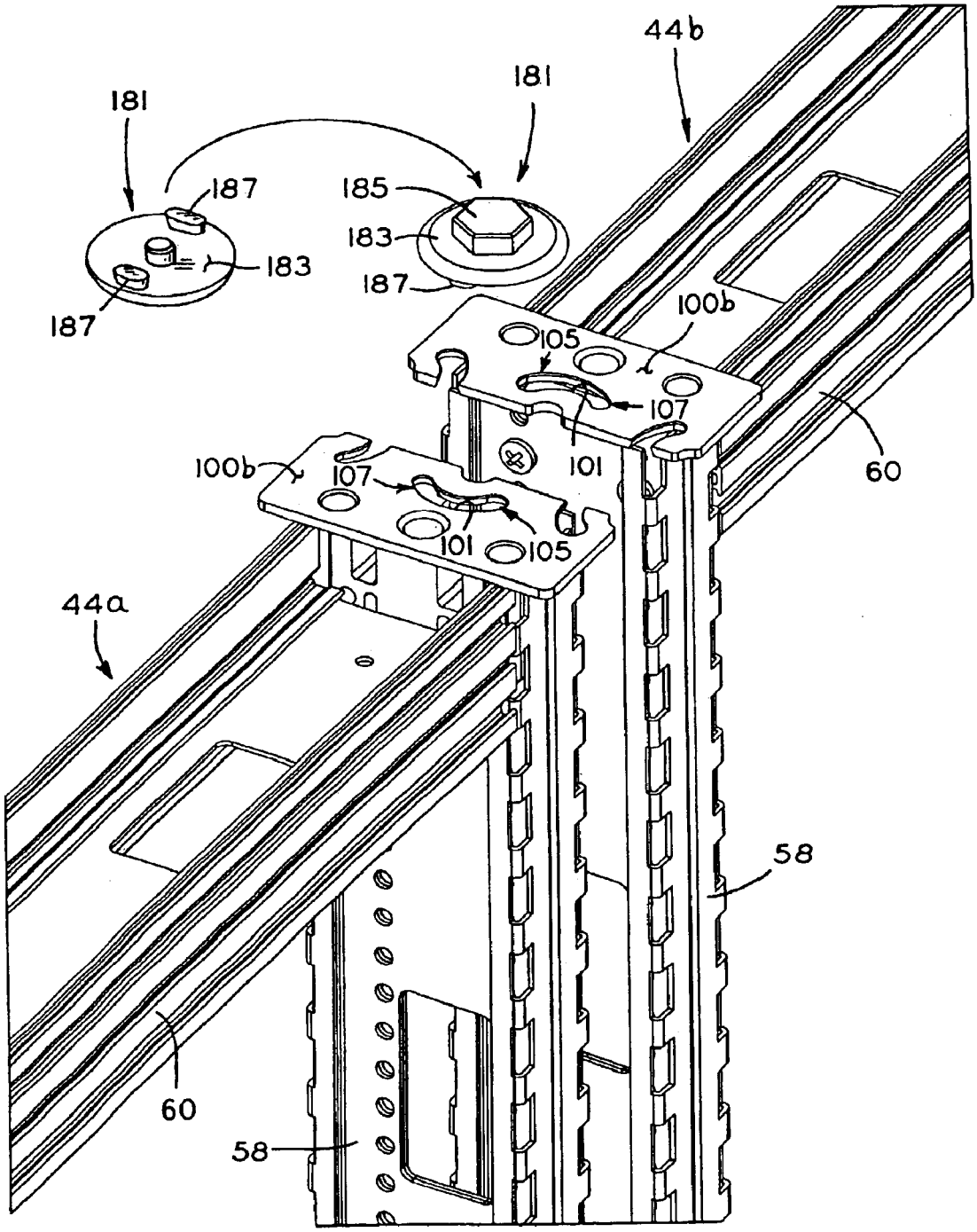
FIG. 15C is an exploded view showing the connection between two panels in an end-to-end manner using cam locks, according to a second embodiment.
Figure 15D:
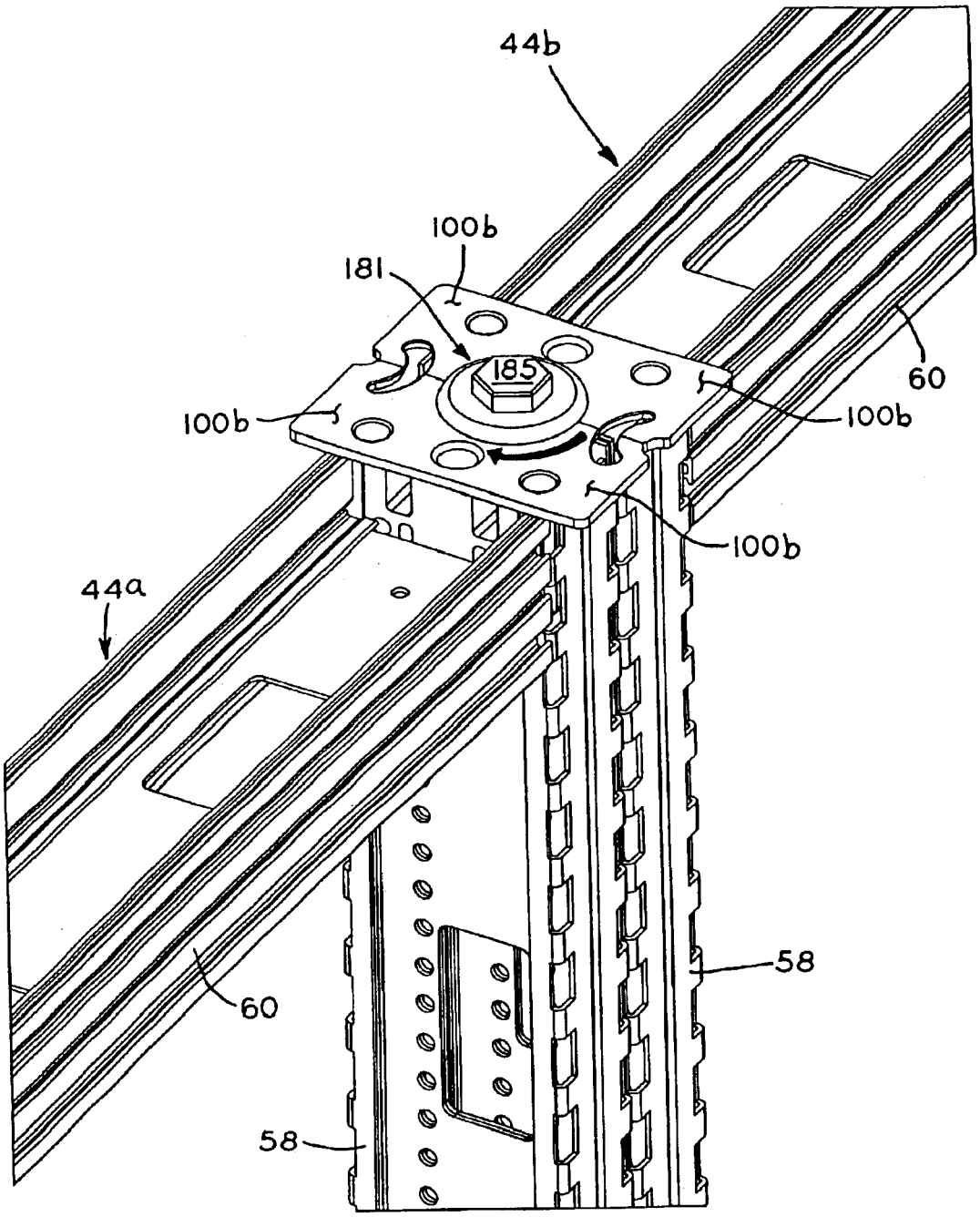
FIG. 15D is a perspective view showing the end-to-end connection between the panels of FIG. 15C.

Referring to FIG. 15C, an end-to-end panel connection according to a second embodiment is shown, in which adjacent panels 44*a*, 44*b* are connected using cam locks 181. Cam locks 181 include circular plate 183 having hexagonal nut head 185 on one side thereof and a pair of cam lugs 187 protruding from an opposite side thereof. Referring to FIGS. 15C and 15D, plates 100*b* of adjacent panels 44*a*, 44*b* are abutted against one another, and cam lugs 187 of cam locks 181 are inserted into wide portions 105 of adjacent cam slots 101, as shown in FIG. 15C. Cam locks 181 are then turned by engaging a tool (not shown) with nut head 185 of cam lock 181 and rotating same approximately one quarter of a full turn, as shown by the arrow in FIG. 15D, such that cam lugs 187 engage narrow portions 107 of cam slots 101. The engagement of cam lugs 187 into narrow portions 107 of cam slots 101 is a close-fitting engagement which produces a tactile feel to the installer, thereby indicating, to the installer that cam lugs 187 have been properly engaged with narrow portions 107 of cam slots 101 to lock adjacent panels 44*a*, 44*b* together, as shown in FIG. 15D. The bottom ends of adjacent panels 44*a*, 44*b* are connected to one another in the same manner as described above.

Figure 15E:
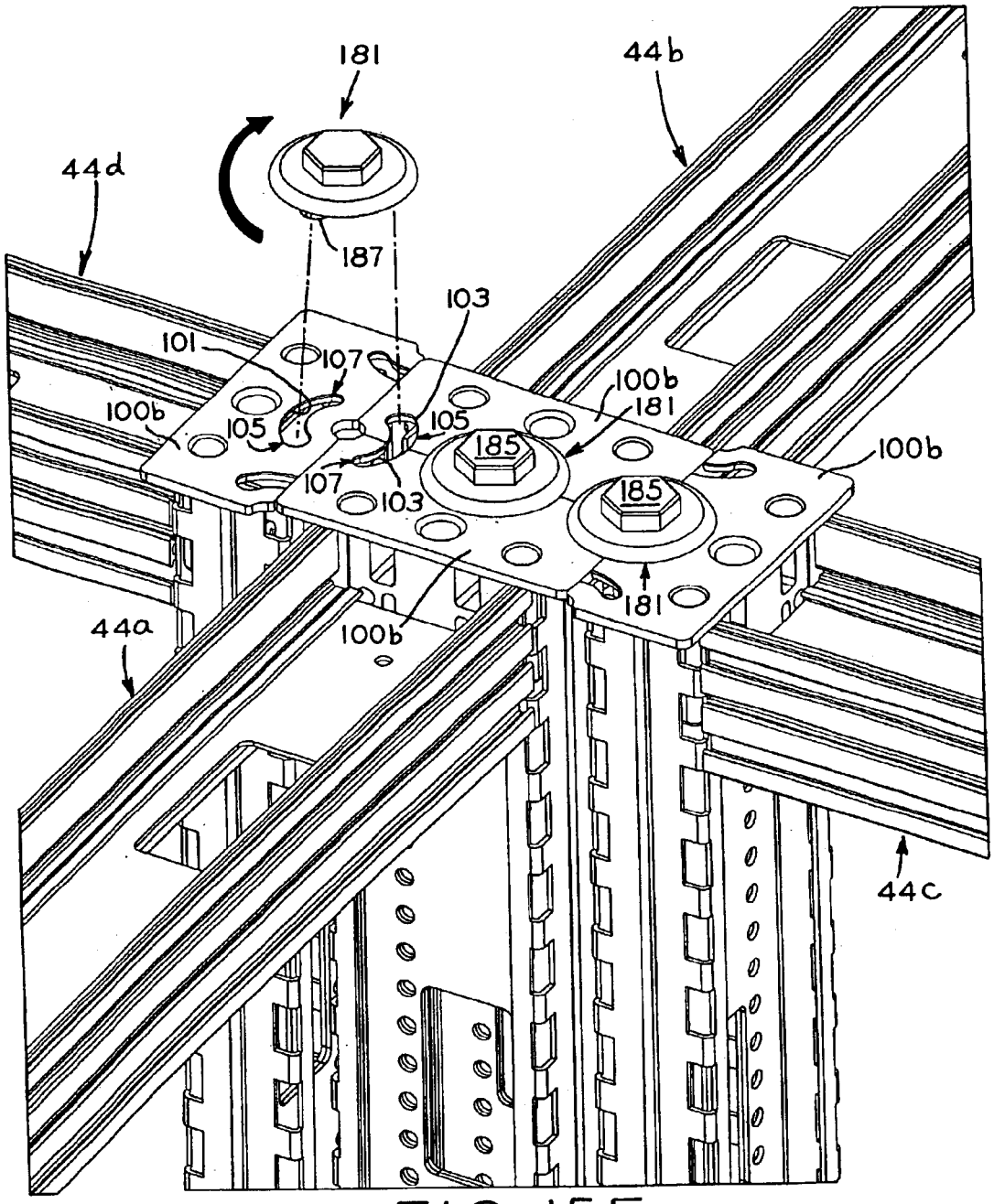
FIG. 15E is a perspective view of a building module X-type connection between four panels according to a second embodiment.

A building module X-type connection is shown in FIG. 15E, which is formed by connecting two additional panels 44*c*, 44*d* to the end-to-end building module connection shown in FIGS. 15C and 15D and described above. As shown in FIG. 15E, when panels 44*a*, 44*b* are connected together in an end-to-end connection, half cam slots 103 of adjacent plates 100*b* thereof combine to form full cam slots 101. Subsequently, adjacent panels 44*c*, 44*d* may be connected by abutting plates 100*b* of same in a perpendicular relationship to the plates 100*b* of panels 4 *a*, 44*b*, and connecting the foregoing together using cam locks 181 as described above, wherein cam lugs 187 of cam locks 181 engage full cam slots 101 of plates 100*b* of panels 44*c*, 44*d*, and also engage the combined half cam slots 103 of plates 100*b* of panels 44*a*, 44*b*. From FIG. 15E one may see that by connecting only one panel 44*c* to the building module end-to-end connection of panels 44*a*, 44*b*, a building module T-type connection 48*a* may be formed.

Figure 7C:
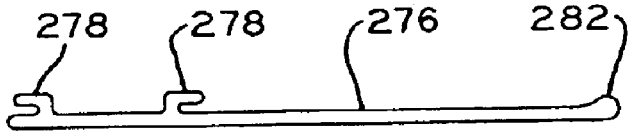
FIG. 7C is an end view of a ceiling trim member.
Figure 7D:
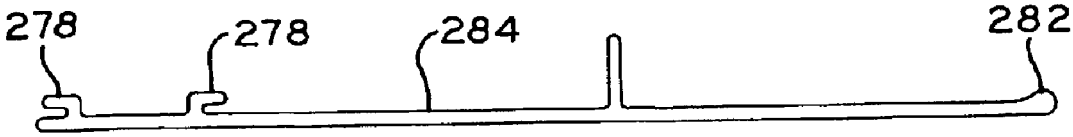
FIG. 7D is an end view of a floor trim member.
Figure 7E:
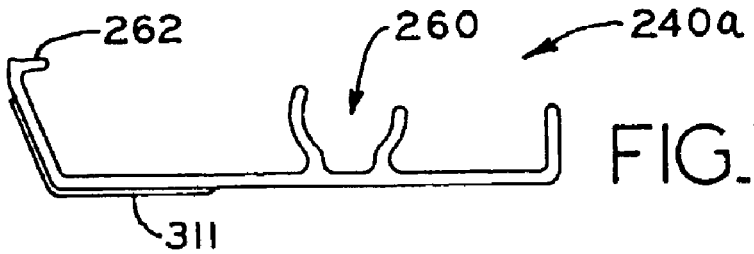
FIG. 7E is an end view of a first horizontal window casing.
Figure 7F:
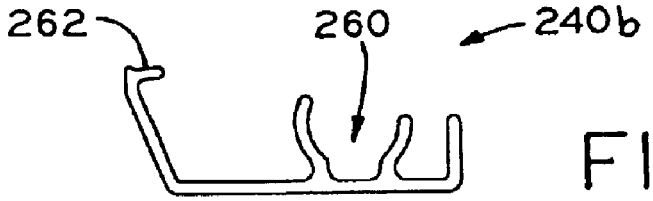
FIG. 7F is an end view of a second horizontal window casing.
Figure 7G:
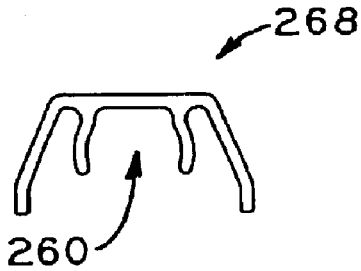
FIG. 7G is an end view of an intermediate window casing.
Figure 7H:
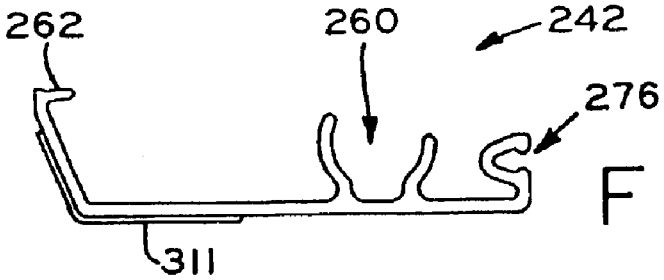
FIG. 7H is an end view of a vertical window casing.
Figure 7I:
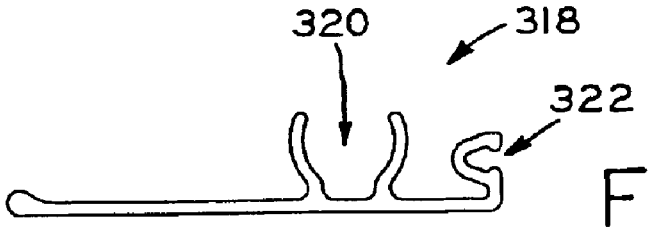
FIG. 7I is an end view of a vertical trim member.
Figure 7J:
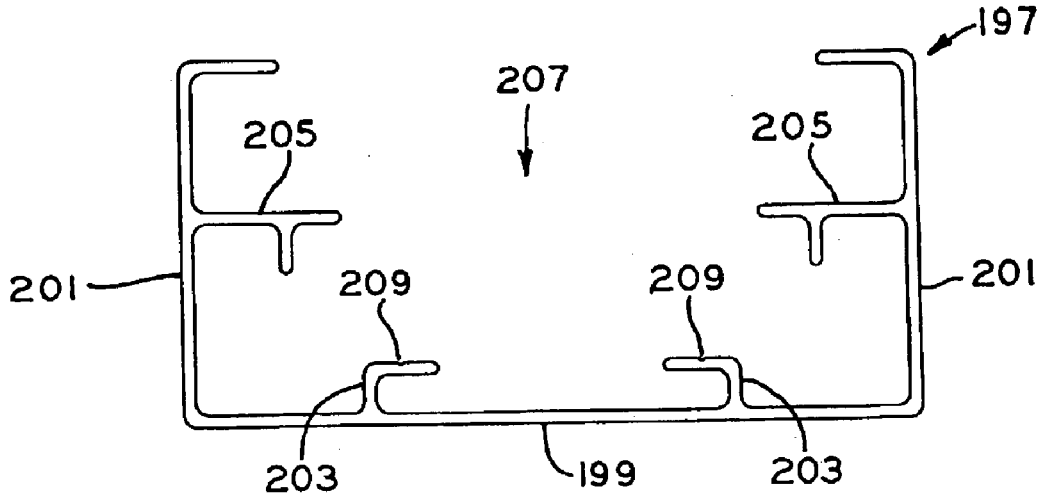
FIG. 7J is an end view of a finished end.
Figure 15F:
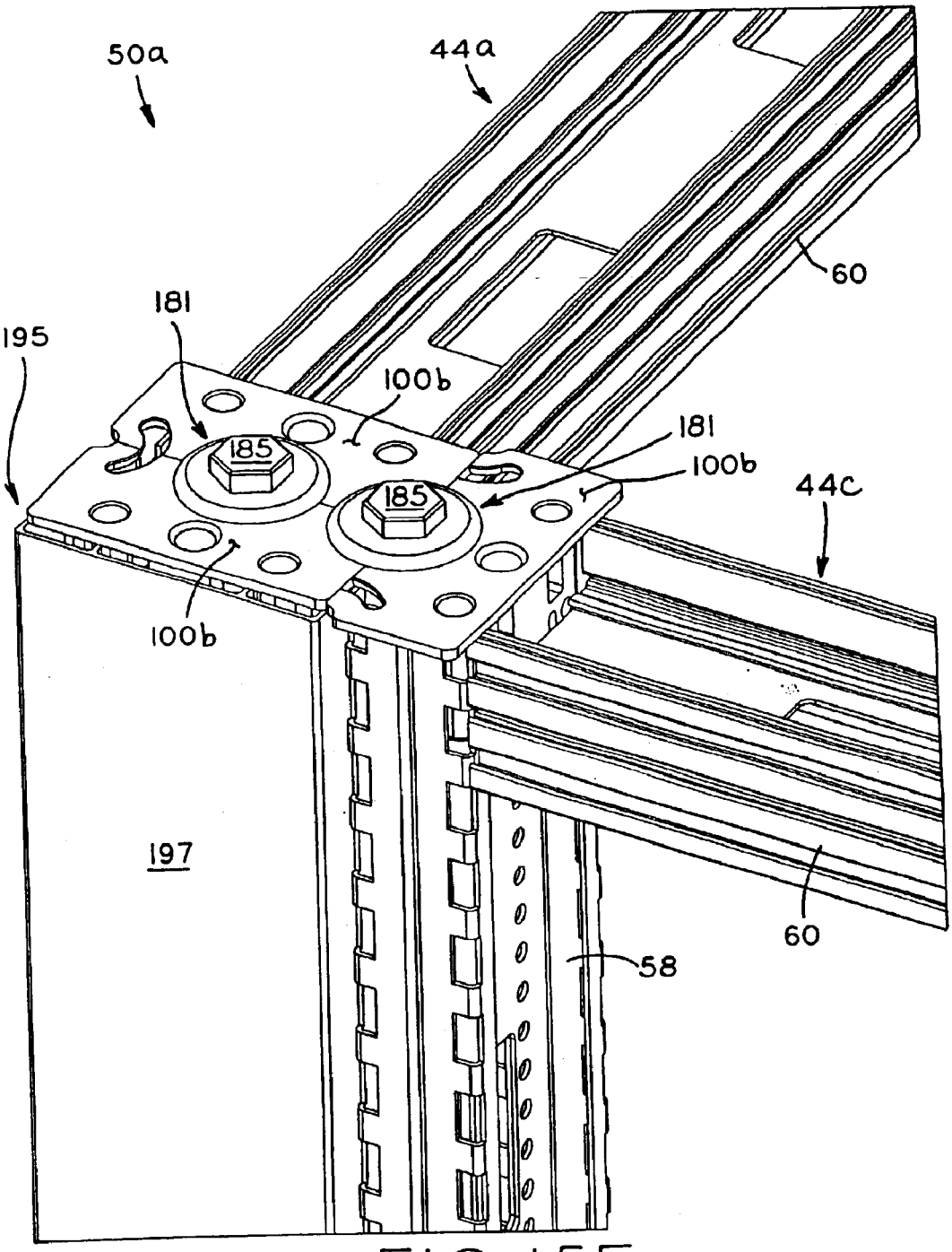
FIG. 15F is a perspective view of a building module L-type connection between two panels according to a second embodiment, further including a finished end unit.
Figure 15G:
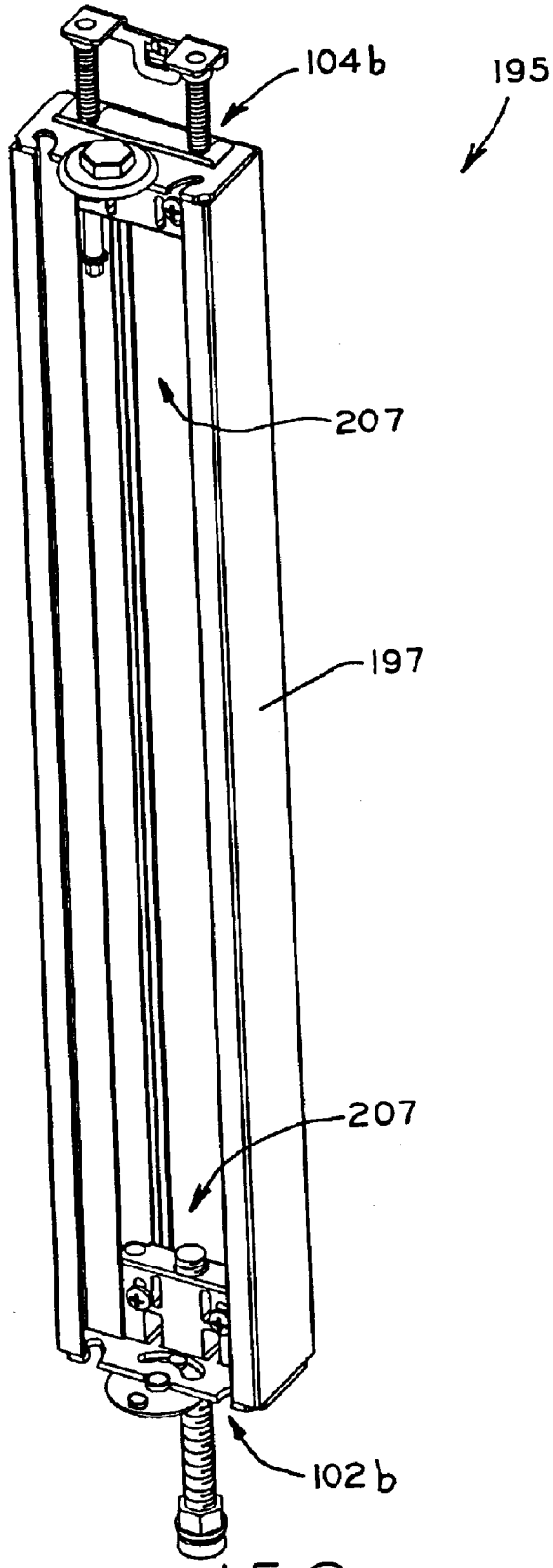
FIG. 15G is a perspective view of the finished end unit of FIG. 15F.

Referring to FIG. 15F, an L-type building module connection 50*a* is shown, wherein adjacent panels 44*a*, 44*c* are each connected to finished end unit 195. Finished end unit 195 is shown in FIG. 15G, and generally includes finish end member 197, jack post block 104*b*, and panel support block 102*b*. Referring to FIG. 7J, finished end member 197 may be formed as a metal extrusion, and includes base wall 199 and a pair of side walls 201 joined to base wall 199 to form a generally C-shaped cross section. Base wall 199 includes a pair of extensions 203, and side walls 201 include a pair of corresponding extensions 205, which together define recessed area 207 for receipt of jack post block 104*b* or panel support block 102*b*. To attach jack post block 101*b* and panel support block 102*b* to finished end member 197, fasteners 99 are inserted as through soles 98*a* or 98*b* in jack post blocks 104*b* and panel support blocks 102*b*, and into extensions 203 of base wall 199 of finished end member 197, wherein extensions 203 include tap grooves 209 (FIG. 7J) for fasteners 99 to engage.

Referring again to FIG. 15F, a first panel 44*a* is connected to plate 100*b* of finished end unit 195 using cam lock 181 as described above, and a second panel 44*c* is connected to the foregoing connection between panel 44*a* and finished end unit 195 using a second cam lock 181, as also described above. As shown in FIG. 15F, finished end member 197 of finished end unit 195 provides an aesthetic, finished end to an L-type building module connection 50*a* between adjacent panels 44*a*, 44*c*.

Figure 15H:
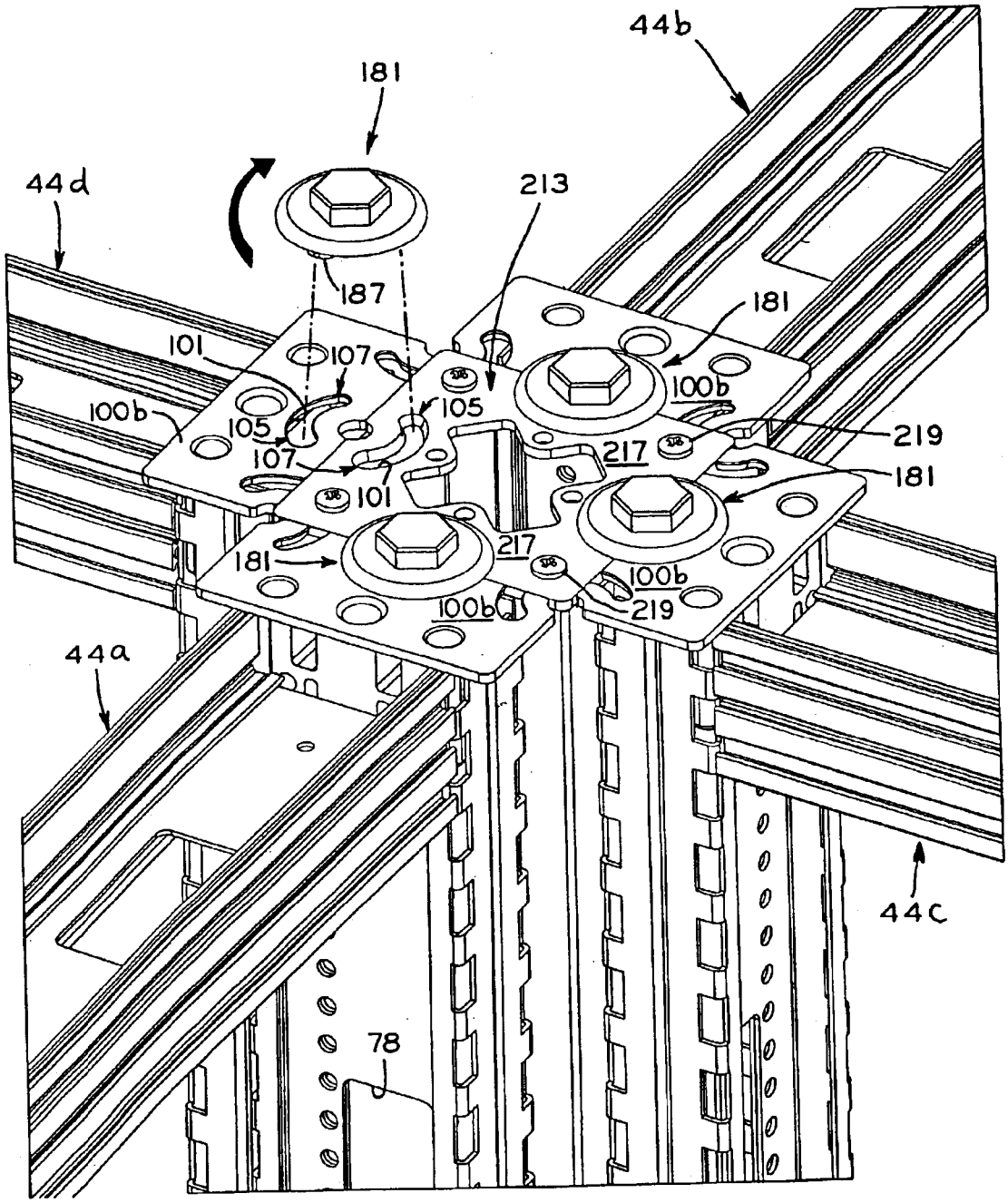
FIG. 15H is a perspective view of a furniture module X-type connection between four panels, losing a corner post unit, according to a second embodiment.
Figure 15J:
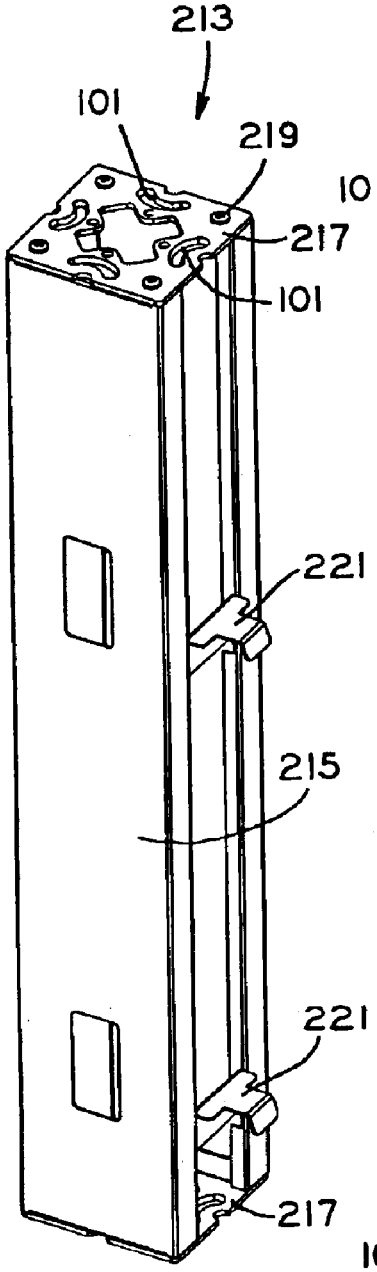
FIG. 15J is a perspective view of the corner post unit of FIG. 15H.
Figure 15I:
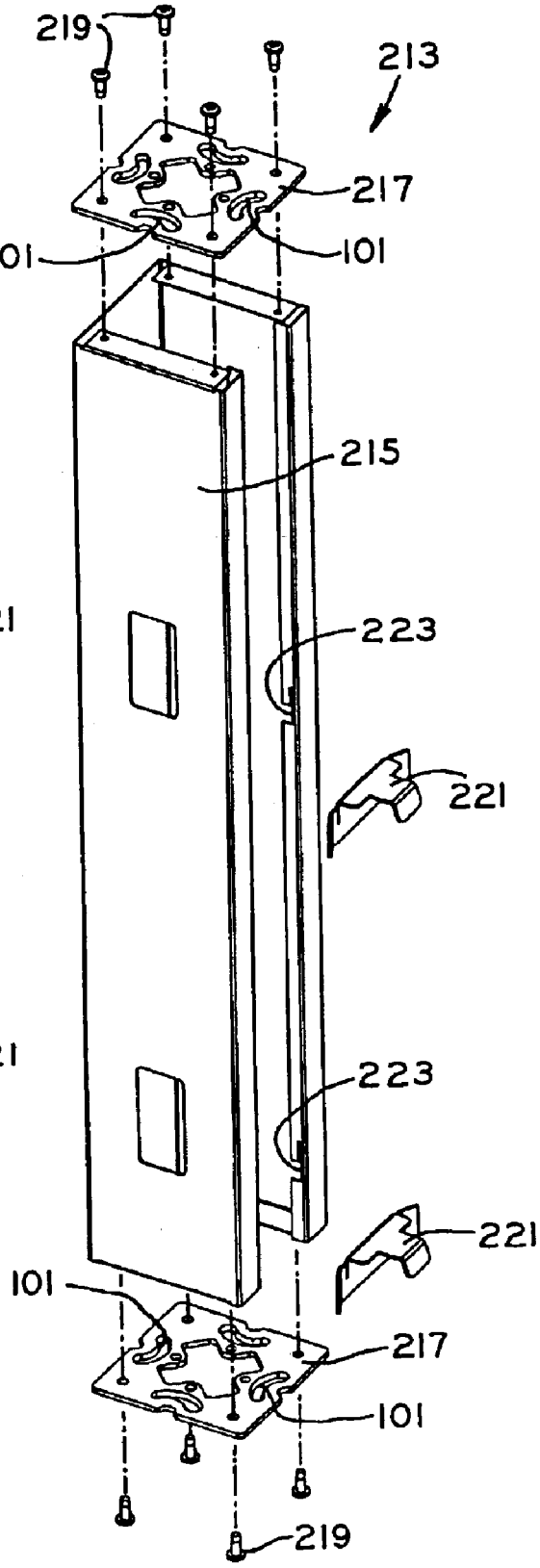
FIG. 15I is an exploded, perspective view of the corner post unit of FIG. 15H.

In FIG. 15H, an X-type furniture module connection is shown between corner post unit 213 and four panels 44*a–d*. Referring to FIGS. 15I and 15J, corner post unit 213 is shown, which includes corner post member 215 having corner post plates 217 attached at either end thereof using fasteners 219. Corner post plates 217 include cam slots 101 adjacent each of the four sides thereof. Corner posts 215 additionally includes hooks 221 attached to slots 223 thereof, the function of which will be explained below.

Referring back to FIG. 15H, corner post unit 213 is initially attached to a first panel 44*a* by engaging hooks 221 of corner post 215 within windows 78 of vertical frame member 58 of panel 44*a*, thereby hanging corner post unit 213 from panel 44*a* to support the weight of corner post unit 213 while additional connections thereto are made. Thereafter, cam locks 181 are used to connect the upper and lower ends of panel 44*a* to corner post unit 213 in the manner described above. Thereafter, additional panels 44*c–d* may be connected to corner post unit 213 using additional cam locks 181. From FIG. 15H, one may see that an L-type furniture module connection 50*b* may be made by connecting two panels 44*a*, 44*b* to corner post unit 213, and a T-type furniture module connection 48*b* may be made by connecting three panels 44*a–c* to corner post unit 213.

Figure 16:
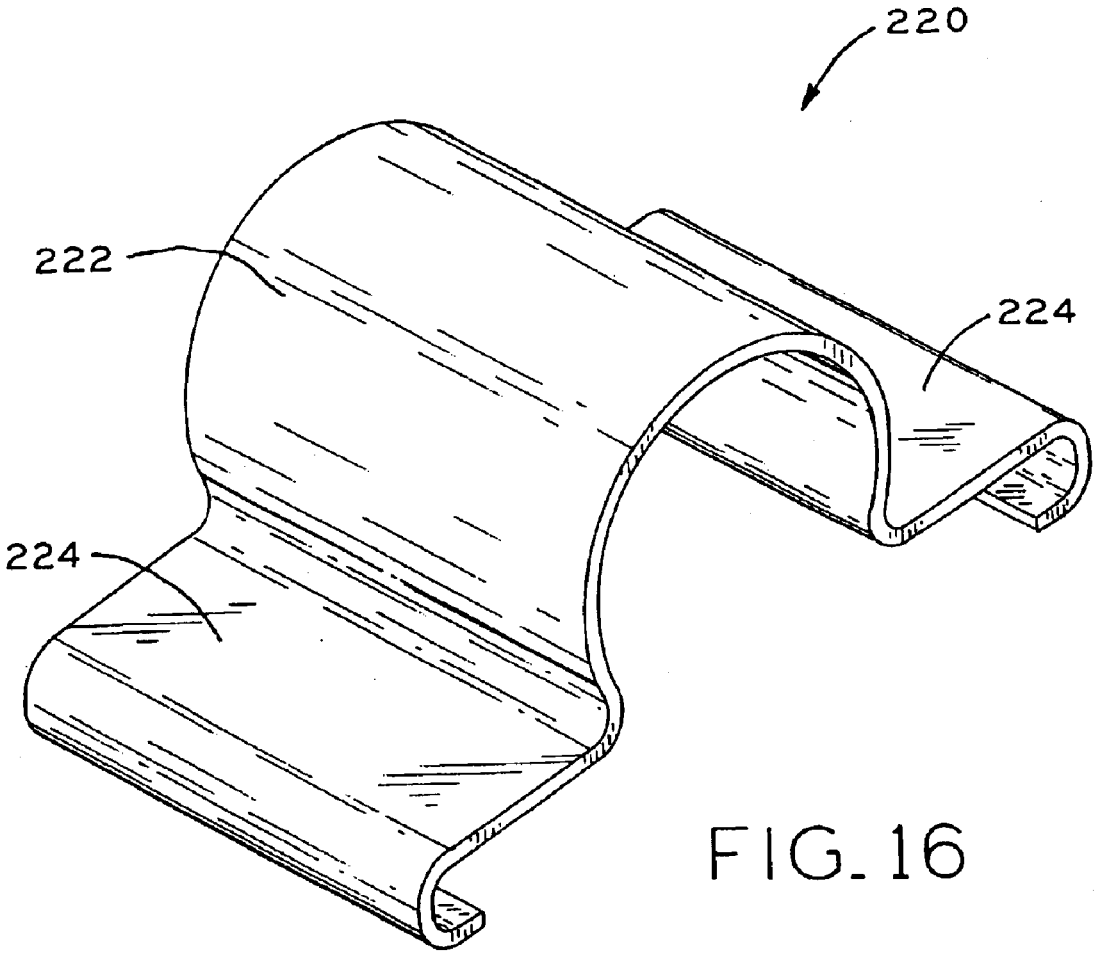
FIG. 16 is a perspective view of a spring clip.

Spring clips 220, shown in FIG. 16, are used to attach various components of floor-to-ceiling panel system 42 to frames 56 of panels 44, as described below. Spring clips 220 may be formed from stamped and bent pieces of spring steel, for example. Spring clips 220 are somewhat horseshoe-shaped in overall appearance, and include central, arched spring body portion 222 from which extend a pair of spring legs 224. As shown in FIGS. 9, 15A–15B, 18, 20–21, and 23–24, spring clips 220 may be connected to vertical frame members 58 by engaging spring legs 224 thereof within horizontally adjacent pairs of slots 80 in sub-frame members 68 of vertical frame members 58. Additionally, spring clips 220 may be attached at any horizontal location along horizontal or intermediate frame members 60, 144 in any of the three vertically spaced positions aligned with first and second channels 92, 94 thereof (FIG. 7A), wherein spring legs 224 of spring clips 220 engage spaced pairs of protrusions 96 at the openings of first and second channels 92, 94 of horizontal or intermediate frame members 60.

Figure 17A:
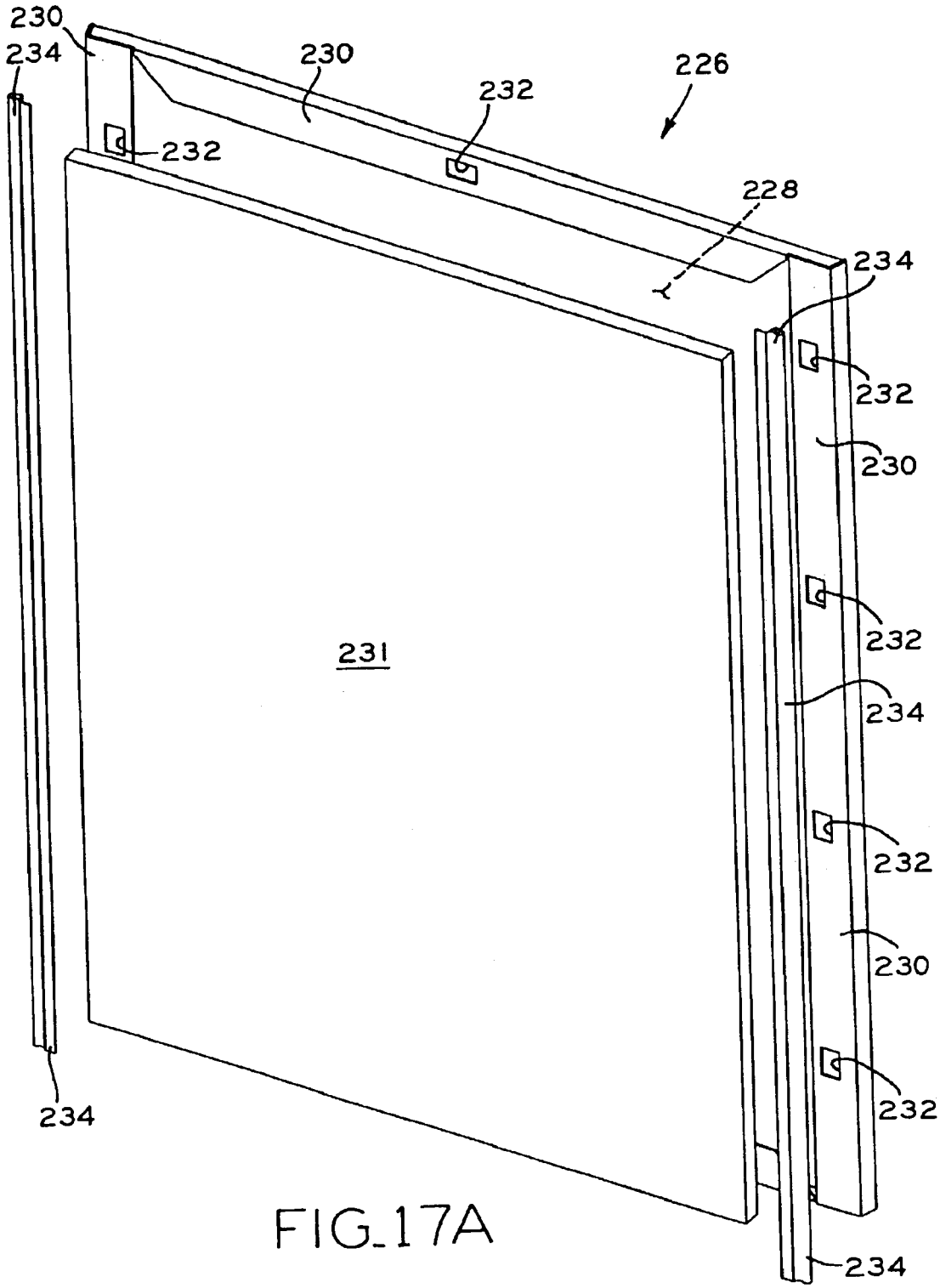
FIG. 17A is an exploded view of an opaque panel skin assembly.
Figure 17B:
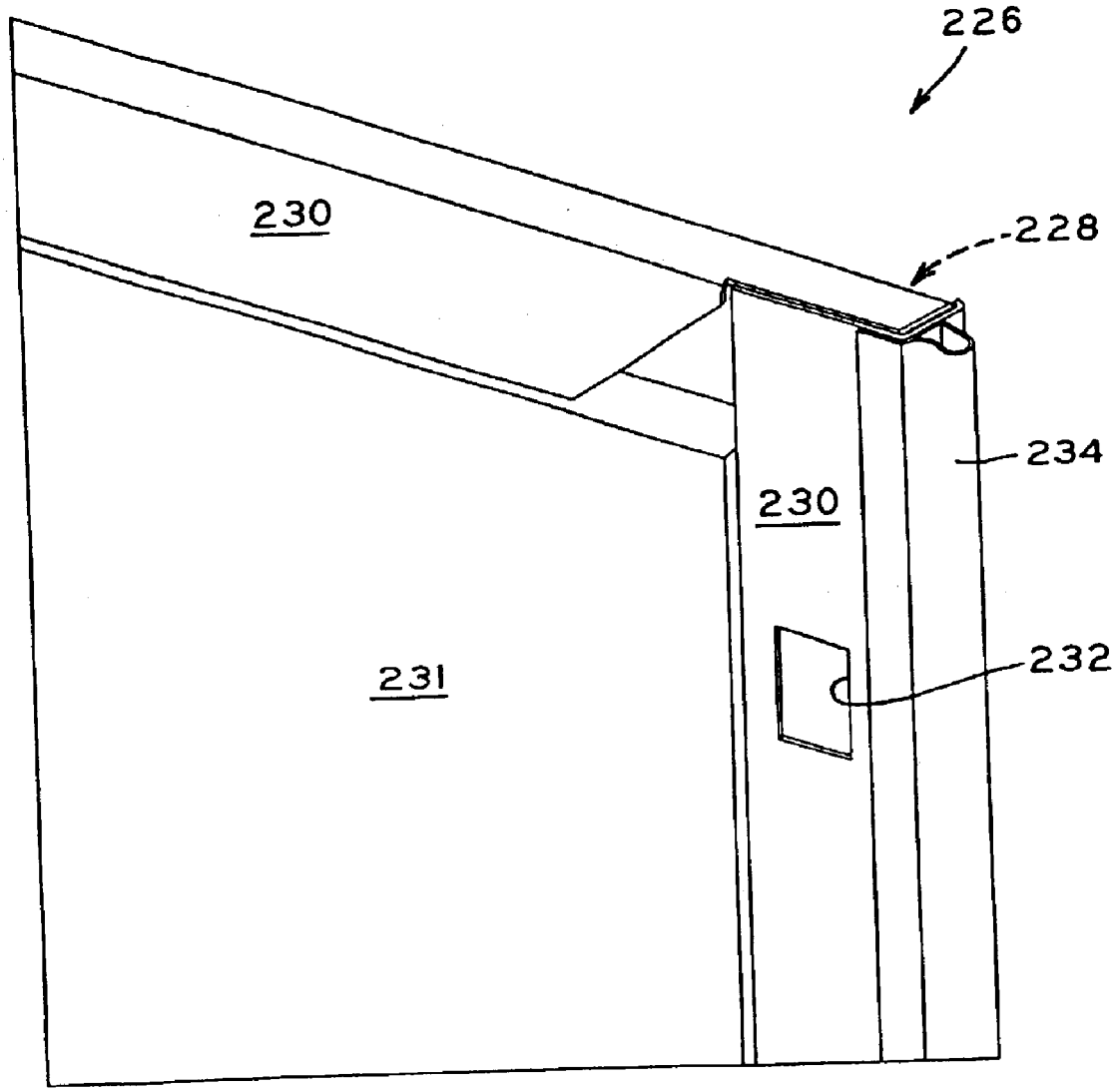
FIG. 17B is a perspective view of a portion of the opaque panel skin assembly of FIG. 17A, shown in an assembled condition.

Opaque panel skins 226, shown in FIGS. 17A and B, may generally include a piece of sheet metal or plastic with panel face 228 having the edge regions thereof bent or formed to define frame portion 230. Core 231 is received within frame portion 230, and is attached thereto in a suitable manner such as by adhesive, for example. Core 230 may be formed from a lightweight material such as honeycomb cardboard. Typically, opaque panel skins 226 are covered with a surface finish, such as paint, wood veneer, or an upholstery material such as fabric or vinyl. Alternatively, opaque panel skins 226 may include only a plastic or metal frame portion 230 which encloses a panel portion made from solid wood, a veneered manufactured wood material, molded plastic, upholstery, fabric, or any other suitable material. Frame portion 230 includes apertures 232 which are adapted to receive spring body portions 222 of spring clips 220 therein, as discussed below. Light and sound seals 234, further described below, are attached long the rear sides of the vertical edges of frame portions 230 by adhesive, for example.

Figure 18A:
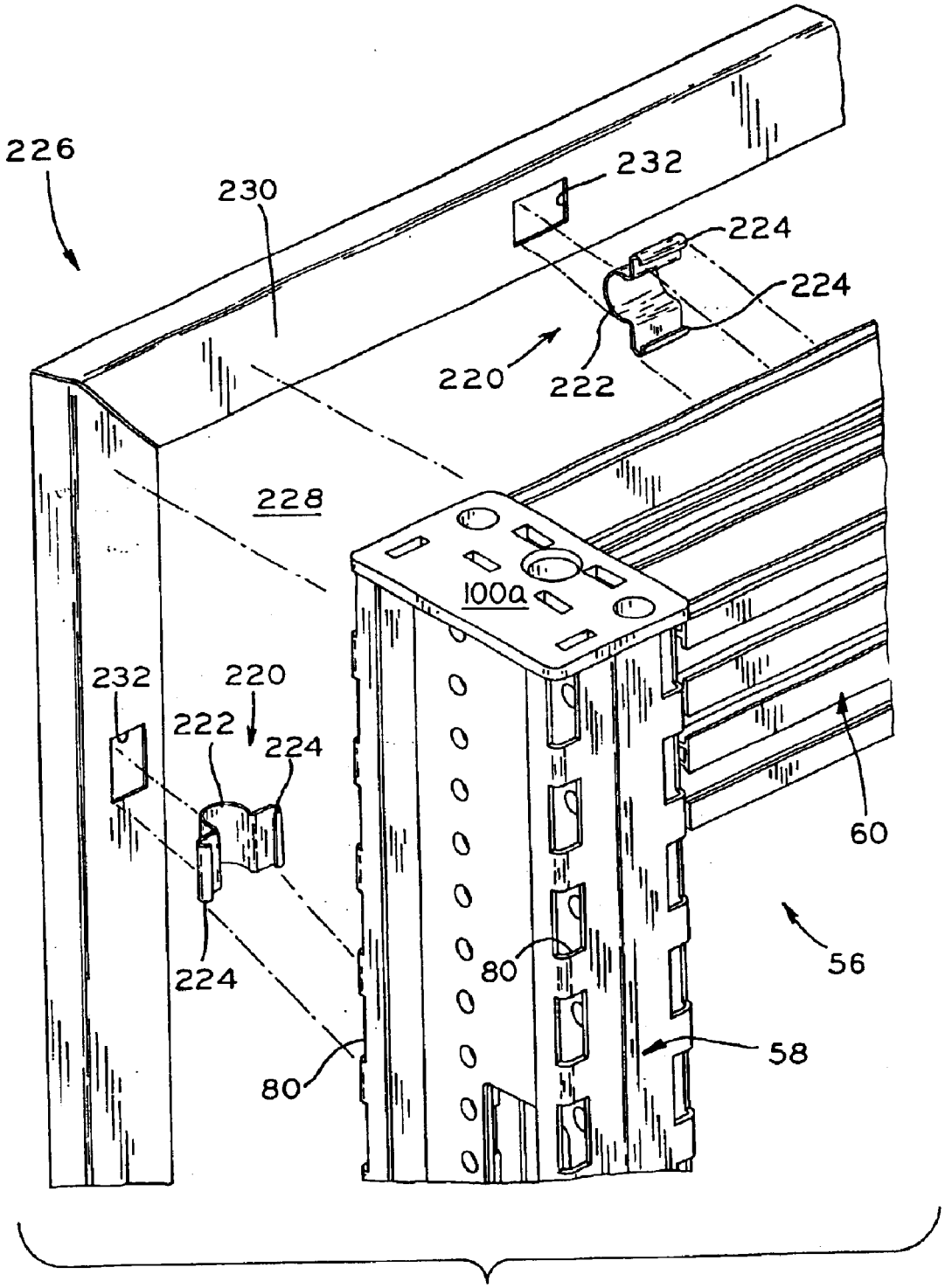
FIG. 18A is a perspective, exploded view showing an upper portion of a panel frame and the attachment of a panel skin thereto using the spring clips of FIG. 16.
Figure 18B:
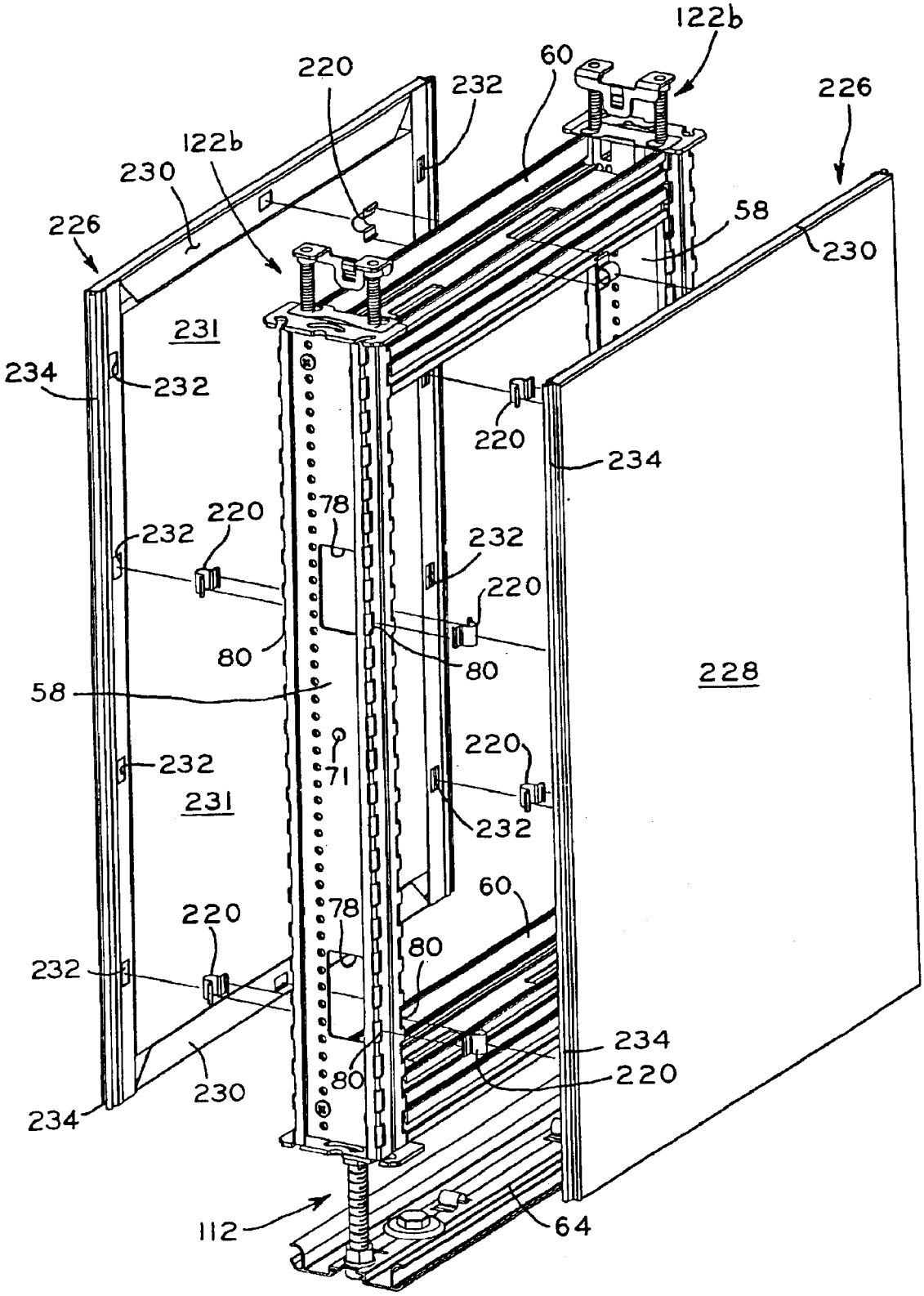
FIG. 18B is a perspective, exploded view showing a full panel frame and the attachment of a pair of panel skins thereto using the spring clips of FIG. 16.
Figure 18C:
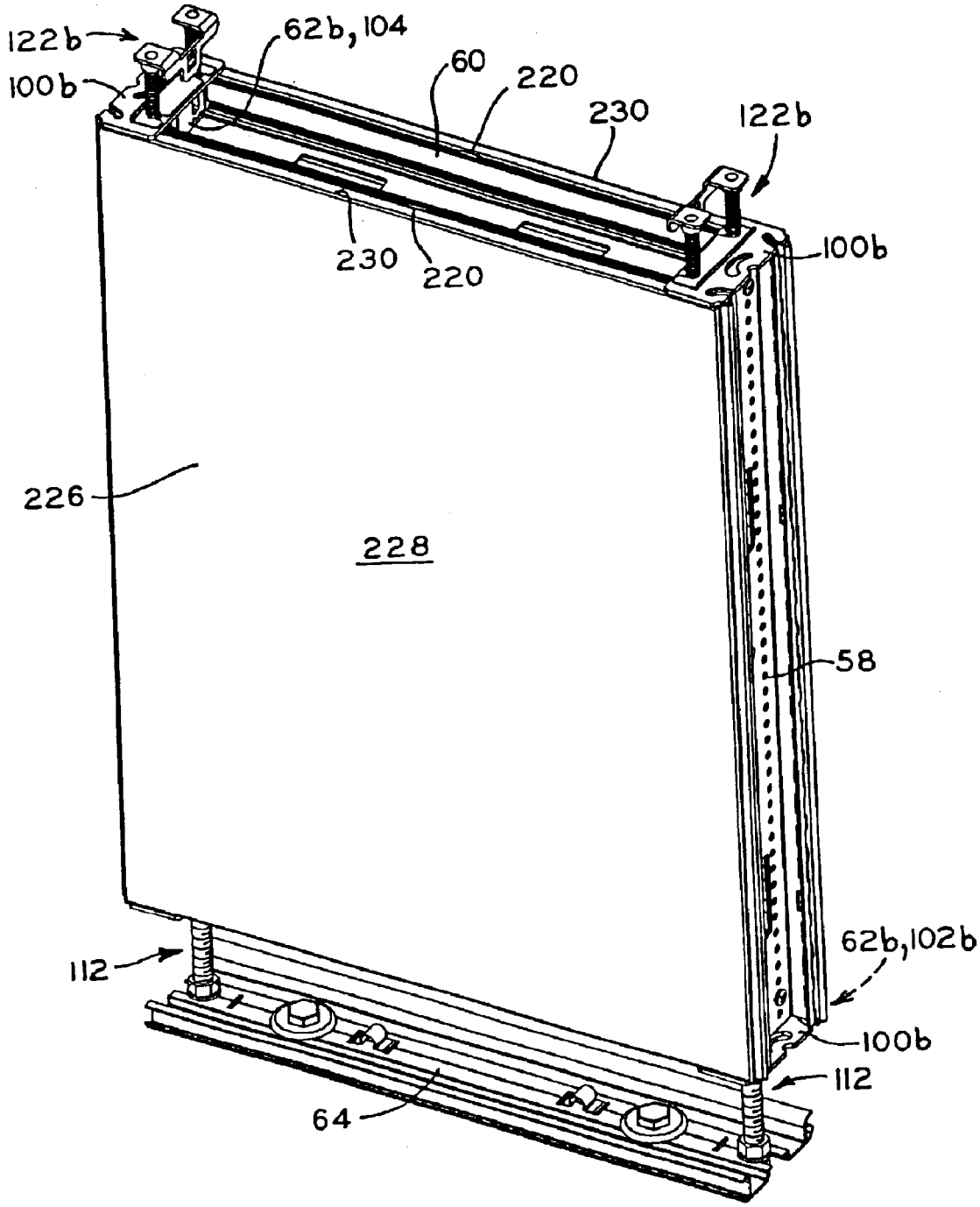
FIG. 18C is a perspective view of the full panel frame of FIG. 18B, with a pair of panel skins attached thereto.

Referring to FIG. 18A and 18B, to detachably mount opaque panel skins 226 to panel frame 56, spring clips 220 may be first attached to vertical and/or horizontal frame members 58, 60, followed by pressing spring body portions 222 of spring clips 220 within apertures 232 in frame portion 230 of opaque panel skins 226. Specifically, spring body portions 222 deform when pressed through the edges of apertures 232 and then spring back to their original shape with an audible clicking sound after passing therethrough to secure opaque panel skins 226 to frame 56. Opaque panel skins 226 may be removed from panel frame 56 by pulling same away from panel frame 56, such that spring body portions 222 of spring clips 220 disengage from aperture 232 in frame portion 230 of opaque panel skin 226. An exemplary panel 42 having an opaque panel skin 226 attached thereto is shown in FIG. 18C.

Figure 26:
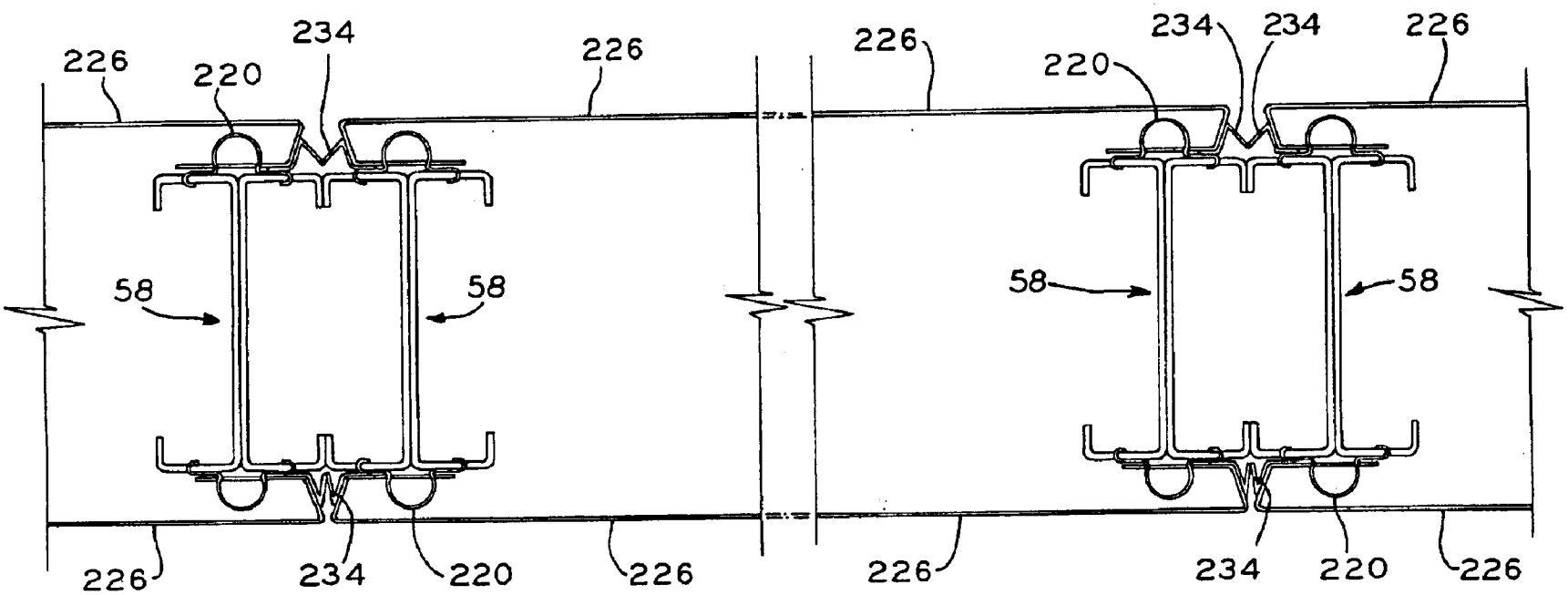
FIG. 26 is a top view showing an end-to-end, panel-to-panel connection, the panels including opaque panel skins with light and sound seals therebetween, wherein on one side of each connection, the opaque panel skins are in abutment with one another, and on an opposite side of each connection, the opaque panel skins are spaced from one another.

Opaque panel skins 226 may be sized as shown in FIG. 26 such that, when adjacent panels are attached to one another in a side-to-side relationship, the ends of opaque panel skins 226 may directly abut one another to provide a continuous vertical wall surface. Alternatively, as also shown in FIG. 26, opaque panel skins 226 may be sized such that a vertical gap is left therebetween when adjacent panels are attached to one another in a side-to-side relationship. In either of the foregoing arrangements, flexible light and sound seals 234 of panel skins 226 deform upon engagement with one another, as shown in FIGS. 15A and 26, or upon engagement with adjacent structures such as corner post 212, as shown in FIG. 15B, to provide a seal which blocks the transmission of light and sound through the connective interface of panels 44. Light and sound seals 234 may also be deformed inwardly to allow access to slots 80 of vertical frame members 58 for attachment of modular furniture components thereto.

Figure 7K:
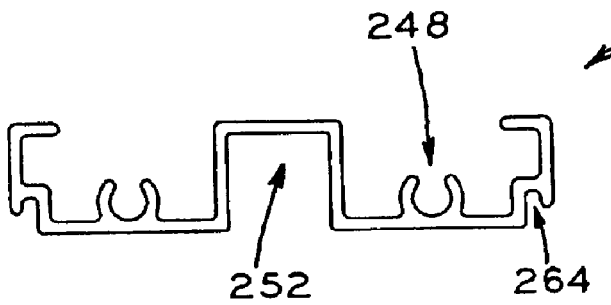
FIG. 7K is an end view of a horizontal window frame member.
Figure 7L:
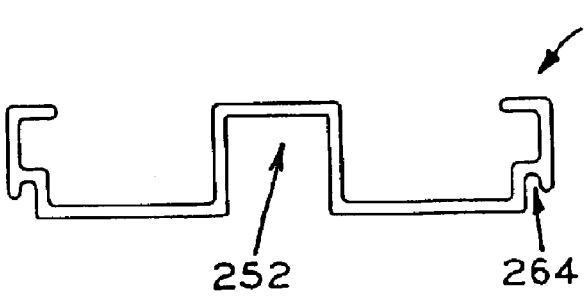
FIG. 7L is an end view of an vertical window frame member.

In addition to opaque panel skins 226, panels 44 may include window panels 236 (FIGS. 19, 22A), which generally include window frame 238 attached to panel frame 56 by first or second horizontal window casings 240*a* (FIG. 7E), 240*b* (FIG. 7F) and vertical window casings 242 (FIG. 7H), as described below. Window frame 238, shown in FIGS. 22A and 22B, includes horizontal and vertical window frame members 244 (FIG. 7K), 246 (FIG. 7L), respectively, which may comprise pieces of extruded aluminum, for example. Horizontal window frame members 244 include fastening embossments 248 therein into which fasteners 243 may be threaded which also pass through holes (not shown) in vertical window frame members 246 to secure horizontal and vertical window frame members 244, 246 together about window pane 250, as shown in FIG. 22B. Alternatively, vertical window frame members 246 may include fastening embossments 248. Referring to FIGS. 7K, 7L, and 22B, horizontal and vertical window frame members 244, 246 additionally include recesses 252 into which window glazing elements 254 are disposed. Window glazing elements 254 may be formed of a dual durometer extrusion of plastic material, including relatively stiff base portion 256 and relatively flexible side wall portions 258 (FIG. 23) which flexibly capture window pane 250 therebetween for securing and stabilizing window pane 250 within window frame 238.

Figure 22A:
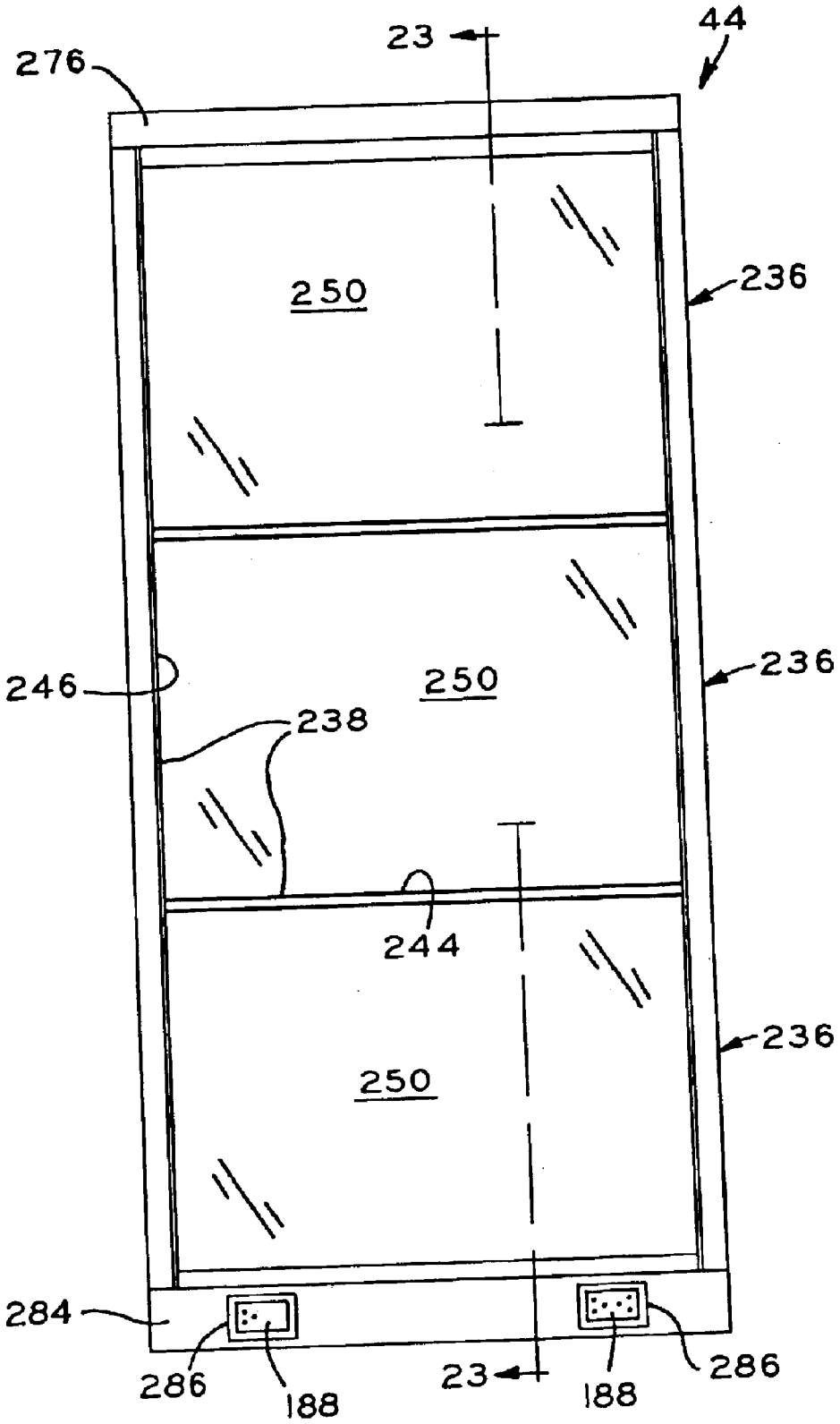
FIG. 22A is a front view of a panel including three vertically adjacent window panels.
Figure 22B:
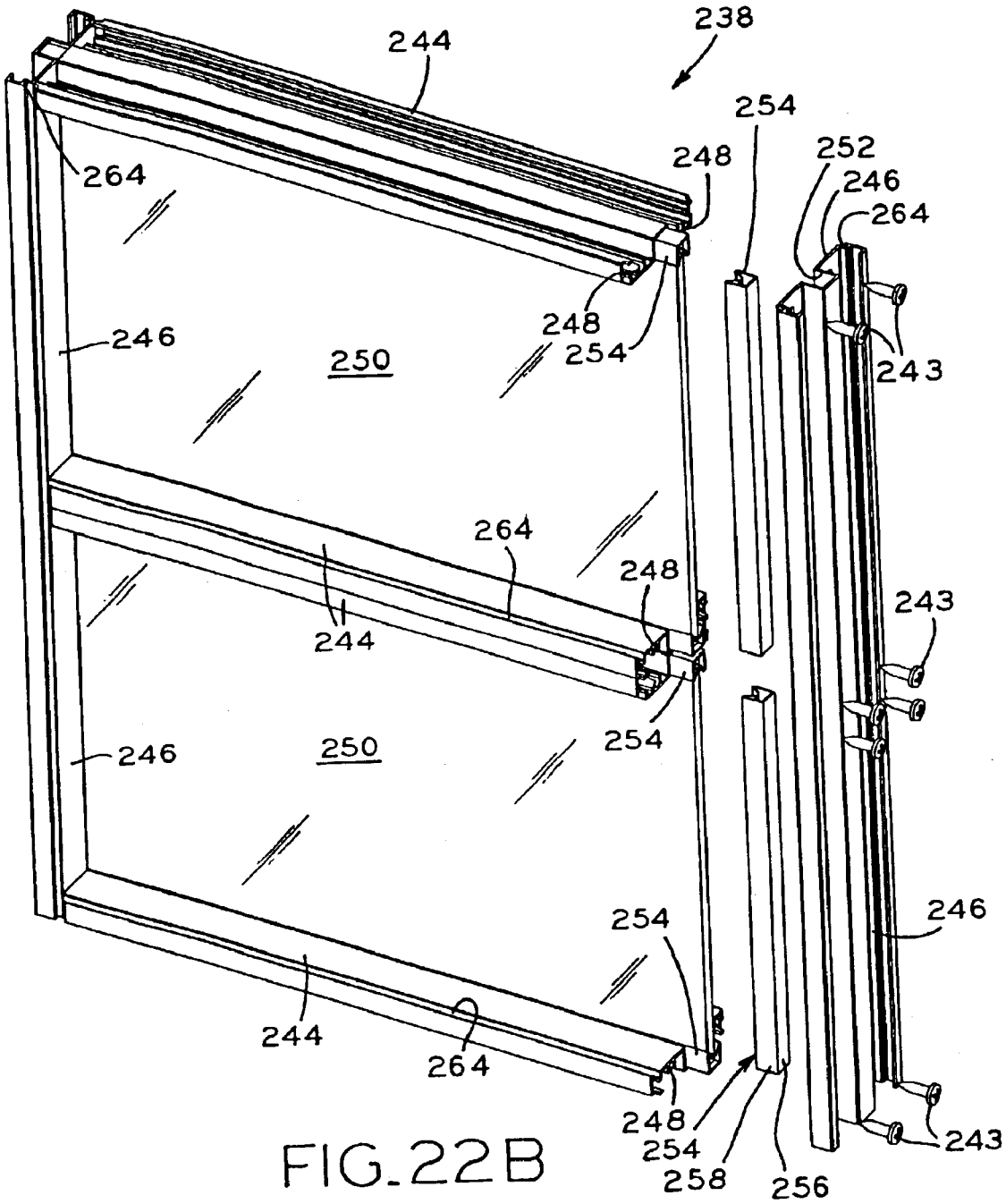
FIG. 22B is a perspective, partially exploded view of one of the window frames in the panel of FIG. 22A.
Figure 22C:
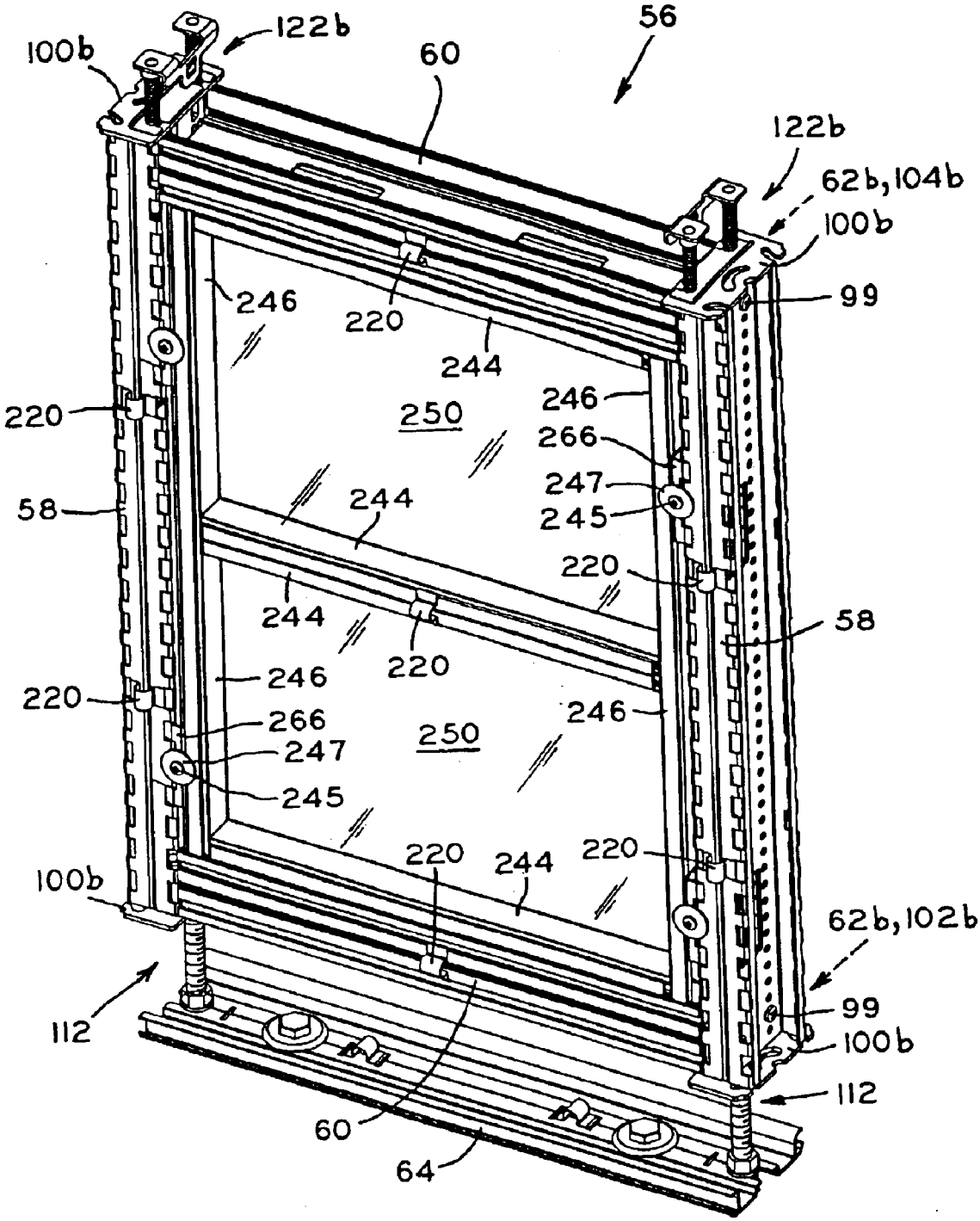
FIG. 22C is a perspective view of a panel frame, including a window frame temporarily held therein by capture plate assemblies.

As shown in FIGS. 9A and 22C, capture plates 300 are attached to vertical frame members 58 to space the distance between vertical frame members 58 and vertical window frame members 246 and, as shown in FIG. 22C, screws 245 and washers 247 may be inserted within capture plates 300 to temporarily stabilize window frame 238 within panel frame 56 until horizontal and vertical window casings 240*a*, 240*b* and 242 are attached to window frame 238 and panel frame 56 to connect widow frame 238 to panel frame 56, as described below.

Referring generally to FIGS. 20, 21, 23, and 24, horizontal and vertical window casings 240*a*, 240*b*, and 242 are respectively attached to horizontal and vertical frame members 244, 246 using spring clips 220 for securing window frame 238 to panel frame 56. Spring legs 224 of spring clips 220 are attached to horizontal and vertical frame members 60, 58 as described above, and spring body portions 222 of spring clips 220 are detachably received within spring clip receptor channels 260 formed longitudinally along horizontal and vertical window casings 240*a*, 240*b*, and 242. Spring body portions 222 of spring clips 220 produce an audible clicking sound when received into spring clip receptor channels 260 to indicate to an installer that window casings 240*a*, 240*b*, and 242 are firmly attached to panel frame 56. Horizontal and vertical window casings 240*a*, 240*b*, and 242 additionally include longitudinal tongues 262 extending therefrom, which are received within longitudinal grooves 264 in horizontal and vertical window frame members 244, 246 to secure window frame 238 to horizontal and vertical window casings 240*a*, 240*b*, and 242.

Figure 19:
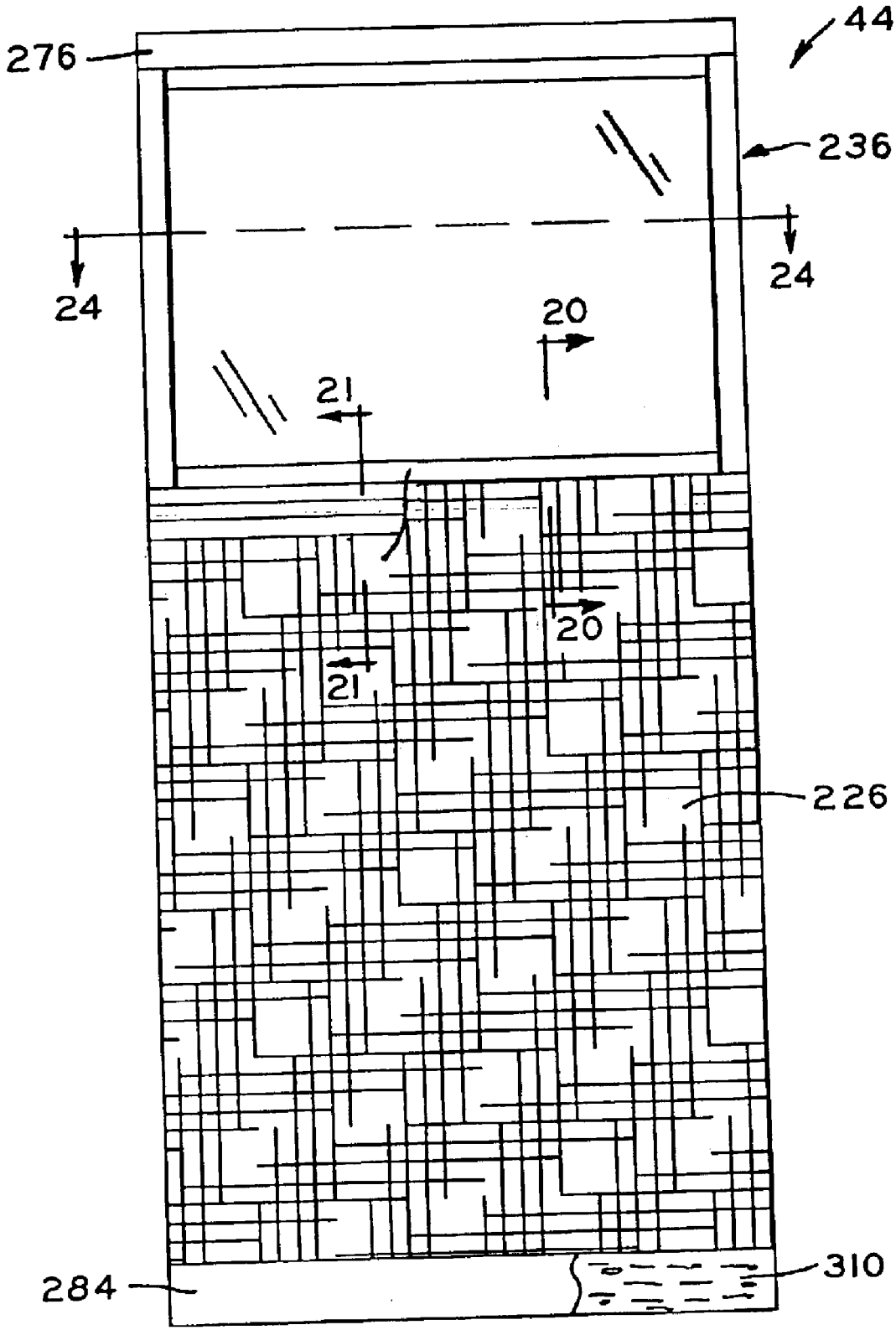
FIG. 19 is a front view of a panel including a window panel disposed above an opaque panel skirt, a portion of the panel further including a mounting track disposed intermediate the opaque panel skin and window panel.
Figure 20:
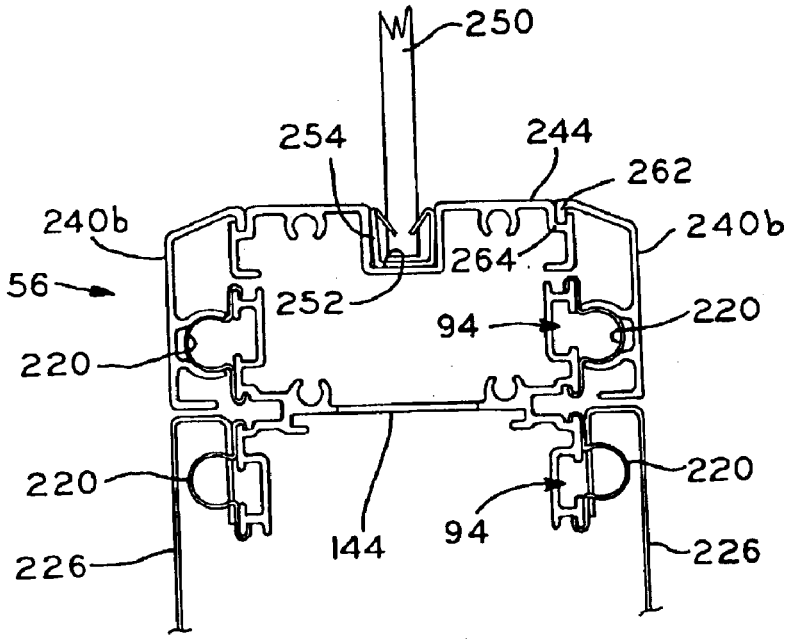
FIG. 20 is a sectional view taken along line 20—20 of FIG. 19.

In the configuration shown in FIGS. 19 and 20, frame 56 includes intermediate frame member 144 with window panel 236 attached thereabove and opaque panel skins 226 attached therebelow. Opaque panel skins 226 are attached via spring clips 220 as described above, wherein spring clips 220 are attached to intermediate horizontal frame member 144 about a lower second channel 94 thereof. Additional spring clips 220, attached about an upper second channel 94 of intermediate horizontal frame member 144, secure second horizontal window casings 340*b* to intermediate horizontal frame member 144. Tongues 262 of second horizontal window casings 240*b* are engaged within grooves 264 of horizontal window frame member 244 to secure horizontal window frame member 144 to frame 56 intermediate second horizontal window casings 240*b*, and window glazing element 254 secures window pane 250 within recess 252 of horizontal window frame member 244.

Figure 25A:
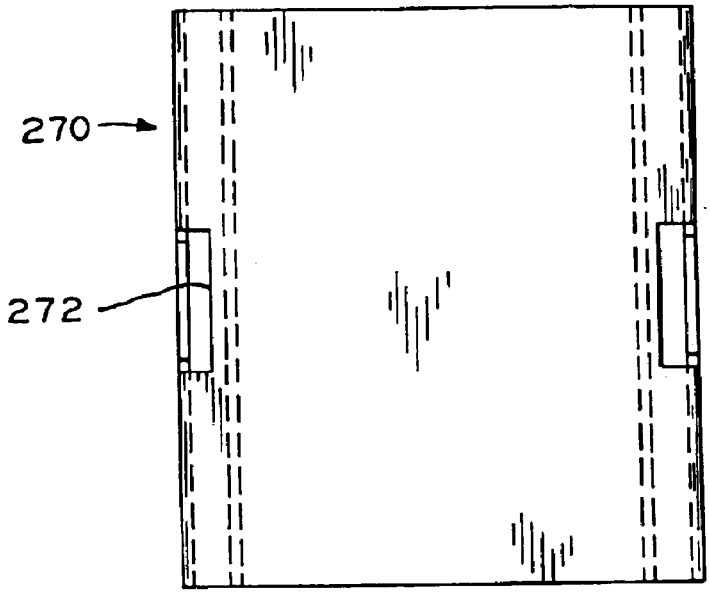
FIG. 25A is a top view of a mounting track/window frame interface bracket.
Figure 25B:
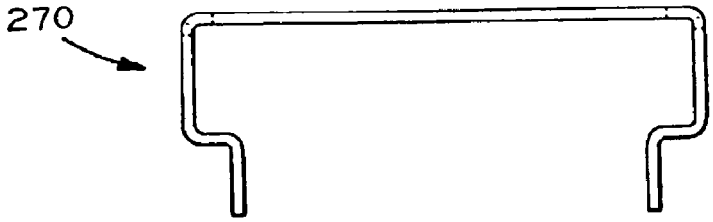
FIG. 25B is an end view of the mounting track/window frame interface bracket of FIG. 25A.
Figure 25C:
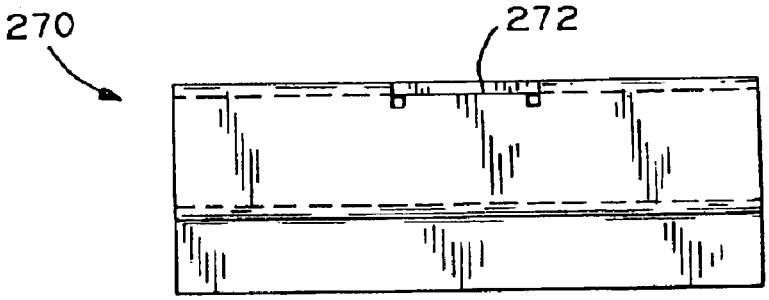
FIG. 25C is a side view of the mounting track/window frame interface bracket of FIG. 25A.

In the configuration shown in FIGS. 19 and 21, frame 56 includes intermediate frame member 144 with window panel 236 attached thereabove and opaque panel skins 226 attached therebelow, and further includes mounting tracks 156 attached to intermediate horizontal frame member 144. Mounting tracks 156 are attached to first channel 92 of intermediate horizontal frame member 144 as described above, and opaque panel skin 226 is captured intermediate side wall portion 84 of intermediate horizontal frame member 144 and lower face surface 168 of mounting track 156. As shown in FIGS. 9A and 21, spring clips 220 include one leg 224 thereof attached to an upper second channel 94 of intermediate horizontal frame member 144 and a second leg 224 thereof attached within slot 272 of mounting track/window panel interface bracket 270 (FIGS. 25A–C), to secure second horizontal window casings 240*b* to intermediate horizontal frame member 144. Mounting track/window panel interface bracket 270 spaces the distance between intermediate horizontal frame member 144 and lower horizontal window frame member 244 and provides stability to the connection therebetween. Tongues 262 of second horizontal window casings 240*b* are engaged within grooves 264 of horizontal window frame member 244 to secure horizontal window frame member 144 to frame 56 intermediate second horizontal window casings 240*b*, and window glazing element 254 secures window pane 250 within recess 252 of horizontal window frame member 244.

Figure 23:
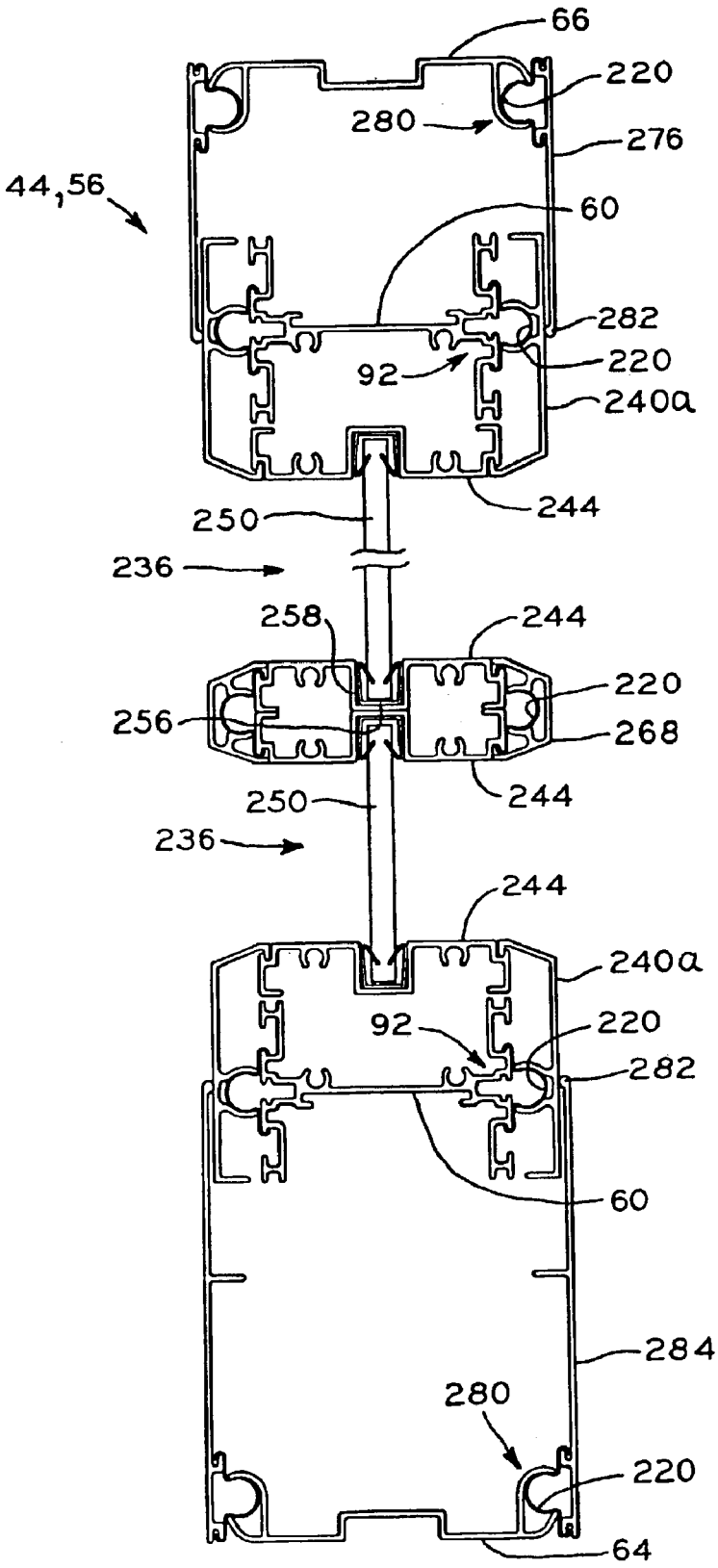
FIG. 23 is a sectional view taken along line 23—23 of FIG. 22A.

Additionally, frame 56 may include two window panels 236 disposed vertically adjacent one another within upper and horizontal frame members 60 of frame 56, as shown in FIGS. 22A–23. In this configuration, spring clips 220 may be used as shown in FIG. 23 to connect adjacent horizontal window frame members 244 to one another in a back-to-back relationship, with intermediate casing members 268 (FIG. 7G) attached to spring clips 220 to mask the connection between the adjacent horizontal window frame members 244 and to provide a smooth trim appearance therebetween. Specifically, as described above with regard to other elements of panel system 42, spring body portions 222 of spring clips 220 are attached to intermediate casing members 268 via engagement of spring body portions 222 thereof within spring clip receptor channels 260 of intermediate casing members 268. Additionally, first horizontal window casings 240*a* are used to connect horizontal window frame members 244 of the upper and lower horizontal frame members 60 of panel frame 56 via additional spring clips 220, which engage the upper and lower horizontal frame members 60 about first channels 92 thereof.

Figure 24:
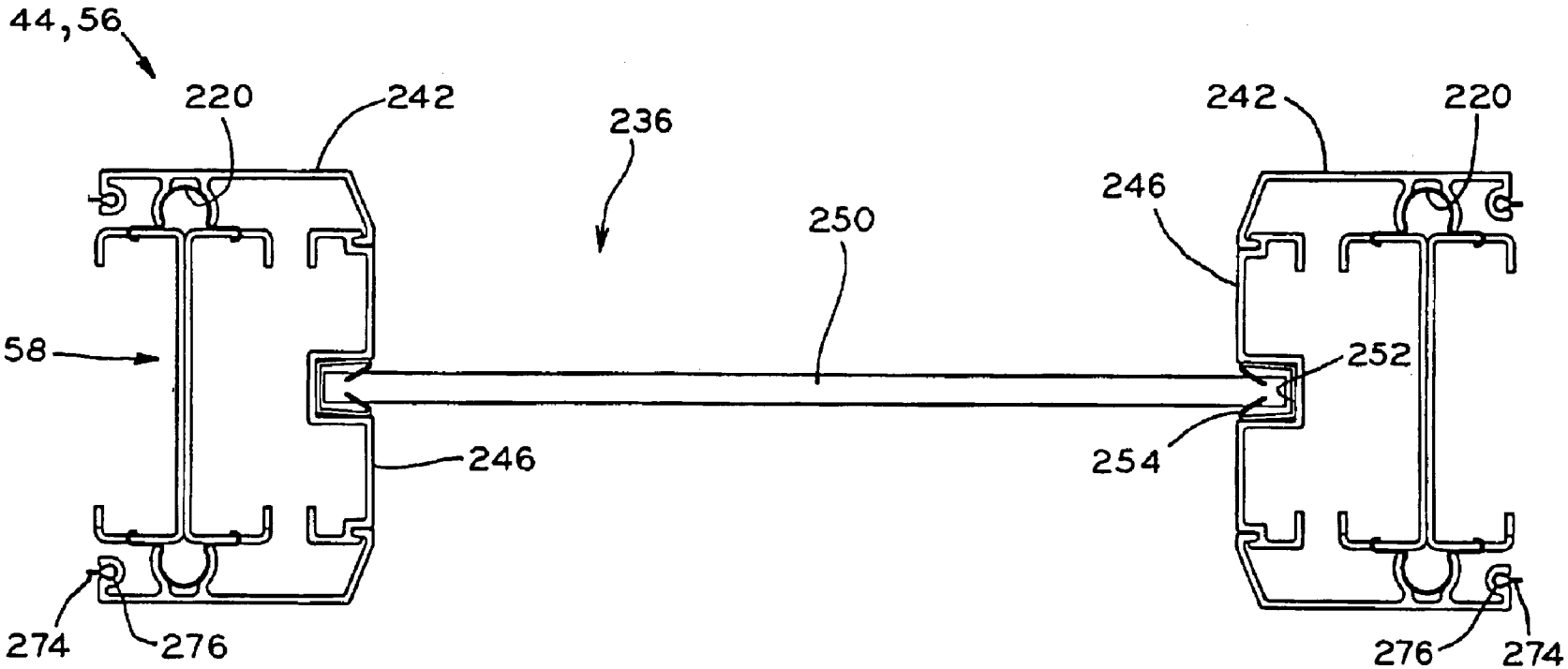
FIG. 24 is a sectional view taken along line 24—24 of FIG. 19.
Figure 27:
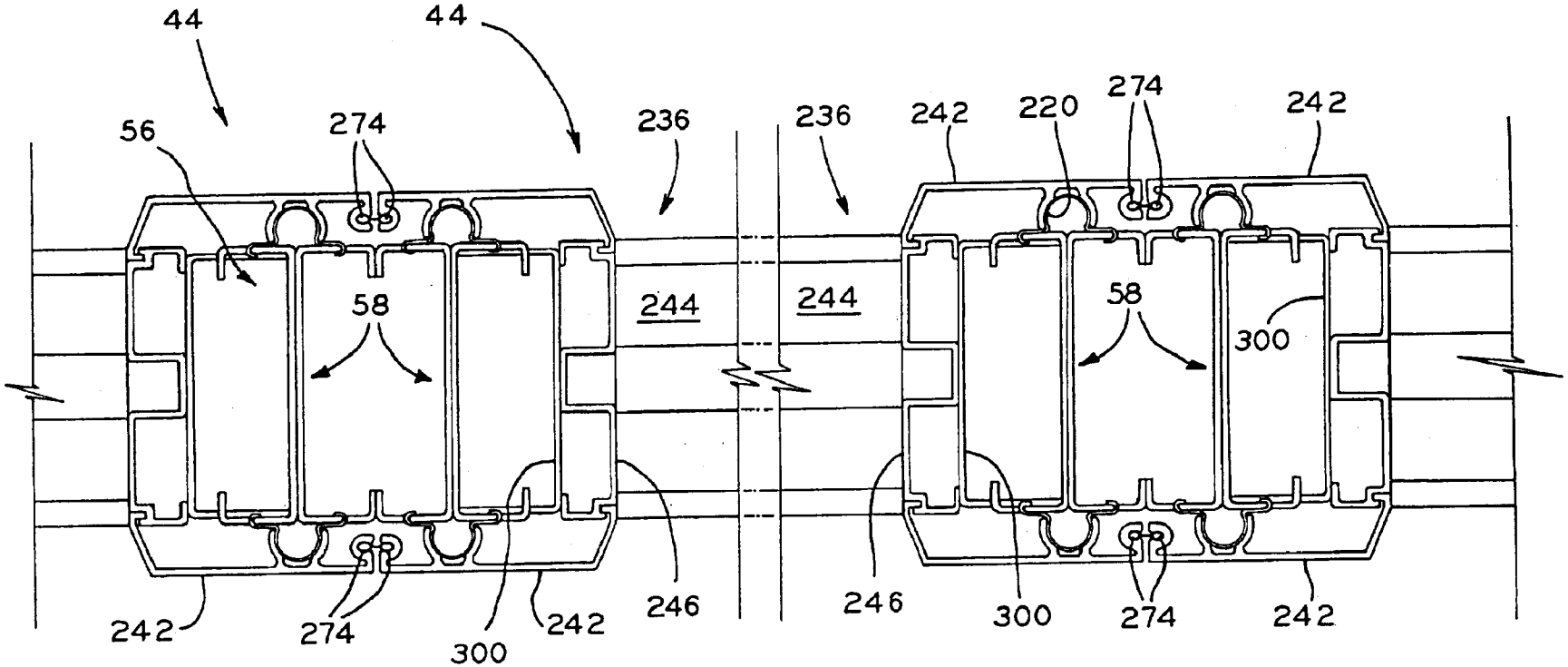
FIG. 27 is a top view showing an end-to-end, panel-to-panel connection between a pair of panels which include window panels, the vertical window casings including contacting vertical light and sound seals.

As shown in FIG. 24, vertical window casings 242 are attached to vertical frame members 58 via spring clips 220, and vertical window frame members 246 are secured to vertical window casings 242 in a similar manner as that described above regarding the horizontal components of window frame 238. When such panels 44, having window panels 236 therein, are connected to one another in a side-to-side manner as shown in FIG. 27, vertical window casings 242 may include light and sound seals 274 disposed within light and sound seal channels 276 (FIG. 7H) of vertical window casings 242 to block the transmission of light and/or sound between the connective interface of such adjacent panels 44.

Figure 30A:
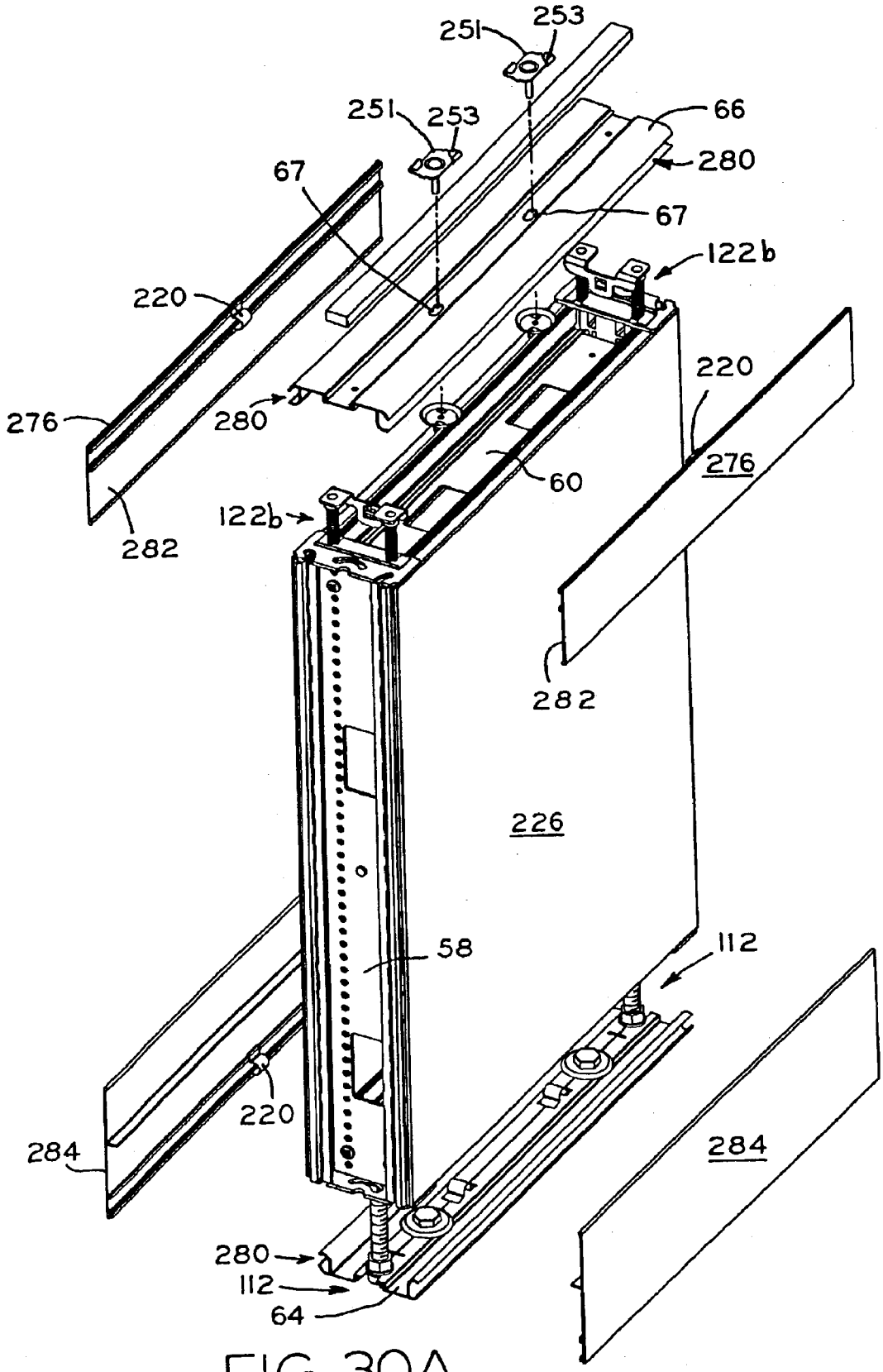
FIG. 30A is an exploded view of an opaque panel, showing the attachment of trim elements to the floor and ceiling tracks thereof.
Figure 30B:
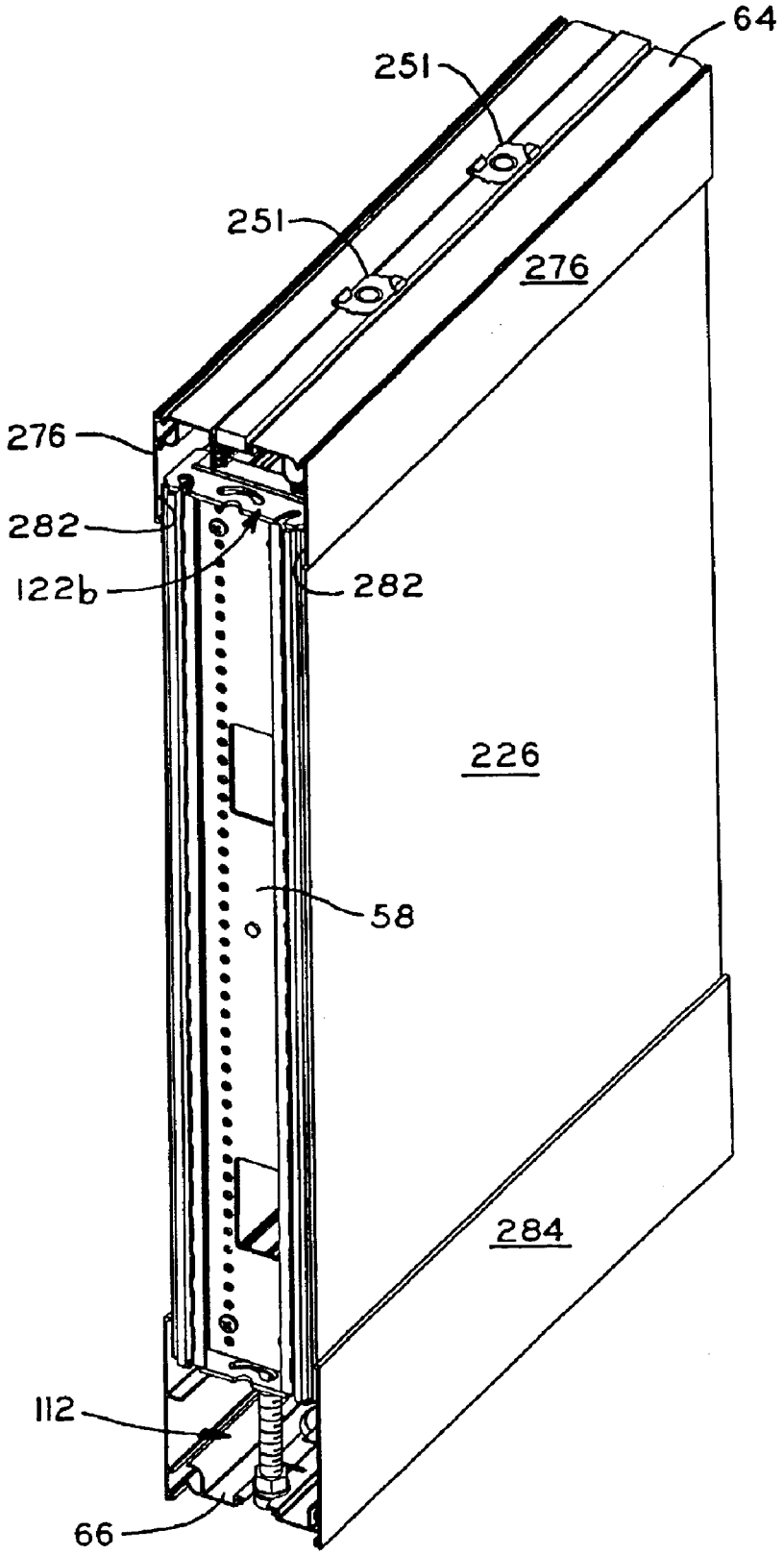
FIG. 30B is a perspective view of the assembled opaque panel of FIG. 30A.

Referring to FIGS. 23, 30*a*, and 30*b*, ceiling trim members 276 (FIG. 7C) are attached to ceiling track 66 with spring clips 220, wherein spring legs 224 of spring clips 220 engage protruding tongues 278 projecting interiorly from ceiling trim members 276, and spring body portions 222 of spring clips 220 engage within spring clip receptor channels 280 defined along the length of each side of ceiling tracks 66. The lower edges of ceiling trim members 276 additionally include protrusions 282 which overlap either horizontal window casings 240*a* (as shown in FIG. 23) or opaque panel skins 226 (as shown in FIG. 30*b*) therebelow to blunt the lower edges of ceiling trim members 276 and also to minimize scuffing of horizontal window casings 240*a* or opaque panel skins 226. Additionally, the overlap between ceiling trim members 276 and horizontal window casings 240*a* or opaque panel skins 226 therebelow allows vertical adjustment of panel frame 56 with respect to ceiling track 66 using jack post assembly 122 as described above, with ceiling trim members 276 masking jack post assemblies 122 and providing a continuous and smooth visual transition between ceiling 54 and horizontal casings 240*a* or opaque panel skins 226 of panel 44.

Similarly, floor trim members 284 (FIG. 7D) are attached to floor track 64 using spring clips 224 in the same manner as described above with respect to ceiling trim members 276. The upper edges of floor trim members 284 include protrusions 282 similar to those of ceiling trim members 276. Additionally, the overlap between the upper edges of floor trim members 284 and either horizontal window casings 240*a* (as shown in FIG. 23) or opaque panel skins 226 (as shown in FIG. 30*b*) thereabove allows vertical adjustment of panel frame 56 with respect to floor track 64 is described above, with floor trim members 284 masking the components of vertical adjustment assembly 112, harness assemblies 186, and electrical jumpers, as well as providing a smooth visual transition between floor 52 and horizontal window casings 240*a* or opaque panel skins 226.

Additionally, as shown in FIGS. 1 and 22A, floor trim members 284 may include apertures therein, through which outlet modules 188 (FIGS. 10, 11, and 22A) of harness assemblies 186 are disposed to provide access to outlet modules 188. Notably, because harness assemblies 186 are attached to floor track 64, panel frame 56 may be vertically adjusted with respect to floor track 64 without vertical movement of harness assemblies 186.

Figure 30C:
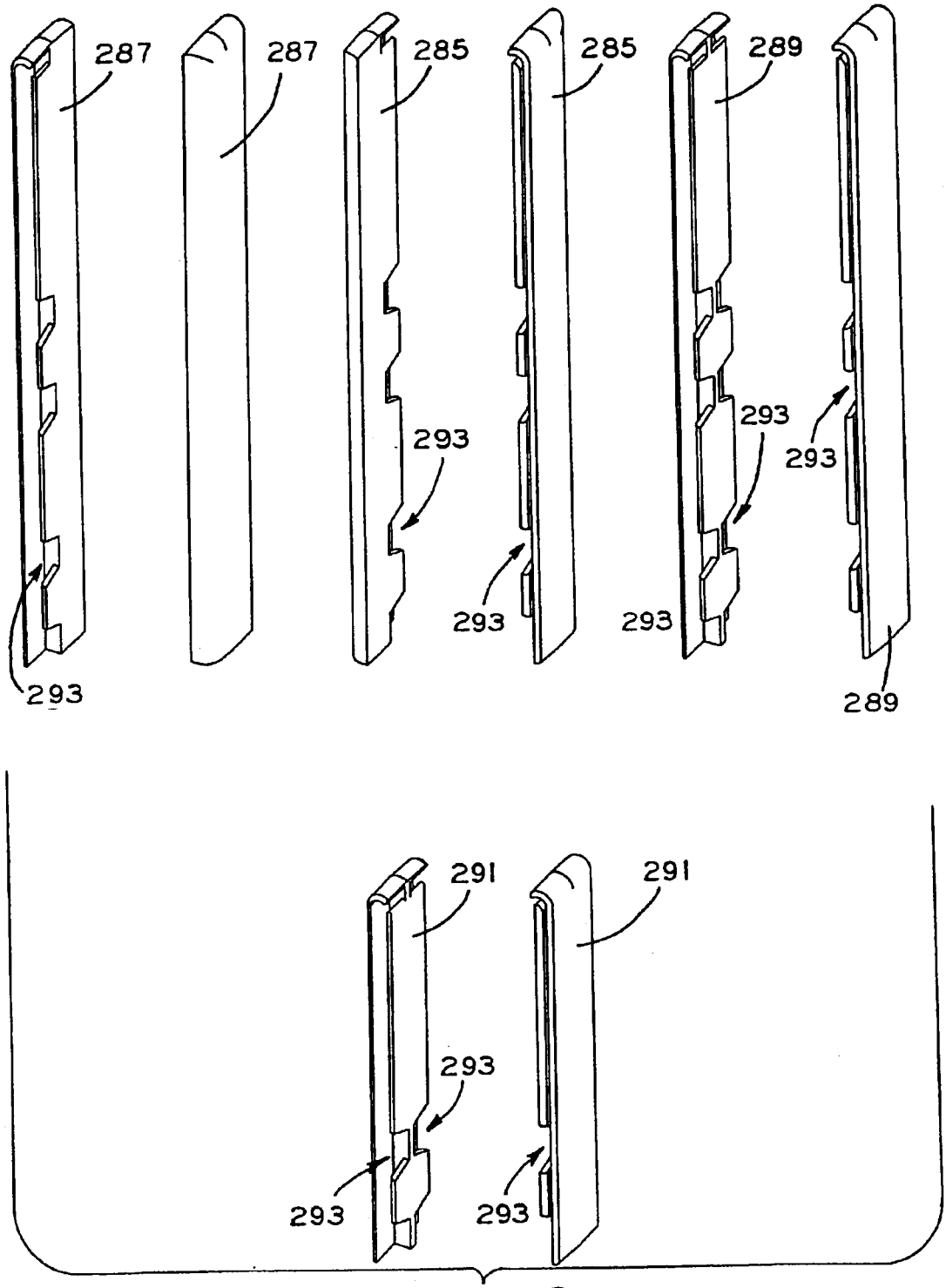
FIG. 30C is a perspective view of various trim end cap and trim splice elements.
Figure 30D:
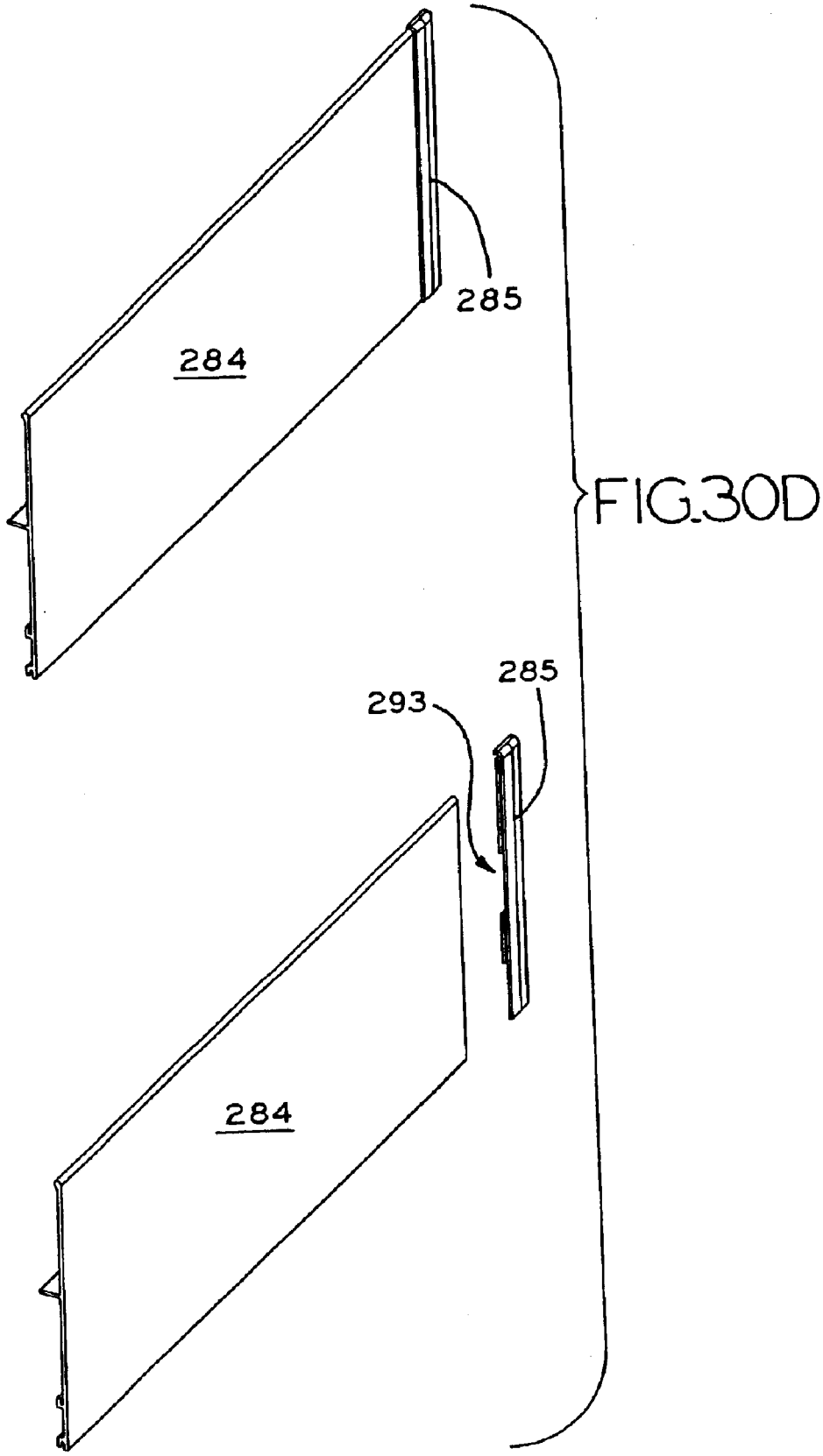
FIG. 30D is a perspective view showing the attachment of a trim end cap to one end of a floor trim member.

As shown in FIG. 30C, various end caps and splice members are provided for attachment to the ends of floor trim members 284 and ceiling trim members 276. Base right end cap 285 includes slot 293 on one side thereof for receipt of the right end of floor trim member 284, as shown in FIG. 30D, for providing an aesthetic, finished end to floor trim member 284 where needed, such as at the end of a panel run, at a door frame (FIG. 28A), or at an L-type panel-to-panel connection, for example. Base left end cap 287, shown in FIG. 30C, functions in the same manner as base right end cap 285. Referring still to FIG. 30C, base splice 289 includes a pair of slots 293 for receipt of the ends of adjacent floor trim members 284 to provide a finished splice connection between abutting floor trim members 284. Similarly, ceiling splice 291 includes a pair of slots 293 for receipt of the ends of abutting ceiling trim members 276 to provide a finished connection therebetween. Further, right and left end caps (not shown) for ceiling trim members 276 may also be provided, which are similar to right and left base end caps 285, 287 of floor trim members 284.

Referring back to FIG. 30A, one exemplary method of attaching panels 44 to ceiling frame members (not shown) within an interior building space is shown, using caddy clips 251. Caddy clips 251 are readily available, and each generally include a pair of sub-clips which engage apertures 67 in ceiling track 66 to connect caddy clips 251 thereto. Hooks 253 of caddy clips 251 are engaged with the ceiling frame members within an interior building space to attach panels 44 to the ceiling structure.

Each of the above-discussed panel components which includes an exterior facing, such as vertical window casings 242, horizontal window casings 240*a*, 240*b*, intermediate window casings 268, as well as ceiling and floor trim members 276, 284, respectively, for example, may include a veneer sheet secured thereon in a suitable manner to provide a desired finish. For example a portion of a veneer sheet 311 is shown in FIG. 7H laminated to vertical window casing 242. Referring to FIG. 19, a portion of veneer sheet 311 is shown laminated to the exposed surface of floor trim member 284 to provide an attractive simulated wood grain finish to the foregoing.

Figure 28A:
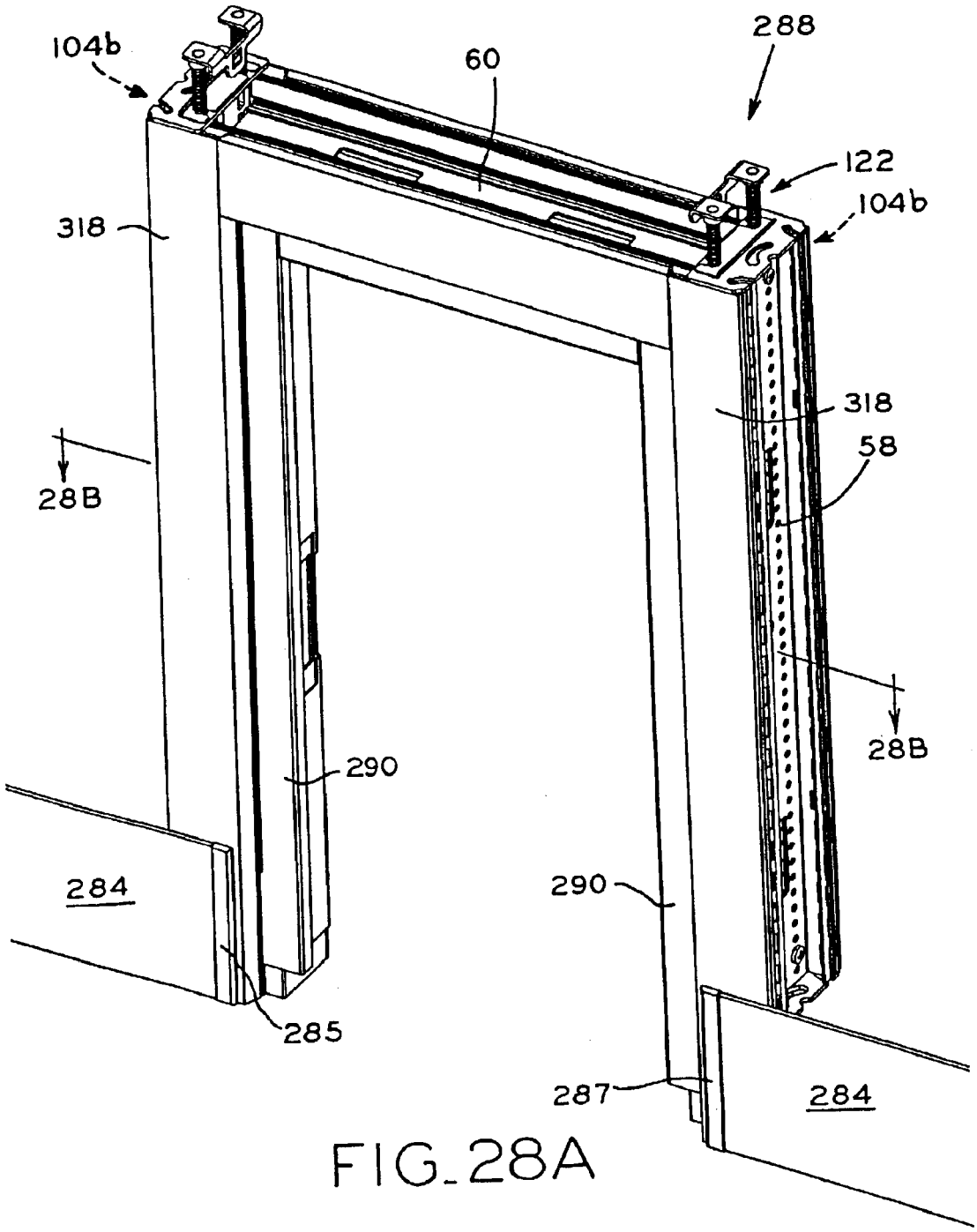
FIG. 28A is a perspective view of a door frame assembly.

Referring to FIGS. 28A and B, door frame assembly 288 is shown. As shown in FIG. 28A, door frame assembly 288 includes a pair of vertical frame members 58 connected at the upper ends thereof with a single upper horizontal frame member 60 via jack post blocks 104*b*, as described above. Further, vertical trim members 318 are attached to vertical frame members 58, and floor trim members 284 with end caps 285, 287, overlap vertical trim members 318.

Figure 28B:
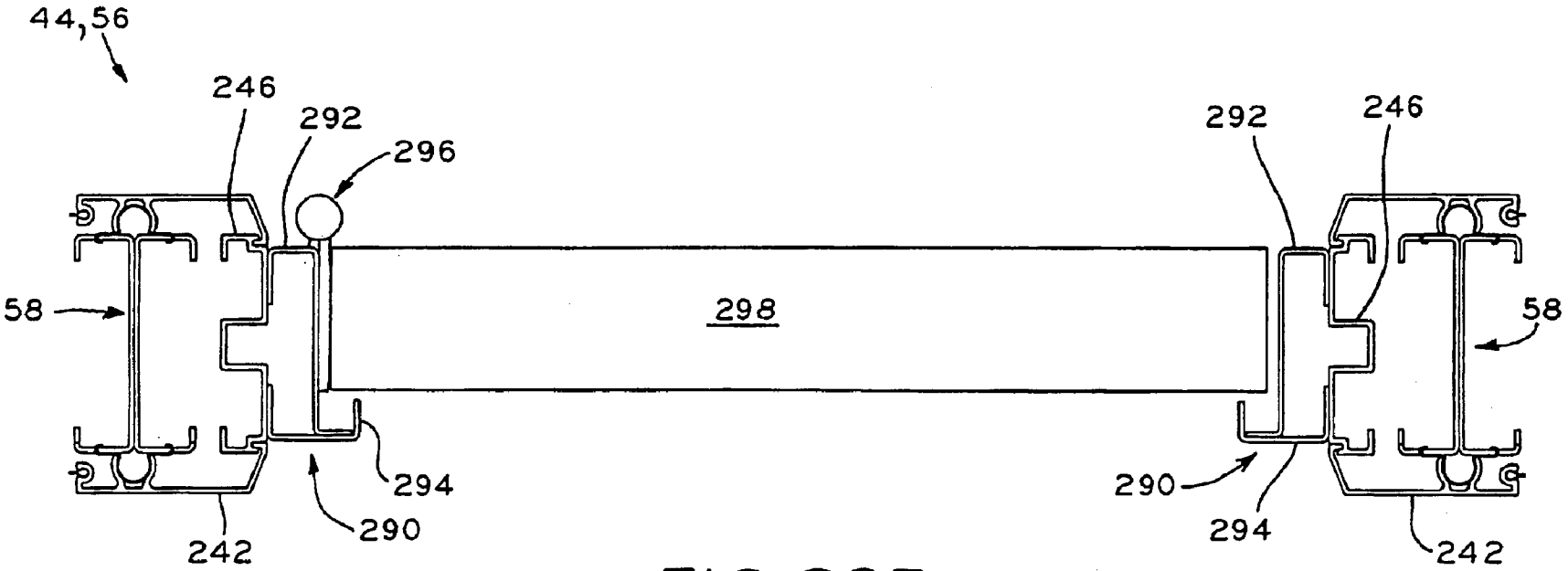
FIG. 28B is a sectional view taken along line 28B—28B of FIG. 28A.

Referring to FIG. 28B, door frame assembly additionally includes door frame members 290, which may be fitted with suitable door latch hardware. Door frame members 290 include sub-frame members 292, 294, which may be formed from bent steel, for example, and which are attached to one another by a suitable method such as welding. Door frame members 290 are secured to vertical window frame members 246 in a suitable manner, such as by welding or with fasteners. Vertical window frame members 246 are connected to vertical window casings 242, which are in turn connected to vertical frame members 58 of frame 56, as described above. Hinge member 296 is mounted to one door frame members 290 and to door 298 to hingedly connect door 298 to panel frame 56, and the opposite door frame member 290 serves as a jamb for door 298.

Figure 29:
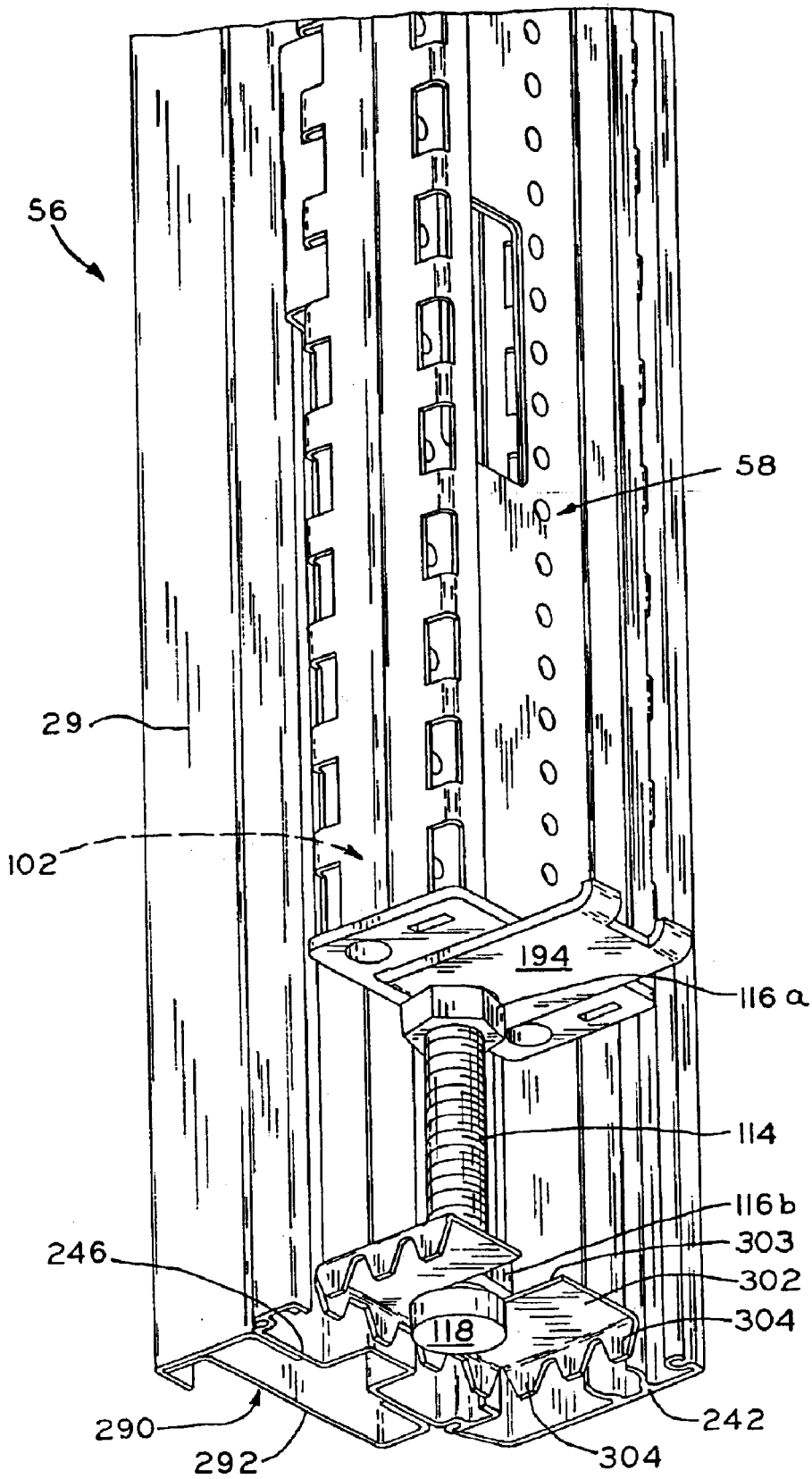
FIG. 29 is a perspective view, looking upwardly, showing a lower portion of the door frame assembly of FIGS. 28A and 28B, including a carpet gripper attached to the panel support block.

Further, referring to FIG. 29, which depicts a lower portion of door frame assembly 288, looking upwardly, door frame assembly 288 may include carpet gripper elements 302 connected to bolt 114 of panel support blocks 102*a* (or 102*b*). Carpet grippers 109 may include a steel plate with a U-shaped slot 303 and a plurality of bent gripper teeth 304 depending therefrom to engage a floor surface. Carpet gripper elements 302 replace floor track 64 in the particular panels 44 which define door frame assembly 288, and are attached to panel support blocks 102 of frame 56 by inserting U-shaped slot 303 of carpet gripper elements 302 between head 118 and nut 116*b* of bolt 114 of vertical adjustment assembly 112 to capture carpet gripper element 302 between nut 116*b* and head 118 of bolt 114.

Figure 31A:
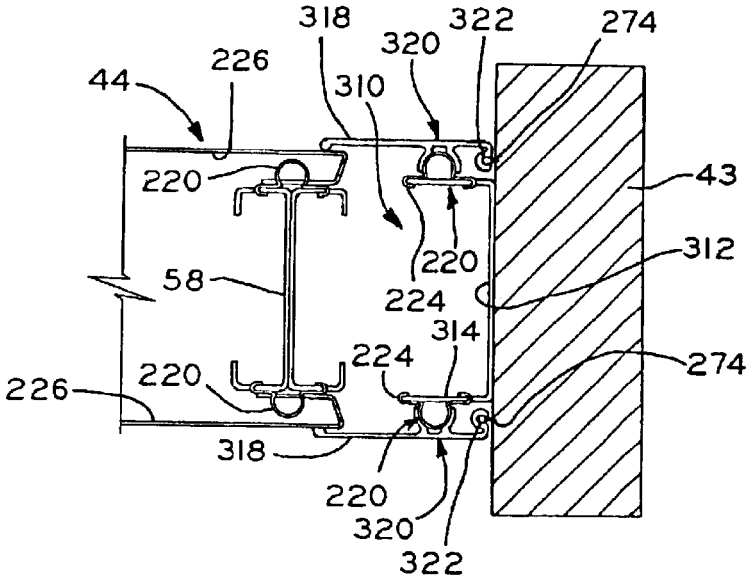
FIG. 31A is a top view of a wall start condition.
Figure 31C:
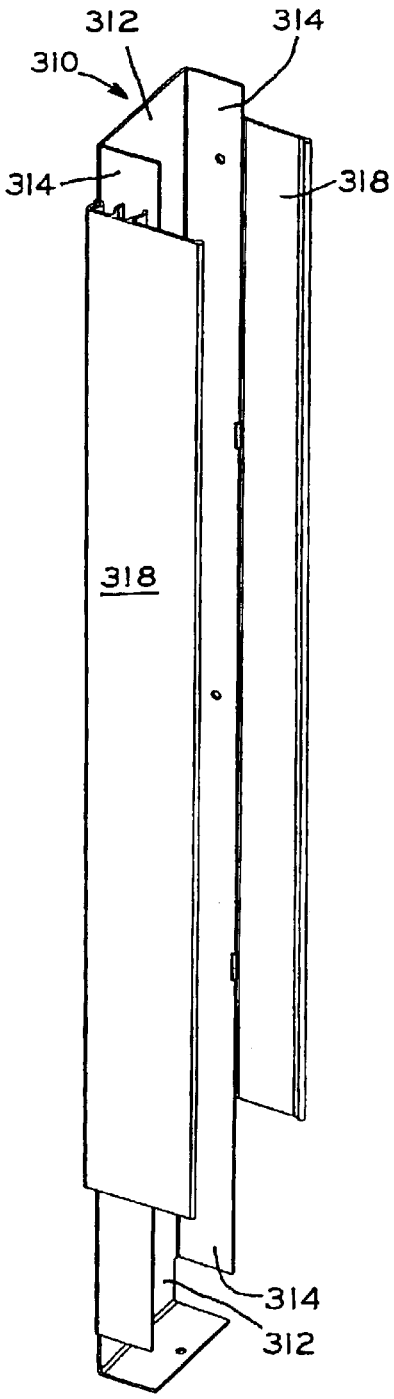
FIG. 31C is a perspective view of the assembly of FIG. 31B.
Figure 31B:
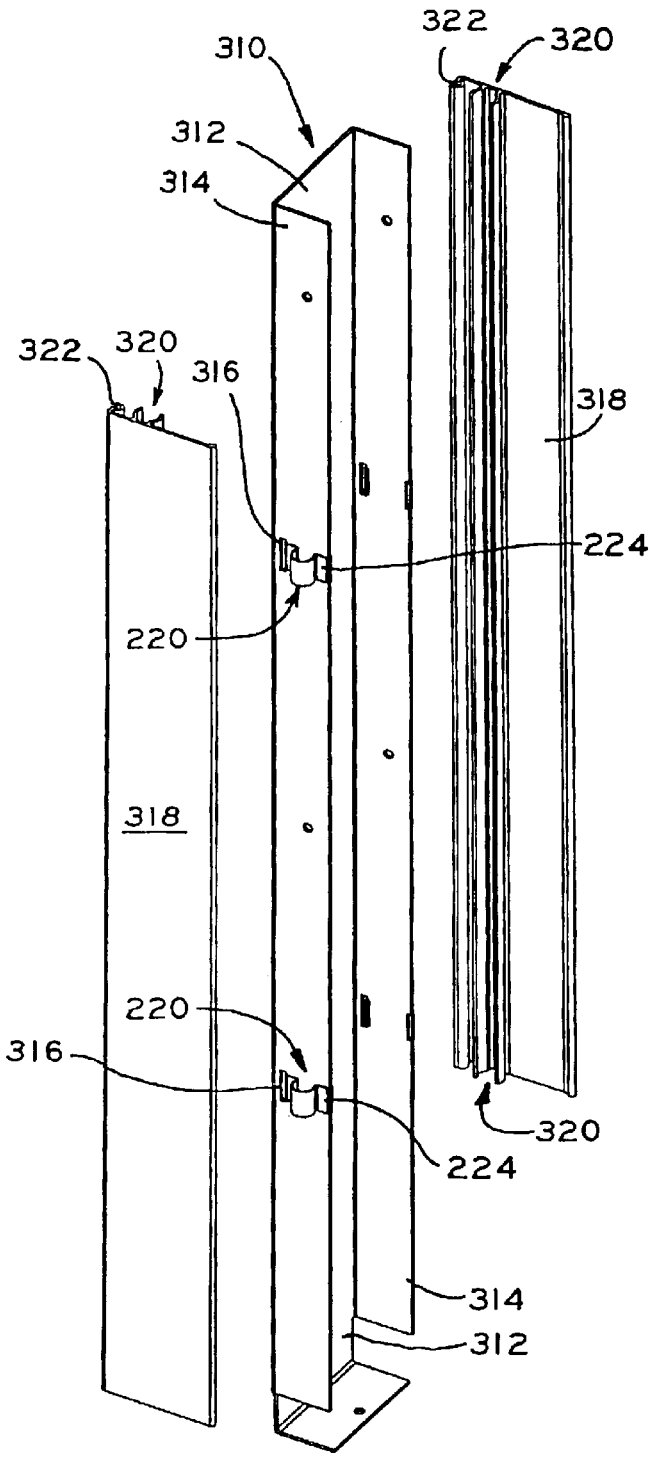
FIG. 31B is an exploded view of a portion of the wall start condition of FIG. 31A, showing a wall start member and a pair of vertical trim members.

A wall start configuration is shown in FIG. 31A, such as when a run of panels 44 extend from a permanent wall 43. The wall start configuration includes wall start member 310, shown in FIGS. 31B and 31C. Wall start member 310 includes base wall 312 which is attached to existing, permanent wall 43 by any suitable fasteners (not shown). Additionally, wall start member 310 includes side walls 314 extending from base wall 312, which, as shown in FIG. 31B, include vertical slots 316 therein. Spring legs 224 of spring clips 220 engage slots 316 and the edges of side walls 314 to attach spring clips 220 to wall start member 310. Vertical trim members 318 (FIG. 71) are attached to wall start member 310 by engaging spring clips 220 within spring clip receptor channels 320 of vertical trim members 318. As shown in FIG. 31A, vertical trim members 318 include grooves 322 for receipt of light and sound seals 274, which engage the surface of permanent wall 43 to block transmission of light and sound through the wall start configuration. Additionally, the opposite ends of vertical trim members 318 overlap opaque panel skins 226 of a panel 44 which is located adjacent permanent wall 43.

Figure 32A:
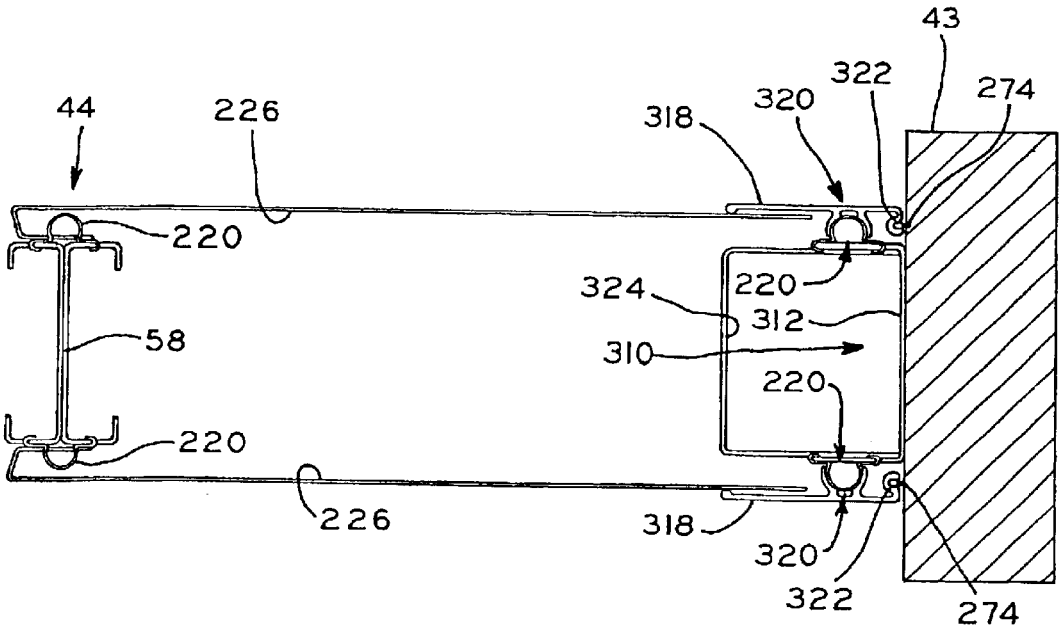
FIG. 32A is a top view of an end filler condition.
Figure 32B:
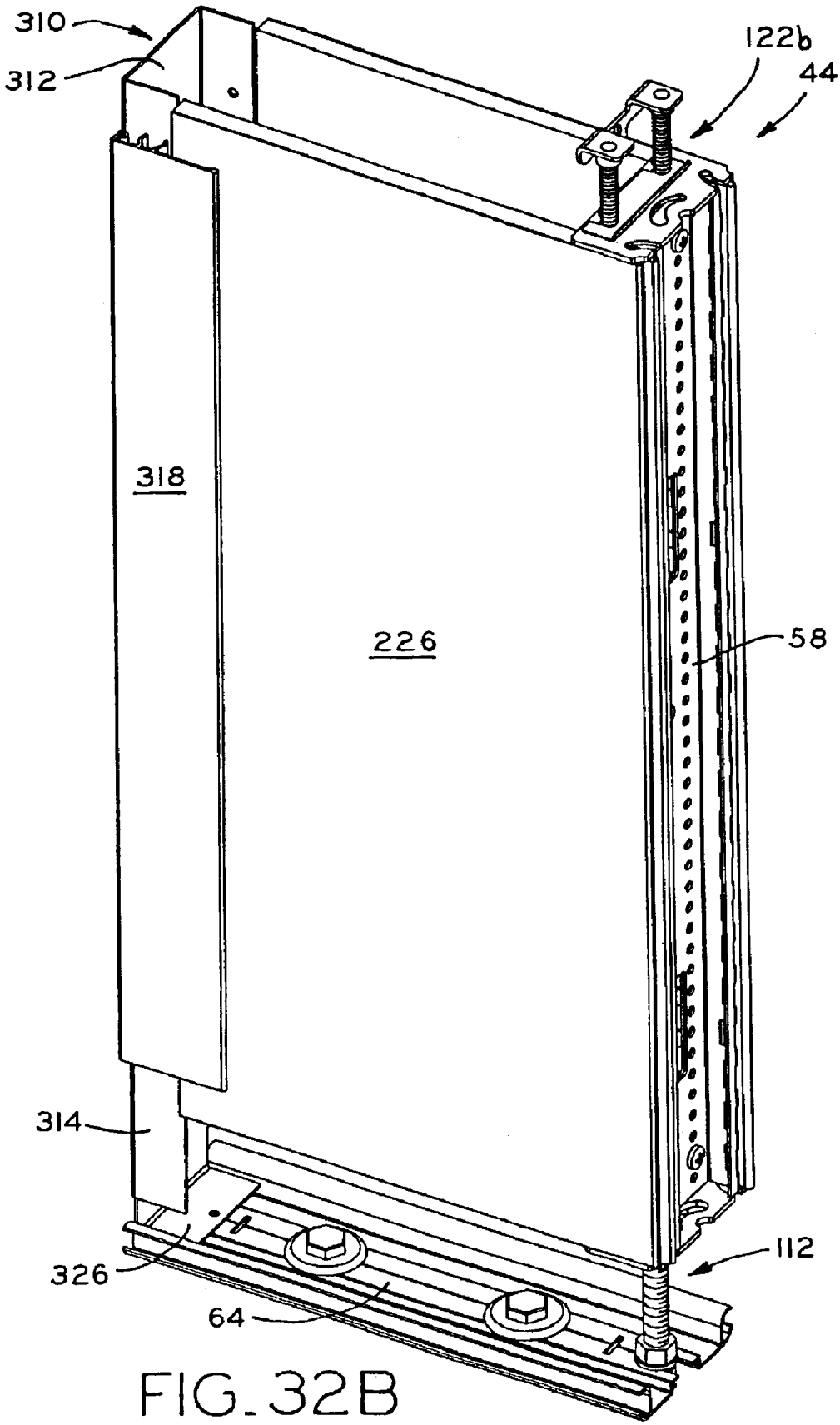
FIG. 32B is a perspective view of a portion of the end filler condition of FIG. 32A.

Referring to FIGS. 32A and 32B, an end filler condition is shown, such as when the end of a run of panels approaches a permanent wall 43. The end filler condition is substantially identical to the wall start configuration shown in FIGS. 31A–C, in that the end filler condition includes wall start member 310 secured to permanent wall 43, and vertical trim members 318 attached to wall start member 310 as described above. Opaque panel skins 226 of panel 44 adjacent permanent wall 43 may be cut to any desired width during installation of panel 44 to fill the gap between panel 44 and permanent wall 43 in the end filler configuration. Opaque panel skins 226 are attached to frame 56 of panel 44 using spring slips 220 as discussed above, and are cantilevered outwardly of panel frame 56 of panel 44 toward wall start member 310. The ends of vertical trim members 318 overlap opaque panel skins 226 to provide a continuous, finished appearance. As shown in FIG. 32A, wall start member 310 additionally includes a C-shaped brace member 324 attached thereto to maintain the spacing between opaque panel skins 226 on either side of the end filler configuration. As shown in FIG. 32B, bottom flange 326 of wall start member 310 rests against the top of floor track 64.

Figure 33A:
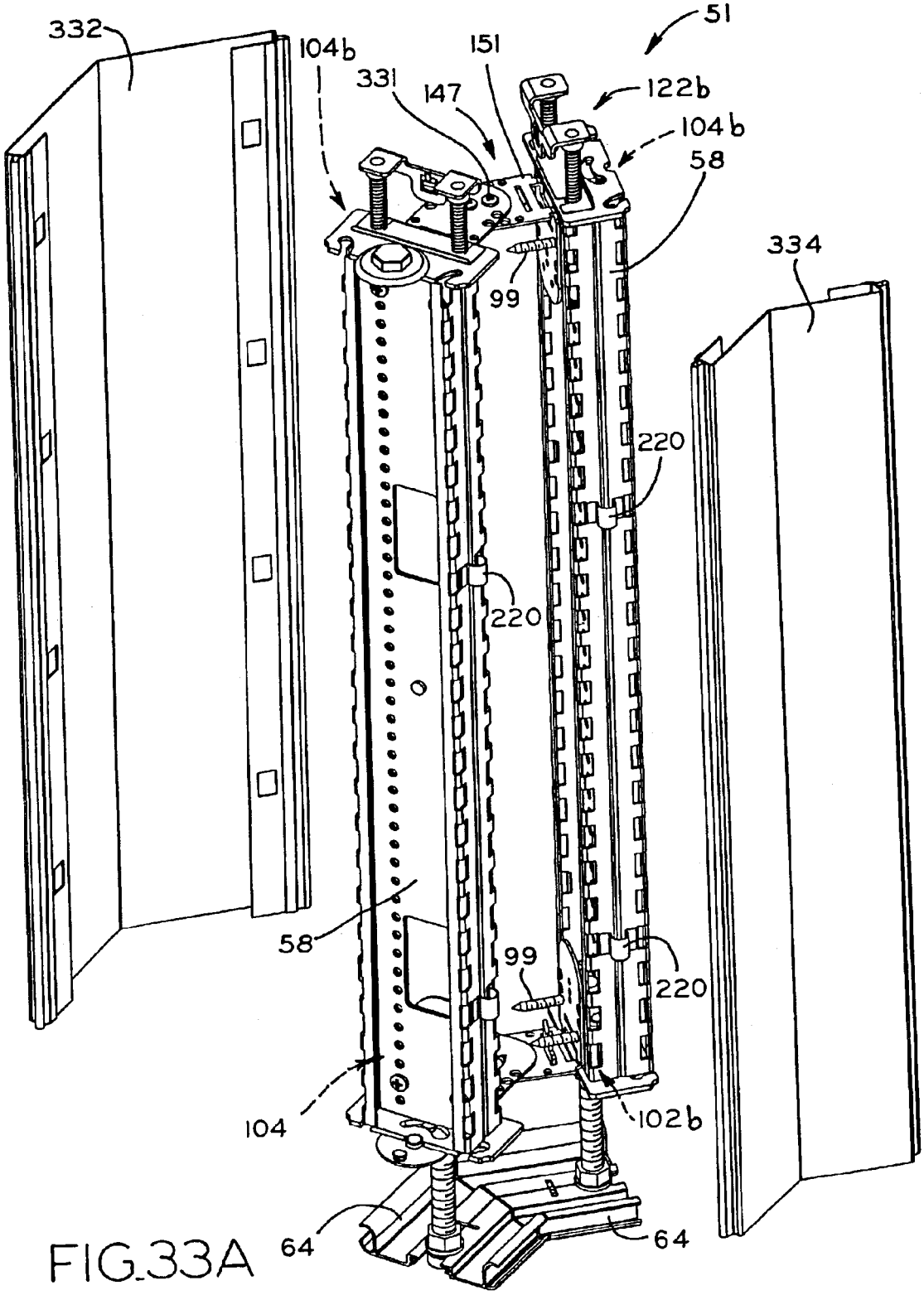
FIG. 33A is an exploded view of a portion of a 135° panel-to-panel connection.
Figure 33B:
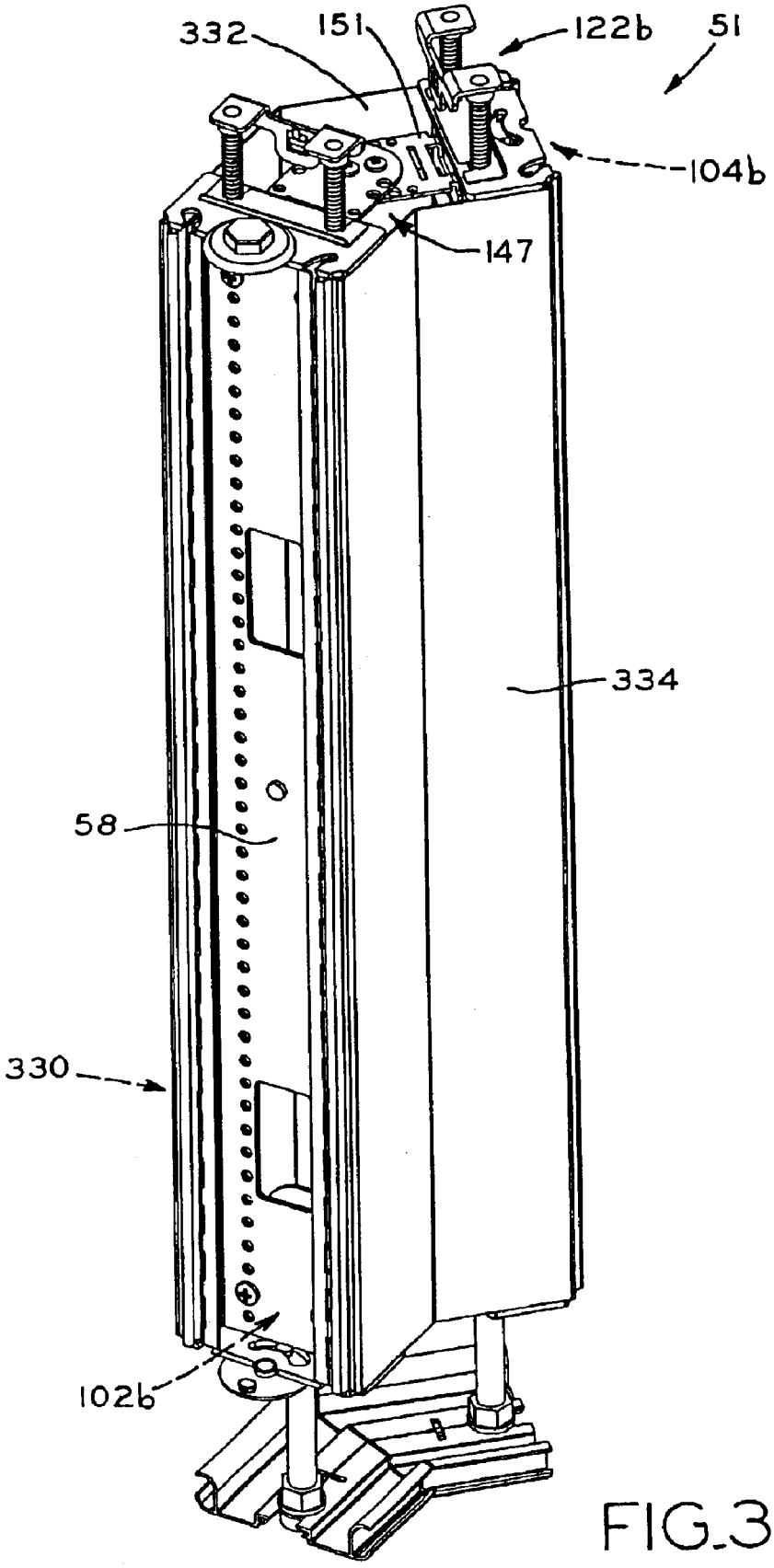
FIG. 33B is a perspective view of the assembly of FIG. 33A.

A 135° panel-to-panel connection 51, shown in FIG. 1, is shown in more detail in FIGS. 33A and 33B, wherein L-shaped brackets 147 (FIG. 9B) are used to connect vertical frame members of the frames of adjacent panels which are aligned 135° with respect to one another. Fasteners 99 connect jack post blocks 104*b* and panel support blocks 102*b* to second flanges 151 of L-shaped brackets 147. Additional fasteners 331 are received within 135° connection holes 161 and center holes 159 (FIG. 9B) of second flanges 151 of L-shaped brackets 147 to secure L-shaped brackets 147 of adjacent panels to one another in a 135° angle with respect to one another. In 135° corner connection 330, floor tracks 64 of adjacent panels have ends which are cut in a mitered arrangement as shown. Additionally, 135° exterior panel 332 and 135° interior panel 334 are attached to adjacent vertical frame members 58 of adjacent panels using spring clips 220 in the manner described above with respect to opaque panel skins 226. Referring to FIGS. 33A and 33B, it may be seen that by varying the location of 135° connection holes 161 and center holes 159 of L-shaped brackets 147, and also by varying the angle of the miter cuts at the ends of floor tracks 64, adjacent panels may be connected to one another at various angles other than 135°.

The installation of a representative panel in panel system 42 will now be generally described as follows. First, panel frame 56 is assembled as described above, which includes vertical and horizontal frame members 58, 60, one or more intermediate horizontal frame member 144 if desired, jack post blocks 104*a* or 104*b*, panel support blocks 102*a* or 102*b*, and floor track 64 secured to panel support blocks 102*a* or 102*b* via vertical adjustment assembly 112. Additionally, floor track 64 may also include harness assemblies 186 attached thereto. Ceiling track 66 is secured to a ceiling grid in a conventional manner using caddy clips 251 or other types of fasteners, for example. Ceiling track 66 may be secured directly to the ceiling grid members along the longitudinal axes of same, or alternatively, ceiling tracks 66 may be secured in an oblique manner with respect to the ceiling track gridwork within an interior building space.

Panel frame 56 is then slid or "skidded" across the floor surface by an installer on curved edges 142 of floor track 64 to locate panel frame 56 beneath a corresponding ceiling track 66, after which panel frame 56 is tilted to a vertical position therebeneath. Then, jack post assemblies 122*a* or 122*b* are extended into engagement with ceiling track 66 as described above to releaseably attach panel frame 56 to ceiling track 66. Thereafter, carpet grippers 109 are installed as described above to anchor the panel frame to a carpeted floor surface. Optionally, screws play be threaded through floor track 64 and into gripping engagement with carpet on a floor surface, or threaded directly into a floor surface, if desired, to further secure panel frame 56 in position.

After panel frame 56 is secured in position as described above, jumpers and outlet modules 188 may be attached to harness assemblies 186 to provide electrical and/or data service throughout panel system 42. Additionally, mounting tracks 156 may be attached to frame 56 as described above and shown in FIGS. 21 and 34. Opaque panel skins 226, window panels 236, or any combination of the foregoing may be attached to frame 56 as described above in any desired configuration. Finally, ceiling and floor trim members 276, 284 are attached to ceiling and floor tracks 66, 64, respectively, to mask the attachment between frame 56 and each of the floor 52 and ceiling 54. Additionally, during the installation of panel system 42, additional panels 44 may be attached to one another using panel connecting brackets 194 and/or corner posts 212 according to a first embodiment, or by using cam locks 181 and/or corner post units 213 and/or finished end units 195 according to a second embodiment, to provide end-to-end panel connections, or to form building or furniture module T-type connections 48*a*, 48*b*, building or furniture module L-type connections 50*a*, 50*b*, or building or furniture module X-type connections, as described above.

While this invention has been described as having preferred designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A partition system for partitioning a work space, comprising:

a frame, said frame including at least one vertical frame member having a series of substantially vertically aligned first holes therein, and at least one horizontal frame member;

at least one bracket having a first portion attached to said horizontal frame member and a second portion having at least one second hole therein adapted to align with at least one of said first holes in said vertical frame member;

at least one fastening element inserted through said first and second holes to secure said horizontal frame member to said vertical frame member; and a track member supported horizontally on said horizontal frame member, said track member configured for attachment of modular furniture components thereto.

2. The partition system of claim 1, wherein said work space includes a floor and a ceiling, and wherein a first portion of said frame is supported on said floor and a second portion of said frame is attached to said ceiling.

3. The partition system of claim 1, wherein said frame includes a pair of vertical frame members, an upper horizontal frame member, a lower horizontal frame member, an intermediate horizontal frame member, and a pair of said brackets connecting said intermediate horizontal frame member at opposite ends thereof to said vertical frame members.

4. The partition system of claim 1, wherein the center-to-center distance between each of said vertically aligned holes of said vertical frame member is one half of an inch, such that said horizontal frame member may be selectively secured by said at least one fastening element at one half inch vertical intervals with respect to said vertical frame member.

5. The partition system of claim 4, wherein each of said first and second portions of said bracket are attachable to said horizontal frame member, and each of said first and second portions of said bracket include at least two holes therein.

6. The partition system of claim 5, wherein one of said first and second portions of said bracket is attached to said horizontal frame member, and the other of said first and second portions of said bracket is attached to said vertical frame member.

7. The partition system of claim 5, wherein said holes in at least one of said first and second portions of said bracket are disposed for receipt of said at least one fastening element, such that said horizontal frame member may be selectively secured by said at least one fastening element at one eighth inch vertical intervals with respect to said vertical frame member.

8. The partition system of claim 1, in combination with an existing permanent wall having a track member horizontally supported thereon, wherein said partition system frame is disposed adjacent said permanent wall, and wherein said track member of said permanent wall is horizontally aligned with said track member of said partition system frame.

9. The partition system of claim 8, including a modular office component mounted to at least one of said track member of said permanent wall and said track member of said partition system frame.

10. The partition system of claim 1, wherein said horizontal frame member includes a horizontal channel therein, and said track member is supported by said horizontal frame member by at least one threaded fastener inserted through said track member and engaged within said channel.

11. In combination:

a permanent wall having a first track member horizontally supported thereon, said first track member configured for attachment of a modular furniture component thereto; and a partition system frame having at least one horizontal frame member, and a second track member horizontally supported on said at least one horizontal frame member, said second track member configured for attachment of a modular furniture component thereto; and at least one panel mounted to said partition system frame, said at least one panel not covering said second track member such that said second track member is exposed;

wherein said partition system frame is disposed adjacent said permanent wall, and wherein said first track member of said permanent wall is horizontally aligned with said second track member of said partition system frame.

12. The partition system of claim 11, including a modular office component mounted to at least one of said first track member of said permanent wall and said second track member of said partition system frame.

* * * * *